US011551888B2

(12) United States Patent
Yang et al.

(10) Patent No.: US 11,551,888 B2
(45) Date of Patent: Jan. 10, 2023

(54) KEYSWITCH STRUCTURE AND KEYBOARD

(71) Applicant: Darfon Electronics Corp., Taoyuan (TW)

(72) Inventors: Chen Yang, Taoyuan (TW); Chia-Hung Liu, Taoyuan (TW); Yu-Chun Hsieh, Taoyuan (TW)

(73) Assignee: DARFON ELECTRONICS CORP., Taoyuan (TW)

( * ) Notice: Subject to any disclaimer, the term of this patent is extended or adjusted under 35 U.S.C. 154(b) by 0 days.

(21) Appl. No.: 17/167,202

(22) Filed: Feb. 4, 2021

(65) Prior Publication Data

US 2021/0249203 A1 Aug. 12, 2021

(30) Foreign Application Priority Data

Feb. 6, 2020 (TW) ..... 109103760

(51) Int. Cl.
*H01H 13/20* (2006.01)
*H01H 13/04* (2006.01)
(Continued)

(52) U.S. Cl.
CPC ..... *H01H 13/20* (2013.01); *H01H 13/04* (2013.01); *H01H 13/14* (2013.01); *H01H 13/70* (2013.01); *H01H 2233/07* (2013.01)

(58) Field of Classification Search
CPC ..... H01H 3/125; H01H 13/705; H01H 13/14; H01H 13/70; H01H 13/704;
(Continued)

(56) References Cited

U.S. PATENT DOCUMENTS 4,642,433 A * 2/1987 Murata ..... H01H 13/36 200/308
6,236,339 B1 5/2001 Kamizono
(Continued)

FOREIGN PATENT DOCUMENTS

CN 204905117 U 12/2015
CN 205542520 U 8/2016
(Continued)

OTHER PUBLICATIONS

Chinese Language Office Action for the corresponding Taiwan application (No. 11020787050) dated Aug. 13, 2021.

*Primary Examiner* — Ahmed M Saeed
(74) *Attorney, Agent, or Firm* — McClure, Qualey & Rodack, LLP

(57) ABSTRACT

A keyswitch structure includes a base, a cap disposed corresponding to the base, a restoring member disposed between the base and the cap, and a tactile adjustment unit. The cap has a cam portion movable relative to the base. The restoring member is configured to provide a restoring force to enable the cam portion to move away from the base. The tactile adjustment unit is disposed corresponding to the cam portion and includes a holder and a tactile feedback member mounted on the holder. The holder is movable relative to the base to change a position of the tactile feedback member relative to the cam portion, so as to change a pressing force required for the cam portion to move toward the base.

17 Claims, 33 Drawing Sheets

(51) Int. Cl.
*H01H 13/70* (2006.01)
*H01H 13/14* (2006.01)

(58) Field of Classification Search
CPC ..... H01H 13/7065; H01H 13/7006; H01H 13/7057; H01H 13/78; H01H 13/79; H01H 13/52; H01H 13/703; H01H 13/50
See application file for complete search history.

(56) References Cited

U.S. PATENT DOCUMENTS

| | | | |
|---|---|---|---|
| 10,079,601 | B2 | 9/2018 | Liu |
| 10,310,609 | B2 | 6/2019 | Liu |
| 10,410,808 | B2 | 9/2019 | Yuan et al. |
| 10,431,402 | B2 | 10/2019 | Hsieh et al. |
| 2018/0069550 | A1 | 3/2018 | Lehmann et al. |
| 2019/0393004 | A1 | 12/2019 | Wang et al. |

FOREIGN PATENT DOCUMENTS

| | | | |
|---|---|---|---|
| CN | 106024474 | A | 10/2016 |
| CN | 106683930 | A | 5/2017 |
| CN | 108091514 | A | 5/2018 |
| CN | 108346539 | A | 7/2018 |
| CN | 108766817 | A | 11/2018 |
| CN | 108922810 | A | 11/2018 |
| CN | 108010775 | B | 8/2019 |
| CN | 110277267 | A | 9/2019 |
| JP | H11265252 | A | 9/1999 |
| TW | I581290 | B | 5/2017 |
| TW | I607477 | B | 12/2017 |
| TW | I632576 | B | 8/2018 |

* cited by examiner

KEYSWITCH STRUCTURE AND KEYBOARD

BACKGROUND OF THE INVENTION

1. Field of the Invention

The invention generally relates to a keyswitch structure. Particularly, the invention relates to a keyswitch structure and a keyboard with adjustable tactile feedback.

2. Description of the Prior Art

Keyswitches in a conventional keyboard generally provide only one kind of tactile feedback. Users have to select the keyboard with appropriate tactile feedback among keyboards with different kinds of tactile feedback according to personal pressing habits. However, when the user is under different operation situations, such as typing, gaming, it is generally desirable to have different tactile feedbacks. Consequently, keyboards that provide merely a single type of tactile feedback cannot satisfy the user's needs, and the user has to purchase additional keyboards with different tactile feedbacks, resulting in extra cost and storage concerns for keyboards not in use.

SUMMARY OF THE INVENTION

It is an object of the invention to provide a keyswitch structure and a keyboard, which can provide multiple kinds of tactile feedback for users to choose, so as to satisfy users' needs.

It is another object of the invention to provide a keyswitch structure and a keyboard, which can move the holder with the entire tactile feedback member mounted thereon, to prevent deformation of the tactile feedback member during the process of adjusting the tactile feedback, further to ensure the consistency of tactile feedback for the adjustment at each time.

In an embodiment, the keyswitch structure includes a base, a cap disposed corresponding to the base, the cap having a first cam portion movable relative to the base, a restoring member disposed between the base and the cap and configured to provide a restoring force to enable the first cam portion to move away from the base, and a first tactile adjustment unit disposed corresponding to the first cam portion, the first tactile adjustment unit including a first holder and a first tactile feedback member mounted on the first holder, wherein the first holder is movable relative to the base to change a position of the first tactile feedback member relative to the first cam portion, so as to change a pressing force required for the first cam portion to move toward the base.

In an embodiment, the base has an accommodation space and a first opening communicating with the accommodation space. The restoring member is disposed in the accommodation space, and the first holder is disposed at one side of the base corresponding to the first opening, so that the first tactile feedback member faces the accommodation space.

In an embodiment, the base includes an inner wall, an outer wall, and a bottom connected to lower ends of the inner wall and the outer wall, so that a movement space is defined between the inner wall and the outer wall, and the accommodation space is at an inner side of the inner wall.

In an embodiment, the cap is a keycap movably combined with the base. The keycap includes a keytop and a keyskirt surrounding the keytop and extending toward the base. The first cam portion is disposed on a bottom of the keytop.

When the keycap moves relative to the base, the keyskirt moves in the movement space.

In an embodiment, the keycap includes a first guiding portion extending from the keytop toward the base, and the base includes a second guiding portion. When the keycap moves relative to the base, the first guiding portion and the second guiding portion moves relatively along each other.

In an embodiment, the keycap includes a first engaging portion extending from the keytop toward the base, and the base includes a second engaging portion. When the keycap is combined with the base, the first engaging portion movably engages with the second engaging portion.

In an embodiment, the cap includes a cap body and a plunger. The cap body is combined with the base and has a through hole. The plunger is movably inserted into the through hole, and the first cam portion is disposed on the plunger.

In an embodiment, the keyswitch structure further includes a second tactile adjustment unit. The cap further has a second cam portion. The second tactile adjustment unit is disposed corresponding to the second cam portion and includes a second holder and a second tactile feedback member mounted on the second holder. The second holder is movable relative to the base to change a position of the second tactile feedback member relative to the second cam portion, so as to change the pressing force required for the second cam portion to move toward the base.

In an embodiment, when the first tactile adjustment unit interferes with the first cam portion, the pressing force required for the first cam portion to move toward the base is a first pressing force. When the second tactile adjustment unit interferes with the second cam portion, the pressing force required for the first cam portion to move toward the base is a second pressing force different from the first pressing force.

In another embodiment, the invention provides a keyswitch structure including a cap, a base disposed below the cap, a support mechanism connected between the cap and the base to support the cap to move relative to the base, the support mechanism having a cam portion, a restoring member disposed between the base and the cap and configured to provide a restoring force to enable the cap to move away from the base, and a tactile adjustment unit disposed corresponding to the cam portion, the tactile adjustment unit including a holder and a tactile feedback member mounted on the holder, wherein the holder is movable relative to the base to change a position of the tactile feedback member relative to the cam portion, so as to change a pressing force required for the cam portion to move toward the base when the cam portion is driven by the cap.

In an embodiment, the base has an opening. The tactile adjustment unit further includes an adjustment plate disposed below the base. The holder is disposed on the adjustment plate and protrudes from the opening above the base.

In an embodiment, the tactile feedback member includes an elastic member having a positioning portion and a movable portion. The positioning portion is positioned on the holder, and the movable portion is bent from one end of the positioning portion toward the positioning portion to be movable relative to the positioning portion.

In an embodiment, the holder includes a positioning structure and a restricting portion. The positioning portion is positioned by the positioning structure, and the restricting portion is disposed corresponding to the movable portion to restrict movement of the elastic member.

In an embodiment, the tactile feedback member includes a torsion spring having a positioning portion and an extending arm extending corresponding to the cam portion. The holder is movable relative to the base to change the position of the tactile feedback member relative to the cam portion, so that the extending arm is located inside or outside a moving path of the cam portion.

In an embodiment, the holder includes a positioning structure and a restricting portion. The positioning portion is positioned by the positioning structure, and the restricting portion is disposed corresponding to the torsion spring to restrict movement of the torsion spring.

In an embodiment, the holder moves to drive the tactile feedback member inside or outside a moving path of the cam portion. When the tactile feedback member is located inside the moving path, and the cap moves toward the base, the cam portion interferes with the tactile feedback member. When the tactile feedback member is located outside the moving path, and the cap moves toward the base, the cam portion passes the tactile feedback member without interfering therewith.

In another embodiment, the invention provides a keyboard including a plurality of keyswitch structures, each of the keyswitch structures including a base, a cap disposed corresponding to the base, the cap having a first cam portion movable relative to the base, and a restoring member disposed between the base and the cap and configured to provide a restoring force to enable the first cam portion to move away from the base, a first tactile adjustment mechanism comprising a first adjustment frame and a plurality of first tactile feedback members disposed on the first adjustment frame corresponding to the plurality of keyswitch structures, respectively, wherein the first adjustment frame is movable relative to the plurality of keyswitch structures to change a position of the first tactile feedback member in each of the keyswitch structures relative to the first cam portion, so as to change tactile feedback of the plurality of keyswitch structures.

In an embodiment, the keyboard further includes a second tactile adjustment mechanism including a second adjustment frame and a plurality of second tactile feedback members disposed on the second adjustment frame corresponding to the plurality of keyswitch structures, respectively. The cap further has a second cam portion. The second adjustment frame is movable relative to the plurality of keyswitch structures to change a position of the second tactile feedback member in each of the keyswitch structures relative to the second cam portion, so as to change the tactile feedback of the plurality of keyswitch structures.

In an embodiment, the first adjustment frame and the second adjustment frame are independently moved with respect to each other, or the first adjustment frame and the second adjustment frame are integrated with each other to form a linking mechanism.

In yet another embodiment, the invention provides a keyboard including a plurality of keyswitch structures, each of the keyswitch structures includes a cap, a base disposed below the cap, a support mechanism connected between the cap and the base to support the cap to move relative to the base, the support mechanism having a cam portion, and a restoring member disposed between the base and the cap and configured to provide a restoring force to enable the cap to move away from the base, a tactile adjustment mechanism including an adjustment plate, a plurality of holders, and a plurality of tactile feedback members mounted on the plurality of holders, the plurality of holders disposed corresponding to the plurality of keyswitch structures, respectively, wherein the adjustment plate moves relative to the plurality of keyswitch structures to change a position of the tactile feedback member in each of the keyswitch structures relative to the cam portion, so as to change tactile feedback of the plurality of keyswitch structures.

In an embodiment, the base has an opening, and the adjustment plate is disposed below the plurality of keyswitch structures, so that the holder protrudes from the opening above the base.

Compared to the prior art, the keyswitch structure and the keyboard of the invention can change the tactile feedback by changing the position of the tactile adjustment unit. Moreover, the keyswitch structure and the keyboard of the invention arrange the tactile feedback member on the movable holder, so that the tactile feedback member will not deform during the adjusting process to ensure the consistency of tactile feedback for the adjustment at each time.

DETAILED DESCRIPTION OF THE PREFERRED EMBODIMENT

The invention provides a keyswitch structure, particularly a keyswitch structure with adjustable tactile feedback. The keyswitch structure can be applied to independent keyboards or integrated into electronic devices to provide multiple tactile feedbacks, such as different stiffnesses (i.e. different required pressing forces), dome-collapse-like tactile feedback, linear feedback, for the user to select based on his/her preference, but not limited thereto.

Figure 1A:
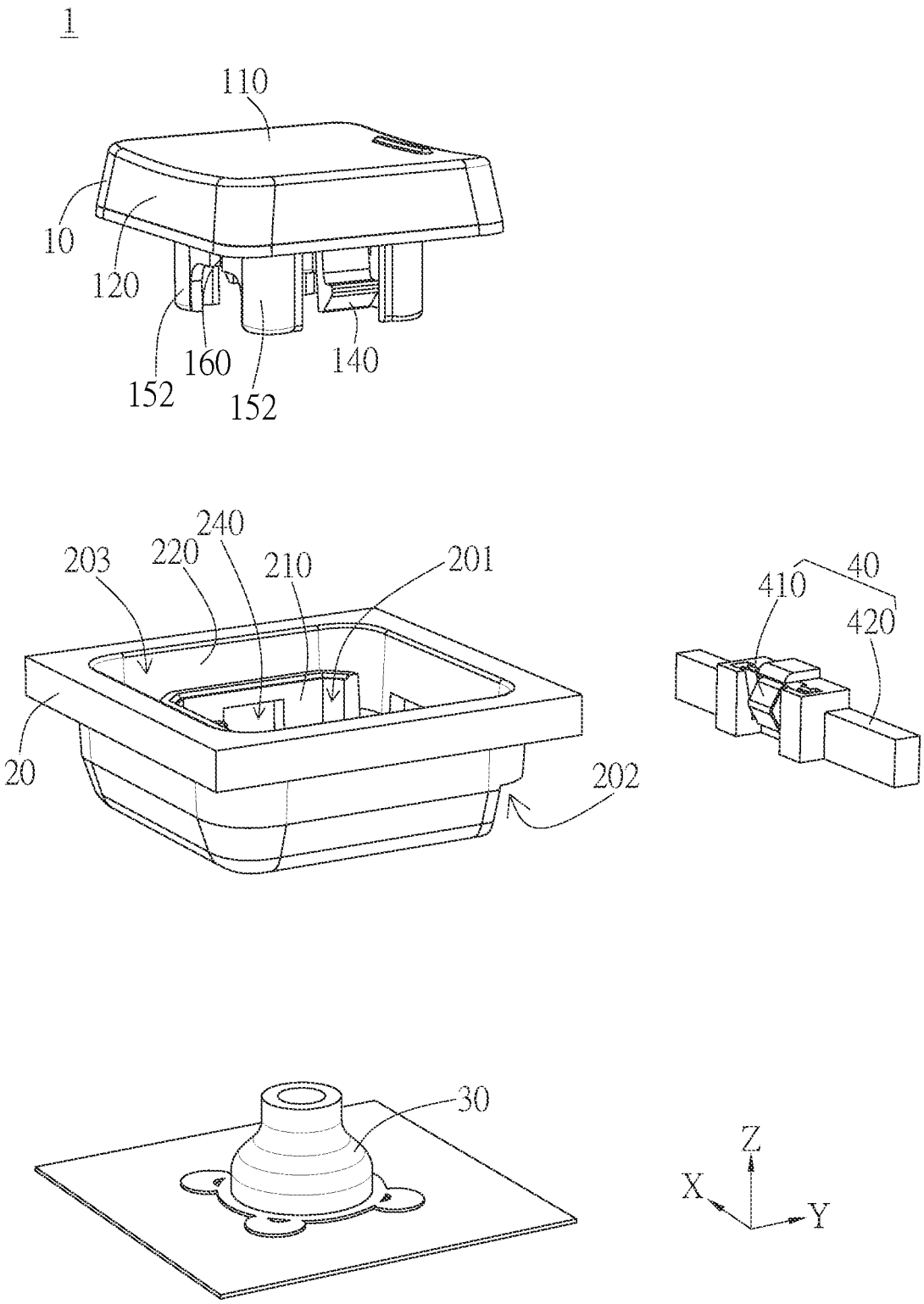
FIGS. 1A to 1C are respectively an exploded view, a perspective view, and a side view of a first embodiment of the keyswitch structure of the invention.
Figure 1B:
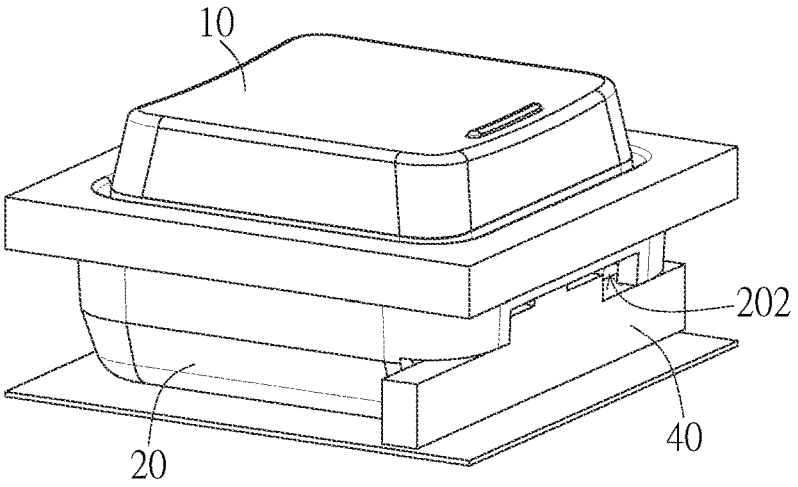
Figure 1C:
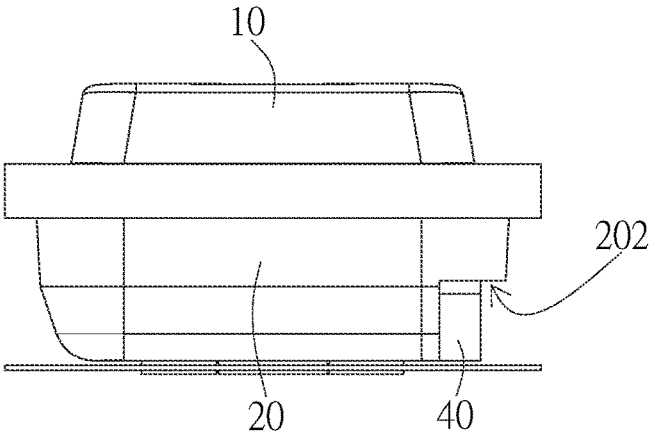
Figure 4A:
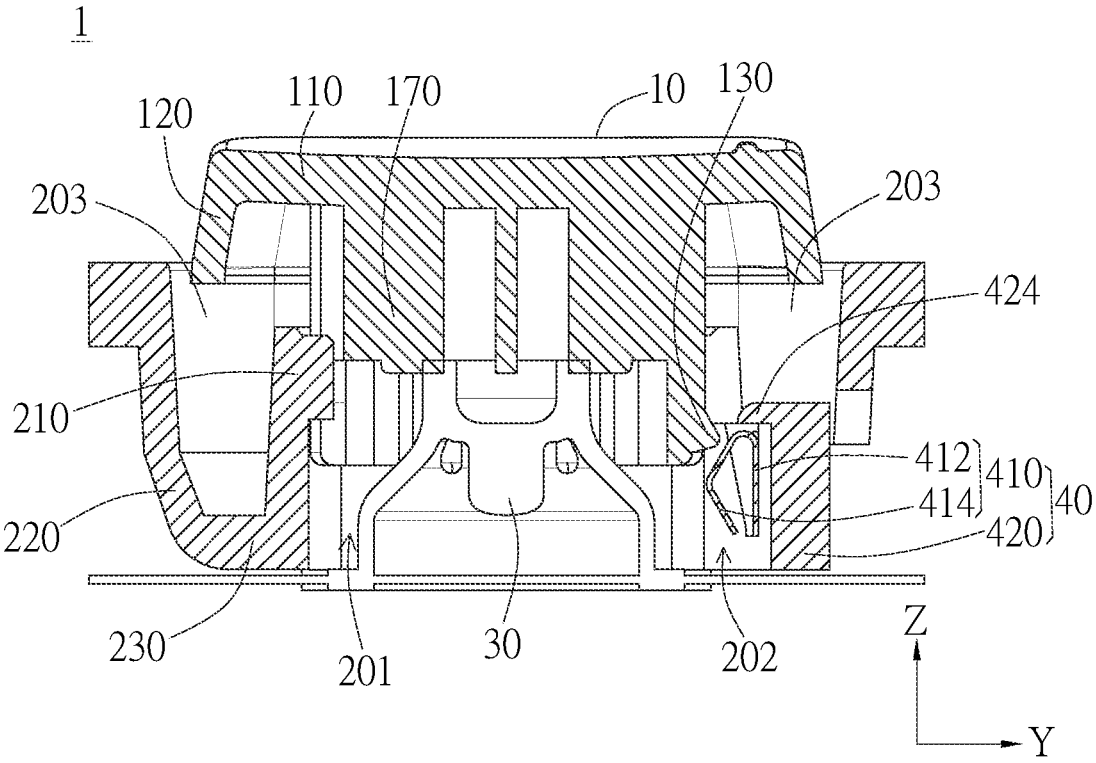
FIGS. 4A and 4B are schematic cross-sectional views of the keyswitch structure of FIG. 1A having the first tactile feedback at the non-pressed state and the pressed state, respectively.
Figure 6A:
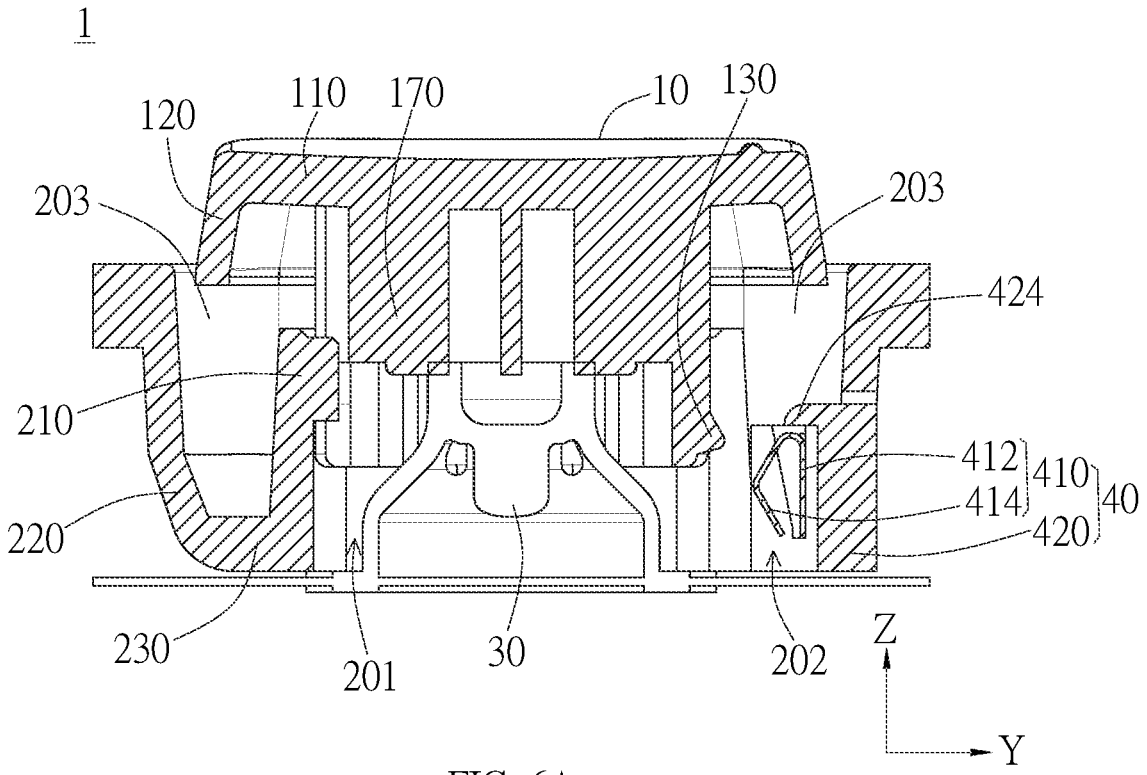
FIGS. 6A and 6B are schematic cross-sectional views of the keyswitch structure of FIG. 1A having the second tactile feedback at the non-pressed state and the pressed state, respectively.
Figure 6B:
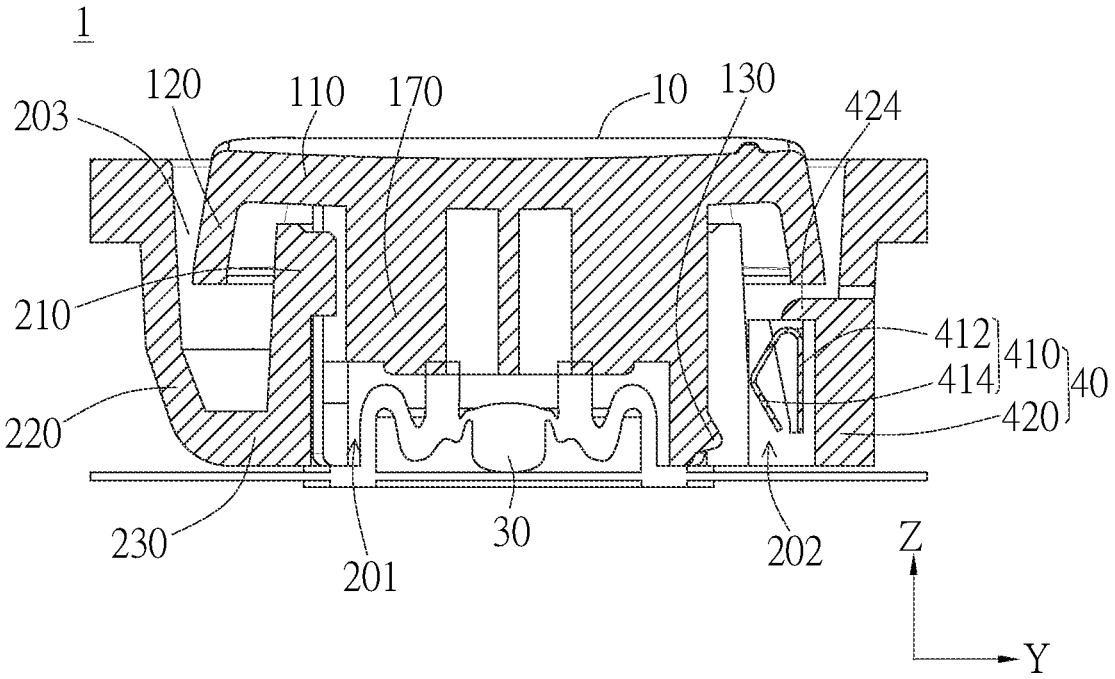

FIGS. 1A to 1C are respectively an exploded view, a perspective view, and a side view of a first embodiment of the keyswitch structure of the invention. As shown in FIGS. 1A to 1C, in an embodiment, a keyswitch structure 1 includes a cap 10, a base 20, a restoring member 30, and a first tactile adjustment unit 40. The cap 10 is disposed corresponding to the base 20, and the cap 10 has a first cam portion 130 (shown in FIG. 1D). The first cam portion 130 is movable relative to the base 20. The restoring member 30 is disposed between the cap 10 and the base 20 and configured to provide a restoring force to enable the first cam portion 130 to move away from the base 20. The first tactile adjustment unit 40 is disposed corresponding to the first cam portion 130. The first tactile adjustment unit 40 includes a first tactile feedback member 410 and a first holder 420, and the first tactile feedback member 410 is mounted on the first holder 420. The first holder 420 is movable relative to the base 20 to change a position of the first tactile feedback member 410 relative to the first cam portion 130 (as shown in FIG. 4A and FIG. 6A), so as to change a pressing force required for the first cam portion 130 to move toward the base 20.

Figure 1D:
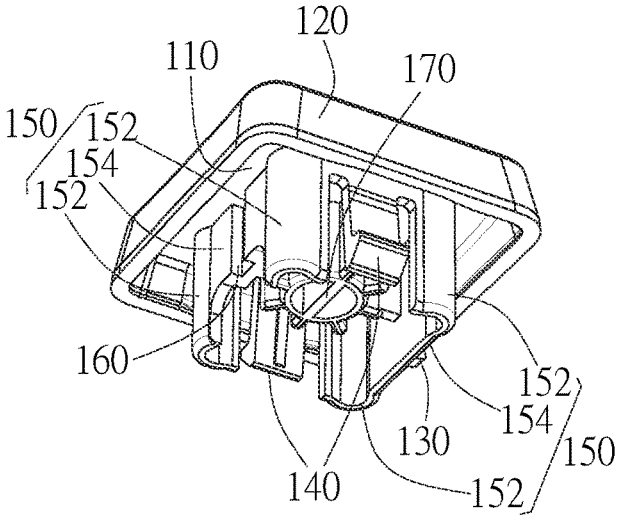
FIG. 1D is a schematic view of the cap of FIG. 1A from a different viewing angle.

Specifically, as shown in FIGS. 1A and 1D, the cap 10 can be embodied as a keycap, and the keycap is movably combined with the base 20. The keycap includes a keytop 110 and a keyskirt 120, and the keyskirt 120 surrounds the keytop 110 and extends toward the base 20. The first cam portion 130 is disposed on the bottom of the keytop 110. For example, the keytop 110 can be a rectangular body extending along the XY plane, and the keyskirt 120 extends downward from the periphery of the keytop 110 to form a rectangular keycap. The first cam portion 130 can include a bump disposed on the bottom of the keytop 110. For example, as shown in FIG. 4A, the first cam portion 130 can be an angular block having a lower surface and an upper surface inclined toward each other and connected at a protrudent point. The protrudent point protrudes outward (e.g. in the Y-axis direction) with respect to the upper surface and the lower surface. In this embodiment, the lower end of the first cam portion 130 preferably extends downward lower than the lower end of the keyskirt 120. In other words, the distance of the first cam portion 130 extending from the bottom of the keytop 110 is preferably larger than the distance of the keyskirt 120 extending from the bottom of the keytop 110. In this embodiment, the keycap further has a first engaging portion 140. The first engaging portion 140 extends from the bottom of the keytop 110 toward the base 20 and is configured to engage with the base 20, so as to limit the moving range of the keycap along the Z axis direction. The lower end of the first engaging portion 140 preferably extends downward lower than the lower end of the keyskirt 120, i.e., the distance of the first engaging portion 140 extending from the bottom of the keytop 110 is preferably larger than the distance of the keyskirt 120 extending from the bottom of the keytop 110. In this embodiment, it is preferable that two first engaging portions 140 extend downward from two opposite sides of the bottom of the keytop 110. For example, two first engaging portions 140 are disposed on the bottom of the keytop 110 at two opposite sides along the X axis direction, and each has a hook-like configuration.

Moreover, the keycap further includes a first guiding portion, which extends from the keytop 110 toward the base 20 and is configured to guide the movement of the keycap relative to the base 20, so as to increase the operation stability. In an embodiment, the first guiding portion can be embodied as a guiding wall 150. The guiding wall 150 is preferably a wall surface, which extends (e.g. downward) from the bottom of the keytop 110 toward the base 20 and is disposed around the periphery of the bottom of the keytop 110. The guiding wall 150 extends downward by a length beyond the lower end of the keyskirt 120. As shown in FIG. 1D, in an embodiment, the guiding wall 150 includes a columnar wall 152 and a coupling wall 154. One or more (e.g. four) columnar walls are disposed on the bottom of the keytop 110 near the corners, and the coupling wall 154 extends along the X axis direction to connect the columnar walls 152 at two sides. As such, two guiding walls 150 are oppositely disposed along the Y axis direction. In the Y axis direction, two first engaging portion 140 are located between opposite ends of the two guiding walls 150, and the first cam portion 130 can be disposed on a lower end of the coupling wall 154 of one of the guiding walls 150. In addition, corresponding to the guiding structure of the base 20, the first guiding portion of the keycap can be embodied as a concave/convex configuration. As shown in FIG. 1D, the keycap can have a guiding groove 160 as the first guiding portion, and the first cam portion 130 and the guiding groove 160 are preferably disposed at opposite sides of the bottom of the keytop 110. For example, the first cam portion 130 and the guiding groove 160 are respectively located on the coupling walls 154 of the two guiding walls 150 along the Y axis direction, but not limited thereto. In another embodiment, the guiding wall 150 can be embodied as four separate columnar walls 152 near the corners of the bottom of the keytop 110, i.e., the columnar walls 152 are not connected by the coupling walls 154. In such a configuration, the first cam portion 130, the guiding groove 160, and the two first engaging portions 140 can be independently disposed between adjacent two separate columnar walls 152 to be near the central position of the four sides. In this embodiment, the guiding wall 150 and the guiding groove 160 both can function as the first guiding portion, so as to guide the movement of the keycap relative to the base 20, but not limited thereto. In another embodiment, either the guiding wall 150 or the guiding groove 160 can function as the first guiding portion. The keycap can further include a positioning portion 170, which is configured to position the restoring member 30. For example, the positioning portion 170 is disposed at the center on the bottom of the keycap 110 and extends (e.g. downward) toward the base 20 to have a post configuration corresponding to the restoring member 30.

Figure 2A:
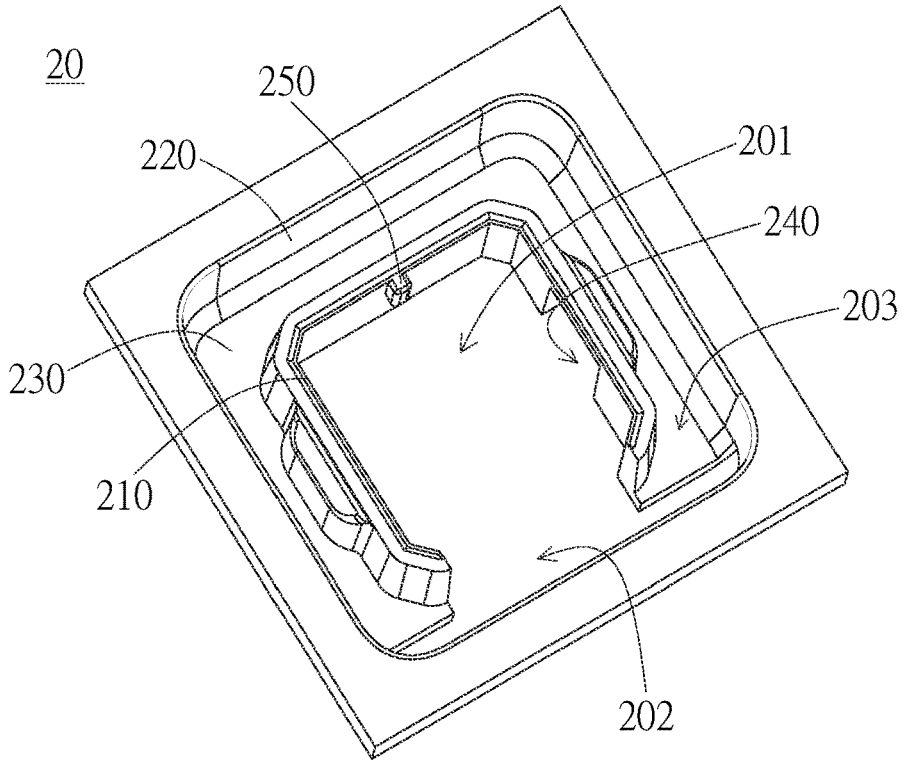
FIGS. 2A and 2B are schematic views of the base of FIG. 1A from different viewing angles.
Figure 2B:
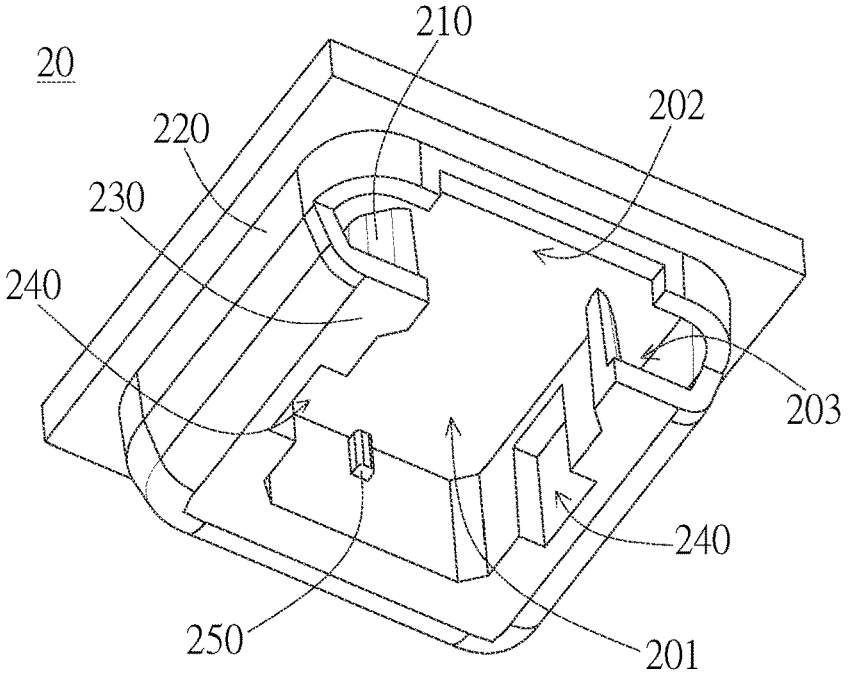

As shown in FIGS. 1A, 2A, and 2B, the base 20 has an accommodation space 201 and a first opening 202, which communicates with the accommodation space 201. Specifically, the base 20 includes an inner wall 210, an outer wall 220, and a bottom 230. The bottom 230 is connected to lower ends of the inner wall 210 and the outer wall 220, so that a movement space 203 is defined between the inner wall 210 and the outer wall 220, and the accommodation space 201 is at an inner side of the inner wall 210. In other words, the accommodation space 201 and the movement space 203 are at least partially separated by the inner wall 210. For example, corresponding to the shape of the keycap, the base 20 has a rectangular shape, and the base 20 has a through hole at the center functioning as the accommodation space 201. The inner wall 210 extends upward from the bottom 230 around the accommodation space 201 (or the through hole), and the outer wall 220 extends upward from the bottom 230 around the inner wall 210 with a distance apart from the inner wall 210, so that the outer wall 220, the inner wall 210, and the bottom 230 together enclose the movement space 203. The opening 202 can be formed at one side of the base 20, so that the bottom 230 and the outer wall 220 are partially opened. For example, the inner wall 210 can be a U-shaped wall, which partially surrounds the accommodation space 201 and extends upward from the bottom 230, and the outer wall 220 and the bottom 230 are partially opened (e.g. along the X axis direction), so that the first opening 202 is formed corresponding to the opening of the U-shaped wall. As such, the accommodation space 201 and the movement space 203 can communicate with each other through the first opening 202. The restoring member 30 is disposed in the accommodation space 201, and the first holder 420 is disposed at one side of the base 20 corresponding to the first opening 202, so that the first tactile feedback member 410 faces the accommodation space 201. In other words, when the keycap (i.e., the cap 10) is combined with the base 20, the first cam portion 130 preferably faces the first opening 202 of the base 20 to face the first tactile feedback member 410.

Corresponding to the first engaging portion 140 of the keycap, the base 20 has a second engaging portion 240. When the keycap (i.e., the cap 10) is combined with the base 20, the first engaging portion 140 movably engages with the second engaging portion 240. For example, the second engaging portion 240 can be one or more slots formed at two sides of the inner wall 210. When the keycap is combined with the base 20, the hook-like first engaging portion 140 engages with the slot-like second engaging portion 240, so as to define the highest position of the keycap (i.e. the cap 110) moving relative to the base 20 in the Z axis direction, and to prevent the detachment of the keycap from the base 20. Corresponding to the first guiding portion of the keycap (i.e., the cap 10), the base 20 has a second guiding portion. For example, the inner wall 210 of the base 20 can have a configuration corresponding to the guiding wall 150 of the keycap, i.e., the size, the shape of the accommodation space 201 substantially match the outer profile of the guiding wall 105. When the keycap moves relative to the base 20, with the fitness of the guiding wall 150 and the inner wall 210, the guiding wall 150 can move in the accommodation space 201 relative to the inner wall 210. In such a case, the inner wall 210 can function as the second guiding portion of the base 20. Moreover, corresponding to the guiding groove 160 of the keycap, the base 20 can have a guiding rail 250 as the second guiding portion, so that when the keycap moves relative to the base 20, the first guiding portion and the second guiding portion moves relatively along each other, i.e., the guiding rail 250 moves relatively in the guiding groove 160. In this embodiment, the guiding rail 250 is preferably disposed at a side opposite to the first opening 202 and protrudes from the inner wall 210 toward the accommodation space 201, so that when the keycap is combined with the base 20, the guiding rail 250 is received in the guiding groove 160, but not limited thereto. In another embodiment, the positions of the guiding groove 160 and the guiding rail 250 can be exchanged. In other words, the keycap (i.e., the cap 10) can have a guiding rail protruding outward (e.g., toward the outer side of the keytop 110), and the base 20 has a groove formed by recessing or opening the inner wall 210.

Figure 3A:
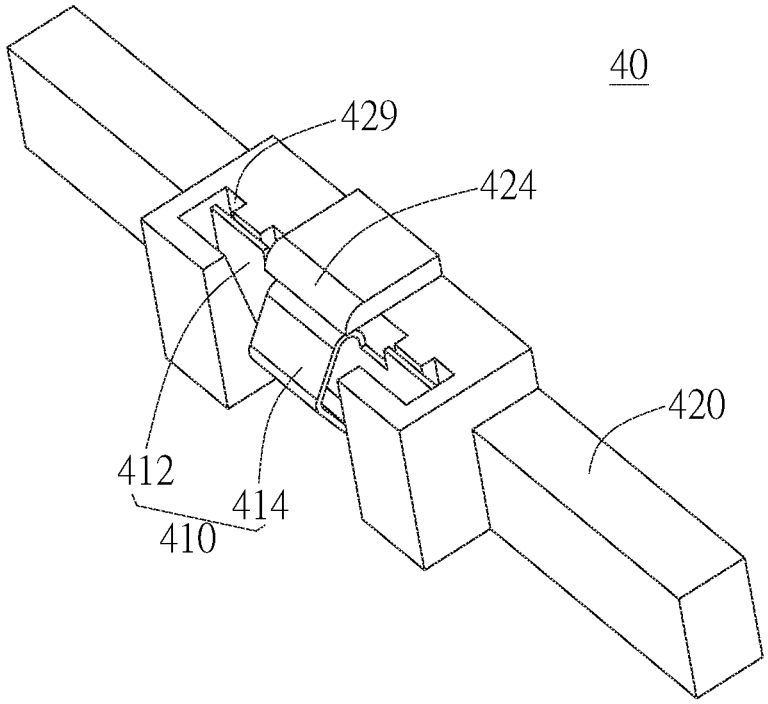
FIGS. 3A and 3B are an assembled view and an exploded view of the tactile adjustment unit of FIG. 1A.
Figure 3B:
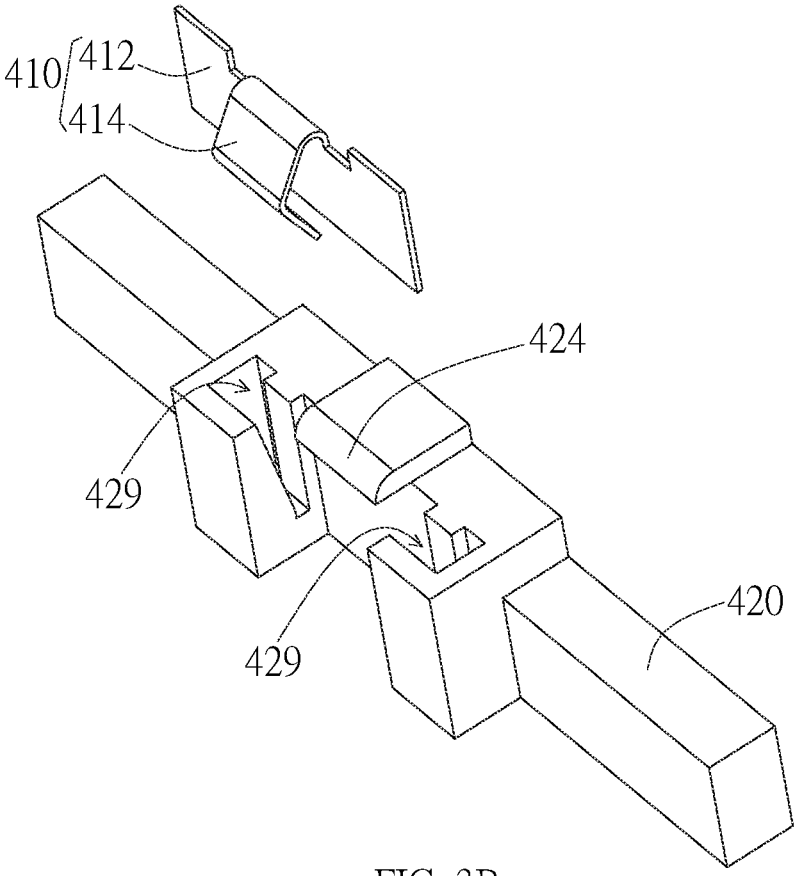
Figure 14A:
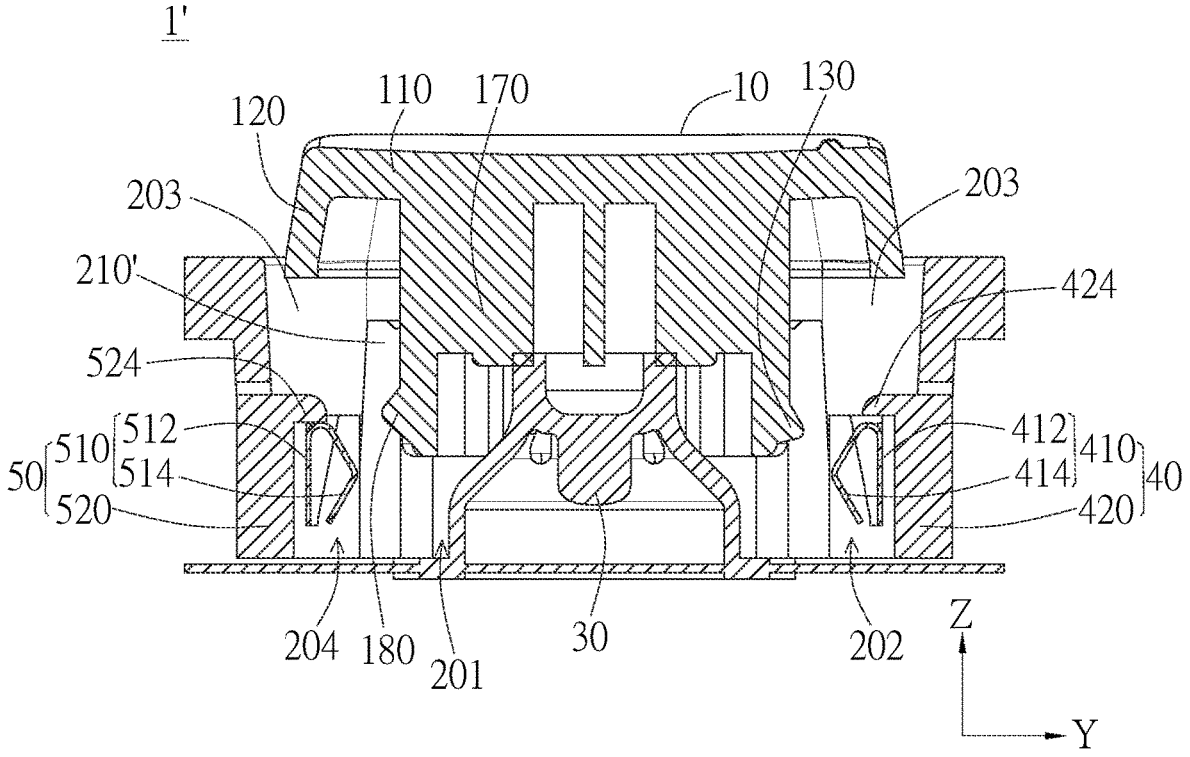
FIGS. 14A and 14B are schematic cross-sectional views of the keyswitch structure of FIG. 11A having the first tactile feedback at the non-pressed state and the pressed state, respectively.
Figure 14B:
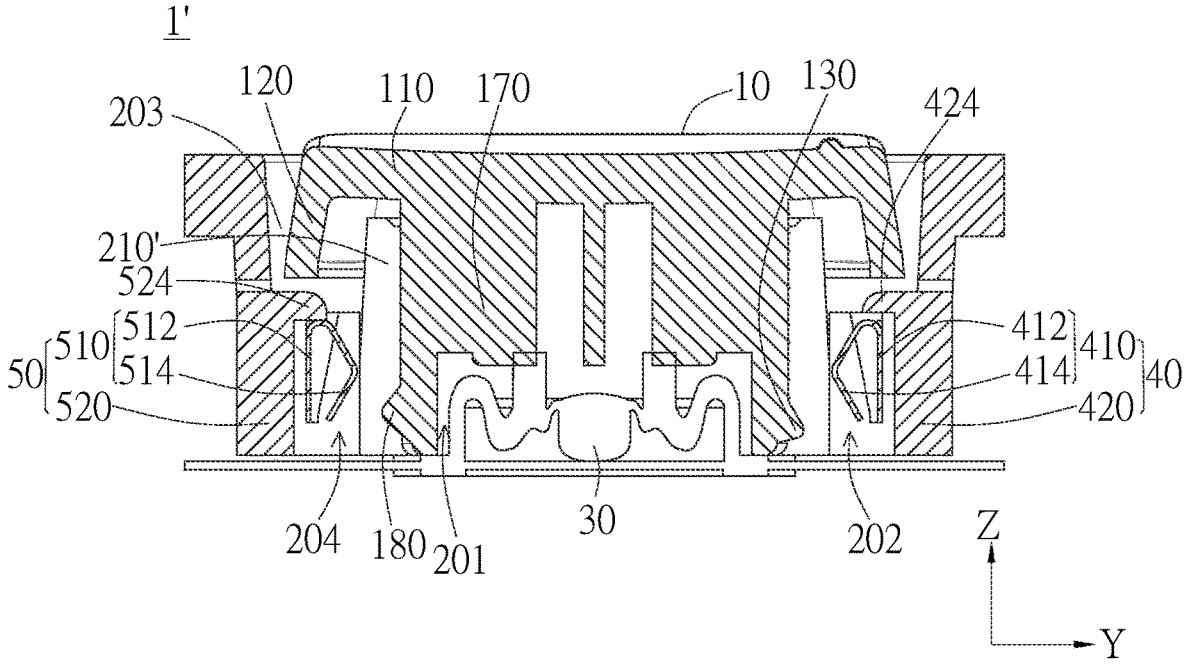

As shown in FIGS. 3A and 3B, in an embodiment, the first tactile feedback member 410 includes an elastic member having a positioning portion 412 and a movable portion 414. The positioning portion 412 is positioned on the first holder 420. The movable portion 414 is bent from one end of the positioning portion 412 toward the positioning portion 412, so that the movable portion 414 is movable relative to the positioning portion 412. For example, the positioning portion 412 of the elastic member can be a positioning plate, and the movable portion 414 can be an arched (or curved) portion, which is bent from one end of the positioning plate to face the positioning plate, so that when the movable portion 414 is pressed, the movable portion 414 can move toward the positioning plate (i.e., the positioning portion 412). The first holder 420 has a positioning structure (e.g. positioning slot 429) and a restricting portion 424. The positioning portion 412 of the elastic member is positioned by the positioning structure, and the restricting portion 424 is disposed corresponding to the movable portion 414 to restrict movement of the elastic member. For example, the positioning structure can be embodied as a positioning slot 429, and the restricting portion 424 can be embodied as a baffle. When the elastic member is mounted on the first holder 420, the positioning portion 412 is inserted into the positioning slot 429, and the restricting portion 424 corresponds to the movable portion 414. In this embodiment, when the elastic member is mounted on the first holder 420, the positioning portion 412 is inserted into the positioning slot 429, and the movable portion 414 is connected to the upper end of the positioning portion 412, so that the restricting portion 424 protrudes from the upper end of the first holder 420 to extend corresponding to the movable portion 414. As such, the restricting portion 424 can define the moving range of the movable portion 414 in the Z axis direction. In an embodiment, when the elastic member is mounted on the first holder 420, a predetermined gap preferably exists between the movable portion 414 and the restricting portion 424 in the Z axis direction, to allow limited movement of the movable portion 414 in the Z axis direction when the movable portion 414 moves relative to the positioning portion 412, but not limited thereto. In another embodiment, when the elastic member is mounted on the first holder 420, the upper end of the movable portion 414 can abut against the restricting portion 424, i.e., there is substantially no gap between the movable portion 414 and the restricting portion 424 in the Z axis direction, to prevent movement of the movable portion 414 in the Z axis direction when the movable portion 414 moves relative to the positioning portion 412 (as the tactile feedback member 50 shown in FIG. 14A).

In an embodiment, the restoring member 30 can be embodied as a rubber dome, which is preferably disposed in the accommodation space 201 of the base 20 and positioned by abutting the positioning portion 170 of the keycap, but not limited thereto. In an embodiment, the restoring member 30 can be embodied as a coil spring, and the coil spring is positioned by inserting the positioning portion 170 of the keycap into one end of the coil spring. According to practical applications, the keyswitch structure 1 can include a switch unit (not shown) or a baseplate. For example, the switch unit can be a membrane switch, which is disposed under the rubber dome, but not limited thereto. In another embodiment, according to practical applications, the switch unit can be an optical switch or a mechanical switch, which is triggered to generate a triggering signal when the cap 10 moves relative to the base 20.

Figure 4B:
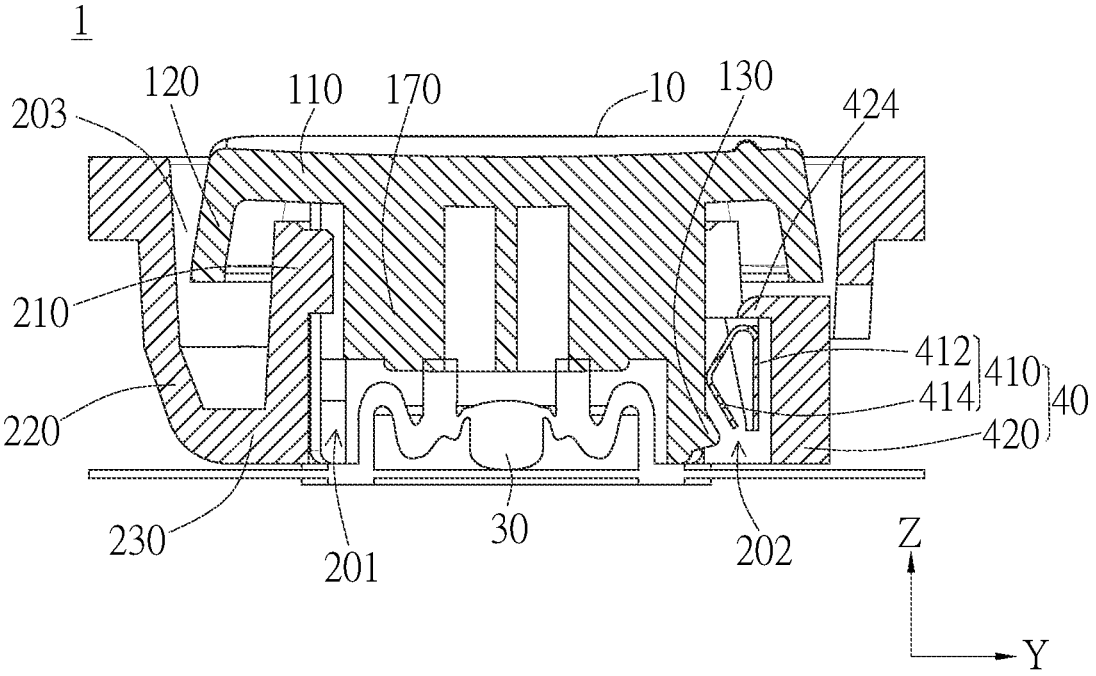
Figure 5A:
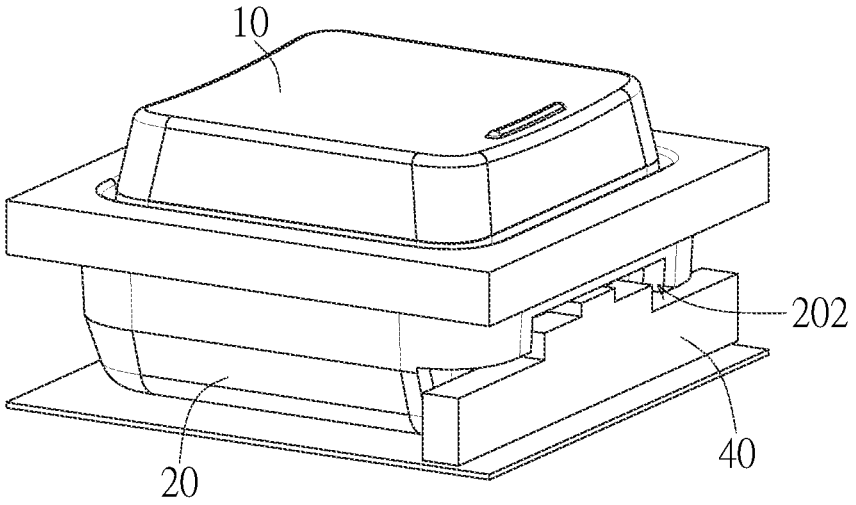
FIGS. 5A and 5B are respectively a perspective view and a side view of the keyswitch structure of FIG. 1A having the second tactile feedback.
Figure 5B:
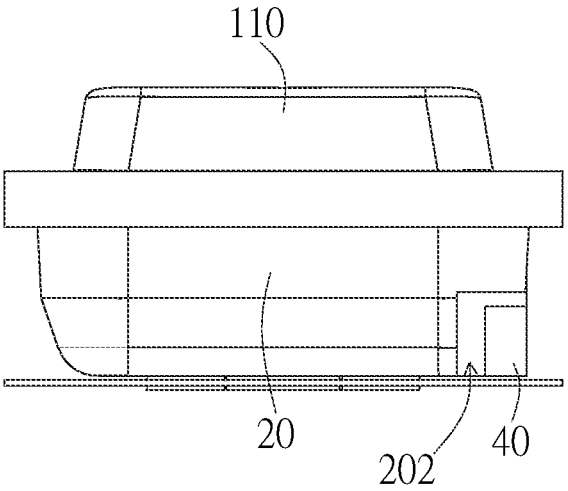

Referring to FIGS. 1B and 1C and FIGS. 4A and 4B, an embodiment of the keyswitch structure 1 having the first tactile feedback is illustrated. As shown in the figures, the first tactile adjustment unit 40 can move relative to the base 20 (i.e., the first holder 420 moves relative to the base 20), so that the position of the first tactile feedback member 410 mounted on the first holder 420 relative to the moving path of the first cam portion 130 can be changed. In this embodiment, when the first holder 420 moves relative to the base 20 toward the first opening 202, the first tactile feedback member 410 moves along with the first holder 420 to be located inside the moving path of the first cam portion 130, i.e., the movable portion 414 at least partially overlaps the first cam portion 130 in the Z axis direction. With such a configuration, when the keycap (i.e., cap 10) is pressed, the keycap along with the first cam portion 130 moves downward and compresses the rubber dome (i.e., the restoring member 30), and during the downward movement of the first cam portion 130, the first cam portion 130 interferes with the movable portion 414 of the first tactile feedback member 410, such as the first cam portion 130 pressing the movable portion 414 toward the positioning portion 412. As shown in FIG. 4B, when the keycap keeps moving downward to trigger the switch unit, and the first cam portion 130 passes the movable portion 414 (i.e., the movable portion 414 moves across the protrudent point of the first cam portion 130), the movable portion 414 is released to rebound away from the positioning portion 412 and bounce upward (because of the design of gap between the movable portion 414 and the restricting portion 424), so that the first tactile feedback member 410 hits the restricting portion 424 to generate a sound, and the keyswitch structure 1 provides the first tactile feedback. When the keyswitch structure 1 is in such a status, the pressing force required for the first cam portion 130 to move across the first tactile feedback member 410 is relatively larger, and the sound can be generated. In addition, according to practical applications, when the movable portion 414 is released to rebound away from the positioning portion 412, the movable portion 414 can hit other portion above the first cam portion 130, such as the coupling wall 154, to enhance the sound effect. Alternatively, when the movable portion 414 is released to rebound away from the positioning portion 412, the movable portion 414 can be designed not to hit any portion, so that no sound is generated. When the keycap is released, i.e., the cap 10 is not pressed anymore, by means of the restoring force provided by the restoring member 30, the keycap can move upward relative to the base 20 and return to the non-pressed position, as shown in FIG. 4A.

Referring to FIGS. 5A and 5B and FIGS. 6A and 6B, an embodiment of the keyswitch structure 1 having the second tactile feedback is illustrated. As shown in the figures, when the first holder 420 moves relative to the base 20 away from the first opening 202, the first tactile feedback member 410 moves along with the first holder 420 to be located outside the moving path of the first cam portion 130, i.e., the movable portion 414 does not overlap the first cam portion 130 in the Z axis direction. With such a configuration, when the keycap (i.e., cap 10) is pressed, the keycap along with the first cam portion 130 moves downward and compresses the rubber dome (i.e., the restoring member 30) to trigger the switch unit, and during the downward movement of the first cam portion 130, the first cam portion 130 does not interfere with the movable portion 414 of the first tactile feedback member 410 since the movable portion 414 is located outside the moving path of the first cam portion 130, so that the keyswitch structure 1 provides the second tactile feedback, i.e., soundless linear tactile feedback. When the keyswitch structure 1 is in such a status, the pressing force required for the first cam portion 130 to move across the first tactile feedback member 410 is relatively smaller, and no sound will be generated.

Figure 7:
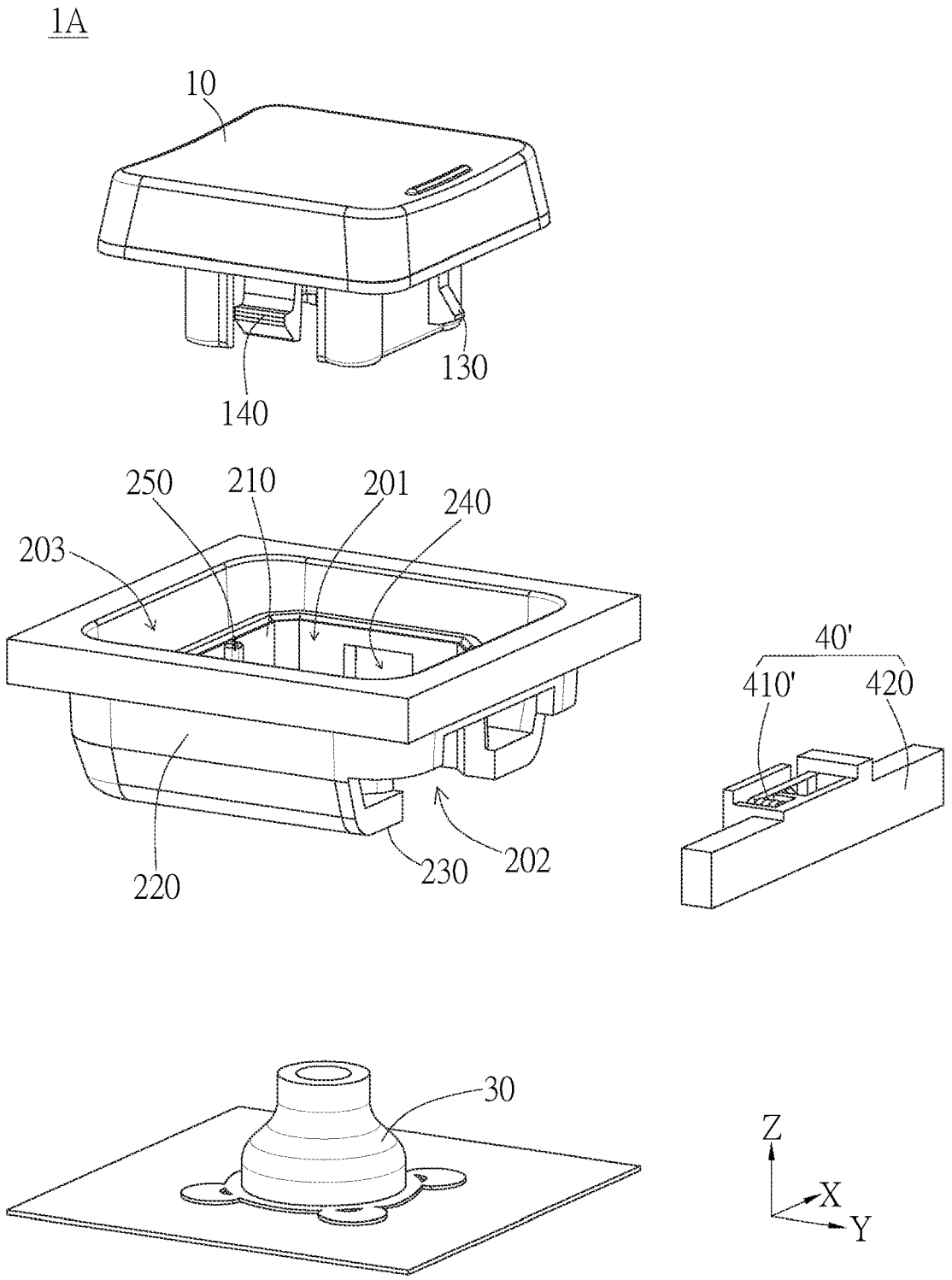
FIG. 7 is an exploded view of a second embodiment of the keyswitch structure of the invention.
Figure 8A:
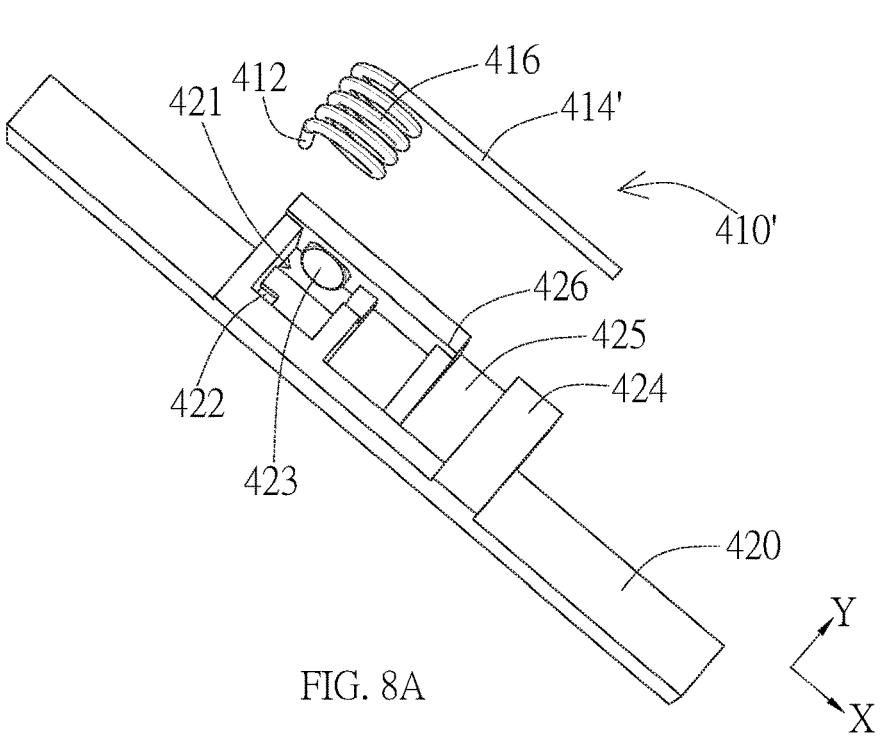
FIGS. 8A to 8C are respectively an exploded view, an assembled view, and a bottom view of the tactile adjustment unit of FIG. 7.
Figure 8B:
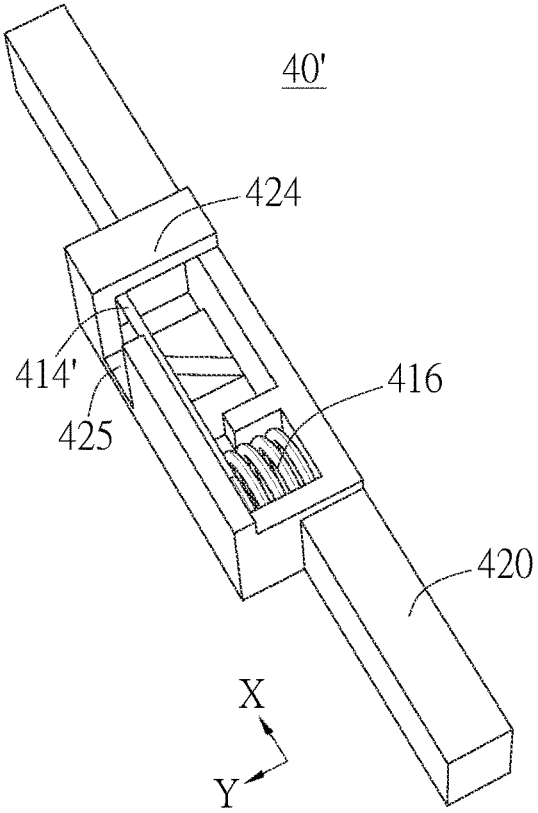
Figure 8C:
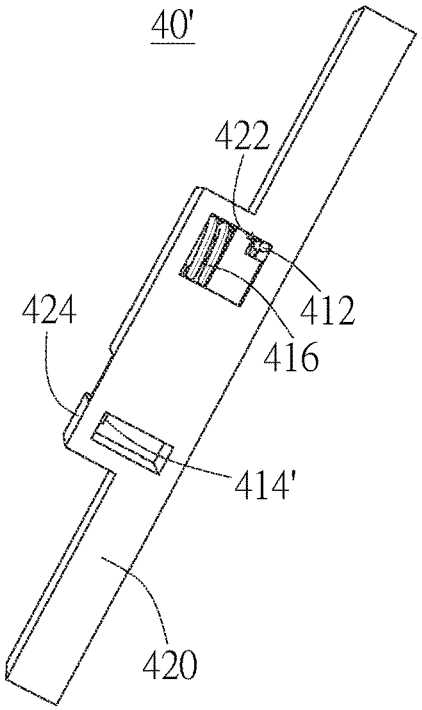

FIG. 7 is an exploded view of a second embodiment of the keyswitch structure 1A of the invention. The keyswitch structure 1A of FIG. 7 has a structure similar to that of the keyswitch structure 1 of FIG. 1A. For example, the details of the keycap (i.e., the cap 10), the base 20, and the restoring member 30 can be referred to the related descriptions of the previous embodiment, and the differences between the keyswitch structure 1A of FIG. 7 and the keyswitch structure 1 of FIG. 1A will be illustrated hereinafter.

In this embodiment, the tactile feedback member 410' of the tactile adjustment unit 40' can have a different configuration. For example, the tactile feedback member 410' can be embodied as a torsion spring. The torsion spring includes a positioning portion 412 and an extending arm 414', which extend from two opposite ends of the torsion spring. An angle between an extending direction of the positioning portion 412 and an extending direction of the extending arm 414' is preferably equal to or smaller than 120 degrees. For example, the positioning portion 412 and the extending arm 414' are two rods extending from two opposite ends of the spring body 416, and the angle between the extending directions of the two rods is preferably not more than 120 degrees. In other words, the extending arm 414' functions as the movable portion of the tactile feedback member 410'. In this embodiment, the holder 420 has a positioning mechanism, which is configured to position the positioning portion 412. For example, the positioning mechanism can include a hole 422, a block 423, and a groove 426, which are configured to position the positioning portion 412, the spring body 416, and the extending arm 414', respectively. Specifically, the holder 420 can be a rectangular base, which has a receiving space 421 and extends along such as the X axis direction. The hole 422 is a through hole, which is formed in the bottom of the holder 420 and communicates with the receiving space 421. The block 423 is disposed on the wall, which defines the receiving space 421, and protrude toward the receiving space 421. In an embodiment, the block 423 and the hole 422 are preferably located in the receiving space 421 at two opposite sides along the Y axis direction. The groove 426 is disposed on the extending direction of the extending arm 414', so as to limit the lateral movement of the extending arm 414'. When the tactile feedback member 410' is disposed in the receiving space 421 of the holder 420, the positioning portion 412 of the tactile feedback member 410' is inserted into the hole 422, the spring body 416 is arranged on the block 423, and the extending arm 414' extends along the X axis direction and is partially confined in the groove 426. The holder 420 has a restricting portion 424, which is disposed corresponding to the torsion spring to limit the movement of the torsion spring. For example, the restricting portion 424 is disposed at the other side of the receiving space 421 opposite to the hole 422 or the block 423, so that the restricting portion 424 is located above the extending arm 414' and overlaps the distal end (or free end) of the extending arm 414' in the Z axis direction, so as to limit the moving range of the extending arm 414' in the Z axis direction. The holder 420 can further include a channel 425 to allow the first cam portion 130 of the keycap (i.e., the cap 10) to move in the channel 425 corresponding to the extending arm 414'. The channel 425 is preferably formed corresponding to the extending arm 414' on the sidewall of the holder 420, which faces the first opening 202 of the base 20, so that at least a portion of the extending arm 414' is exposed from the channel 425 and faces the accommodation space 201.

Figure 9A:
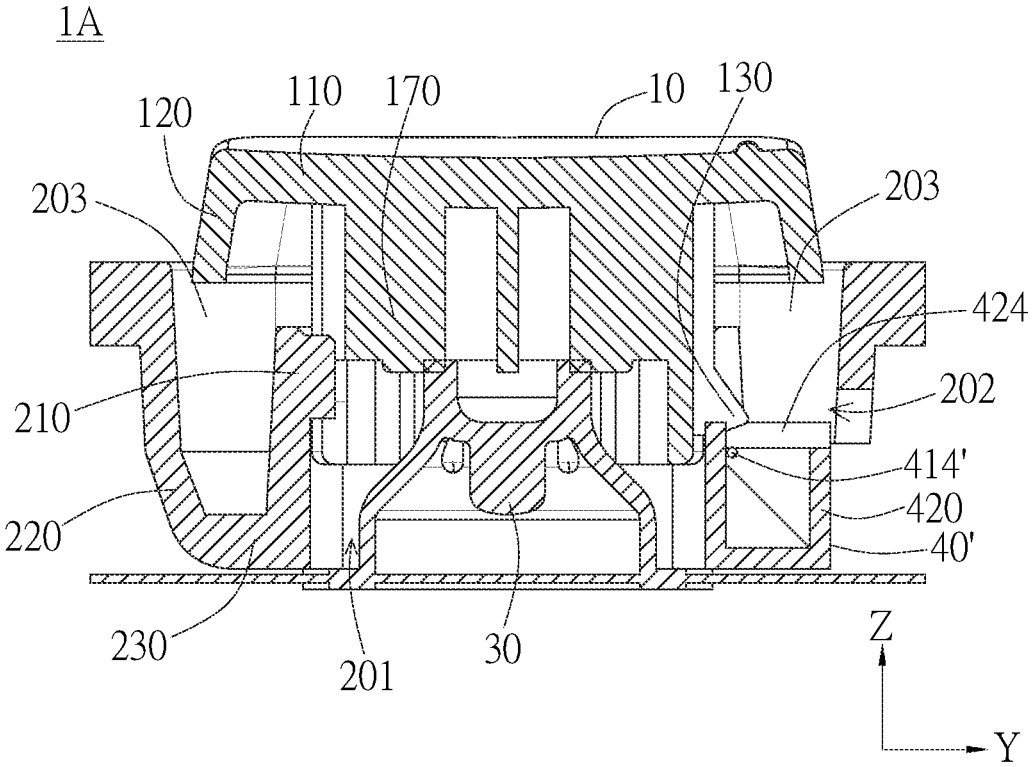
FIGS. 9A and 9B are schematic cross-sectional views of the keyswitch structure of FIG. 7 having the first tactile feedback at the non-pressed state and the pressed state, respectively.
Figure 9B:
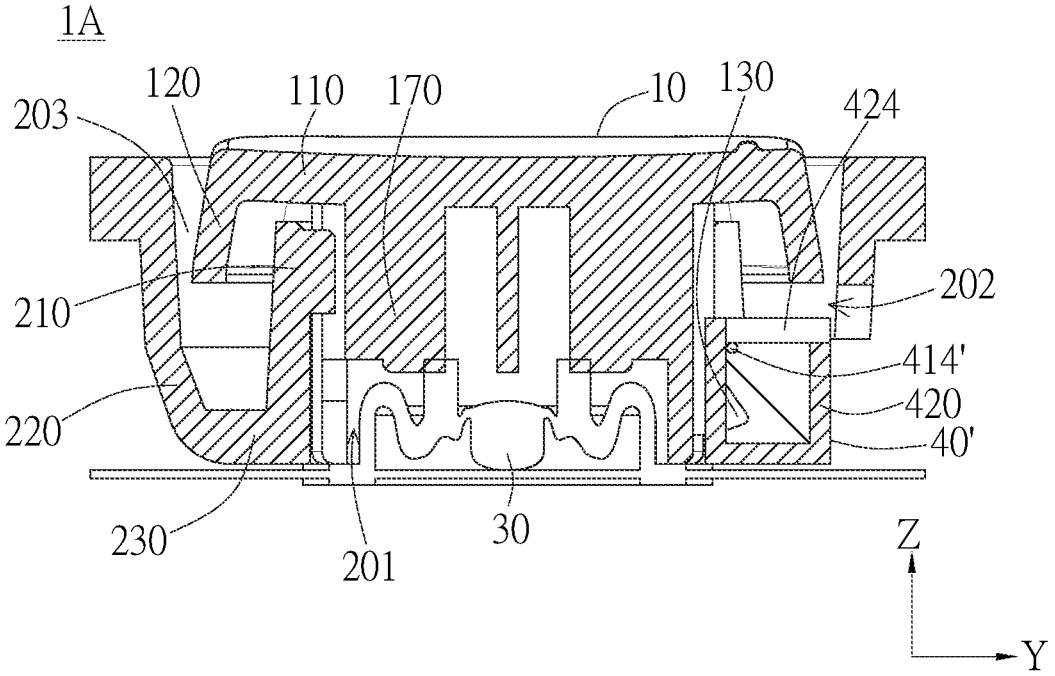

The holder 420 is movable relative to the base 20 to change the position of the tactile feedback member 410' with respect to the first cam portion 130, so that the extending arm 414' can be located inside or outside the moving path of the first cam portion 130, and the tactile feedback of the keyswitch structure 1A is accordingly changed. Referring to FIGS. 9A and 9B, an embodiment of the keyswitch structure 1A having the first tactile feedback is illustrated. As shown in the figures, the tactile adjustment unit 40' can move relative to the base 20 (i.e., the holder 420 moves relative to the base 20), so that the position of the tactile feedback member 410' mounted on the holder 420 relative to the moving path of the first cam portion 130 can be changed. In this embodiment, when the holder 420 moves relative to the base 20 toward the first opening 202, the tactile feedback member 410' moves along with the holder 420 to be located inside the moving path of the first cam portion 130, i.e., the extending arm 414' at least partially overlaps the first cam portion 130 in the Z axis direction. With such a configuration, when the keycap (i.e., cap 10) is pressed, the keycap along with the first cam portion 130 moves downward and compresses the rubber dome (i.e., the restoring member 30), and during the downward movement of the first cam portion 130, the first cam portion 130 interferes with the extending arm 414' of the tactile feedback member 410'. Specifically, the first cam portion 130 moves downward in the channel 425 and presses the extending arm 414', so that the extending arm 414' moves relatively along the lower surface of the first cam portion 130 toward the protrudent point. As shown in FIG. 9B, when the keycap keeps moving downward to trigger the switch unit, the extending arm 414' moves relatively across the protrudent point and then along the upper surface of the first cam portion 130, so that the extending arm 414' is released to bounce (e.g. upward) toward the restricting portion 424 of the holder 420 and hit the restricting portion 424 to generate a sound, and the keyswitch structure 1A provides the first tactile feedback. When the keyswitch structure 1A is in such a status, the pressing force required for the first cam portion 130 to move across the tactile feedback member 410' is relatively larger, and the sound can be generated. When the keycap is released, i.e., the cap 10 is not pressed anymore, by means of the restoring force provided by the restoring member 30, the keycap can move upward relative to the base 20 and return to the non-pressed position, as shown in FIG. 9A.

Figure 10A:
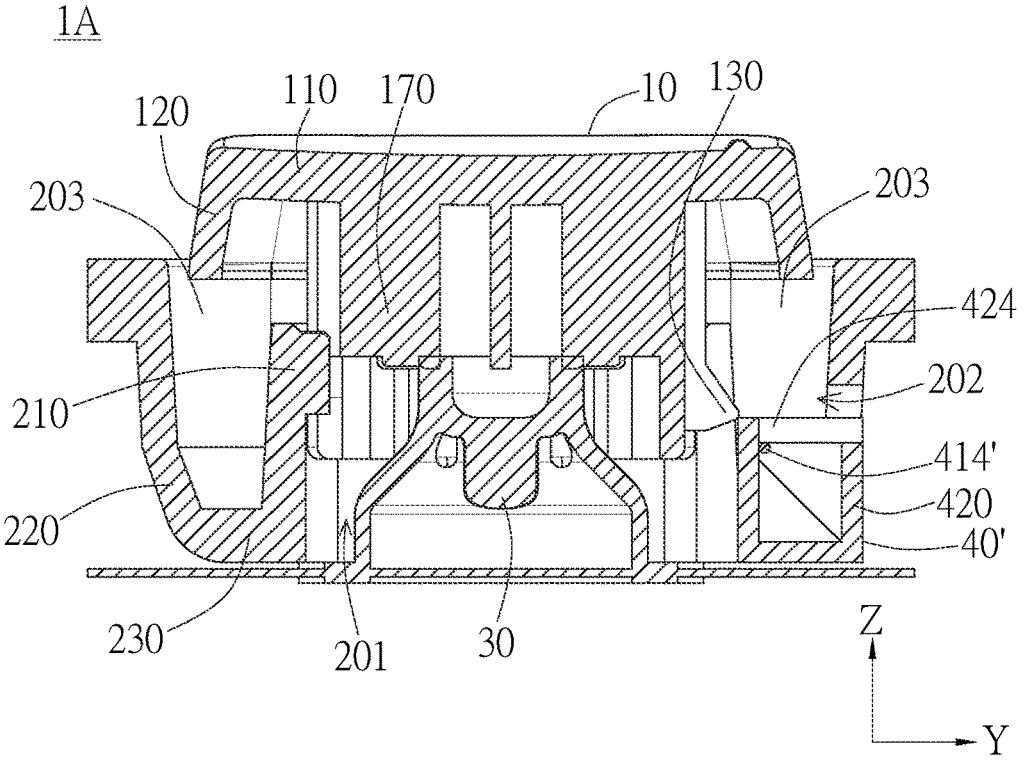
FIGS. 10A and 10B are schematic cross-sectional views of the keyswitch structure of FIG. 7 having the second tactile feedback at the non-pressed state and the pressed state, respectively.
Figure 10B:
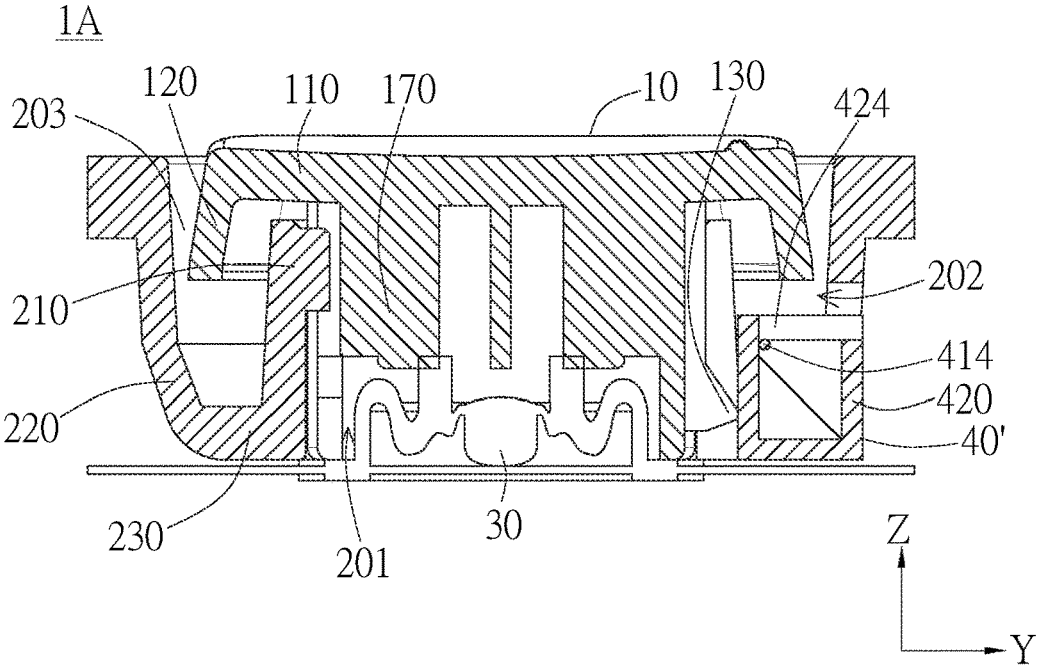

Referring to FIGS. 10A and 10B, an embodiment of the keyswitch structure 1A having the second tactile feedback is illustrated. As shown in the figures, when the holder 420 moves relative to the base 20 away from the first opening 202, the tactile feedback member 410' moves along with the holder 420 to be located outside the moving path of the first cam portion 130, i.e., the extending arm 414' moves away from the moving path of the first cam portion 130 or does not overlap the first cam portion 130 in the Z axis direction. With such a configuration, when the keycap (i.e., cap 10) is pressed, the keycap along with the first cam portion 130 moves downward and compresses the rubber dome (i.e., the restoring member 30) to trigger the switch unit, and during the downward movement of the first cam portion 130, the first cam portion 130 does not interfere with the extending arm 414' of the tactile feedback member 410' since the extending arm 414' is located outside the moving path of the first cam portion 130, so that the keyswitch structure 1A provides the second tactile feedback, i.e., soundless linear tactile feedback. When the keyswitch structure 1A is in such a status, the pressing force required for the first cam portion 130 to move across the tactile feedback member 410' is relatively smaller, and no sound will be generated.

Moreover, in the embodiments of FIGS. 1A and 7, two different kinds of tactile feedback provided by the keyswitch structure 1 (or 1A) are illustrated based on whether the first cam portion 130 interferes with the tactile feedback member 410 (or 410') or not, but not limited thereto. In another embodiment, by adjusting the position of the holder 420 relative to the base 20, the movable portion 414 (or the extending arm 414') of the tactile feedback member 410 (or 410') can be located at two or more different positions with respect to the moving path of the first cam portion 130, so that the keyswitch structure 1 (or 1A) can provide two or more kinds of tactile feedback. Specifically, by adjusting the position of the holder 420 relative to the base 20, the movable portion 414 (or the extending arm 414') can not only be located inside the moving path of the first cam portion 130, but also have different horizontal distances with respect to the protrudent point of the first cam portion 130, so that the pressing force required for actuating the keyswitch structure 1 (or 1A) can be different, and the volume of the generated sound effect will also be different. For example, when the holder 420 moves relative to the base 20 toward the first opening 202 to get closer to the center of the accommodation space 201, the distance between the movable portion 414 (or the extending arm 414') and the protrudent point of the first cam portion 130 in the Y direction becomes larger (i.e., the movable portion 414 (or the extending arm 414') gets deeper into the inner side of the keycap), so that the pressing force required for actuating the keyswitch structure 1 (or 1A) becomes larger, and the sound generated also becomes louder since the distance for the movable portion 414 (or the extending arm 414') moving relative along the lower surface of the first cam portion 130 is larger (i.e., the bouncing force is larger). As such, in the case that the first cam portion 130 interferes with the tactile feedback member 410 (or 410'), tactile feedback of different pressing forces (or different volumes of sound) can be provided. In addition, by adjusting the position of the holder 420 relative to the base 20, the movable portion 414 (or the extending arm 414') can be located corresponding to the protrudent point of the first cam portion 130, so that the keyswitch structure 1 (or 1A) can provide a dome-collapse-like tactile feedback. For example, when the extending arm 414' is substantially located corresponding to the protrudent point of the first cam portion 130, the first cam portion 130 pushes the extending arm 414' laterally outward to generate the dome-collapse-like tactile feedback during the downward movement of the first cam portion 130.

Figure 11A:
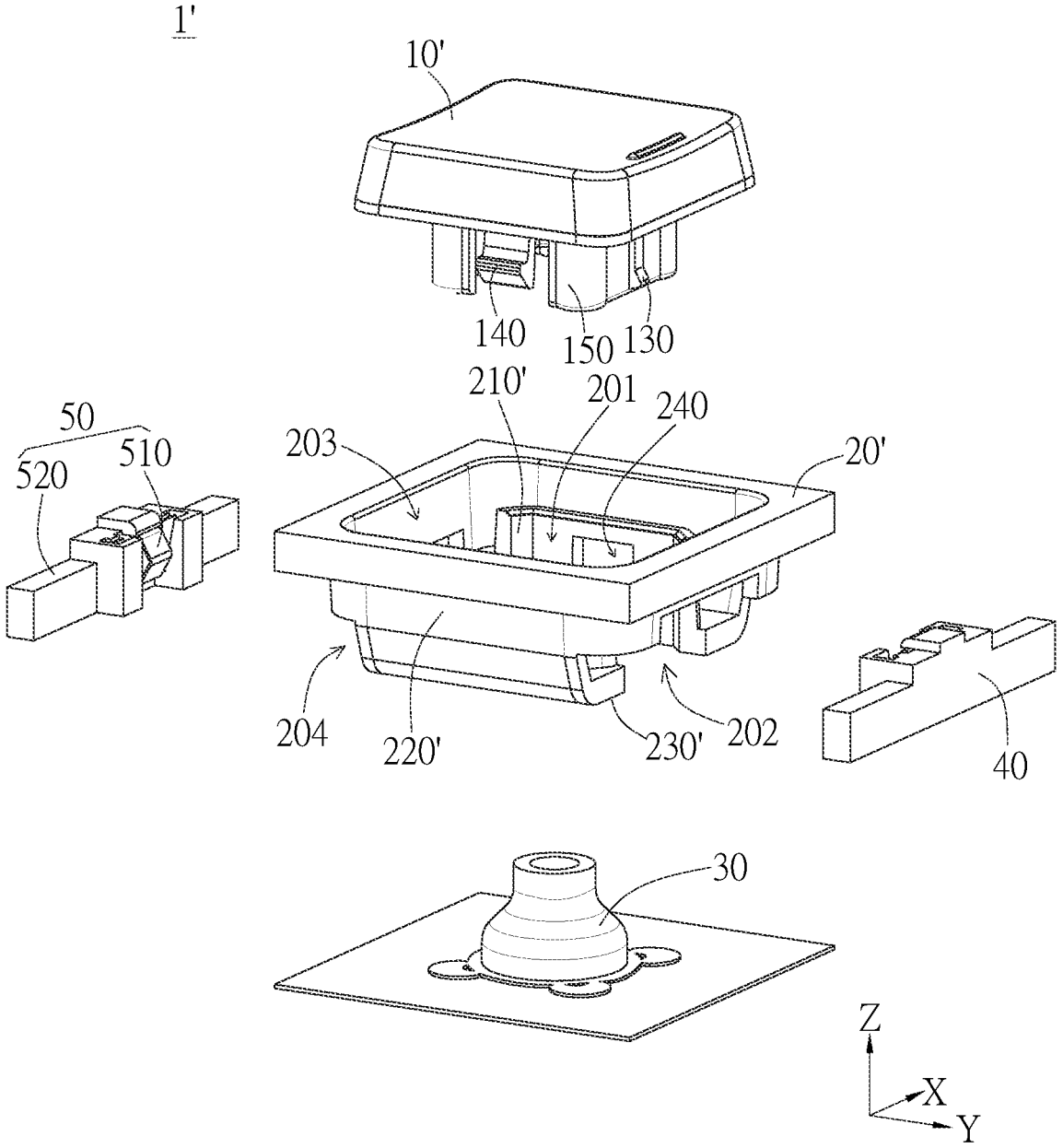
FIGS. 11A to 11C are exploded views of a third embodiment of the keyswitch structure of the invention from different viewing angles.
Figure 11B:
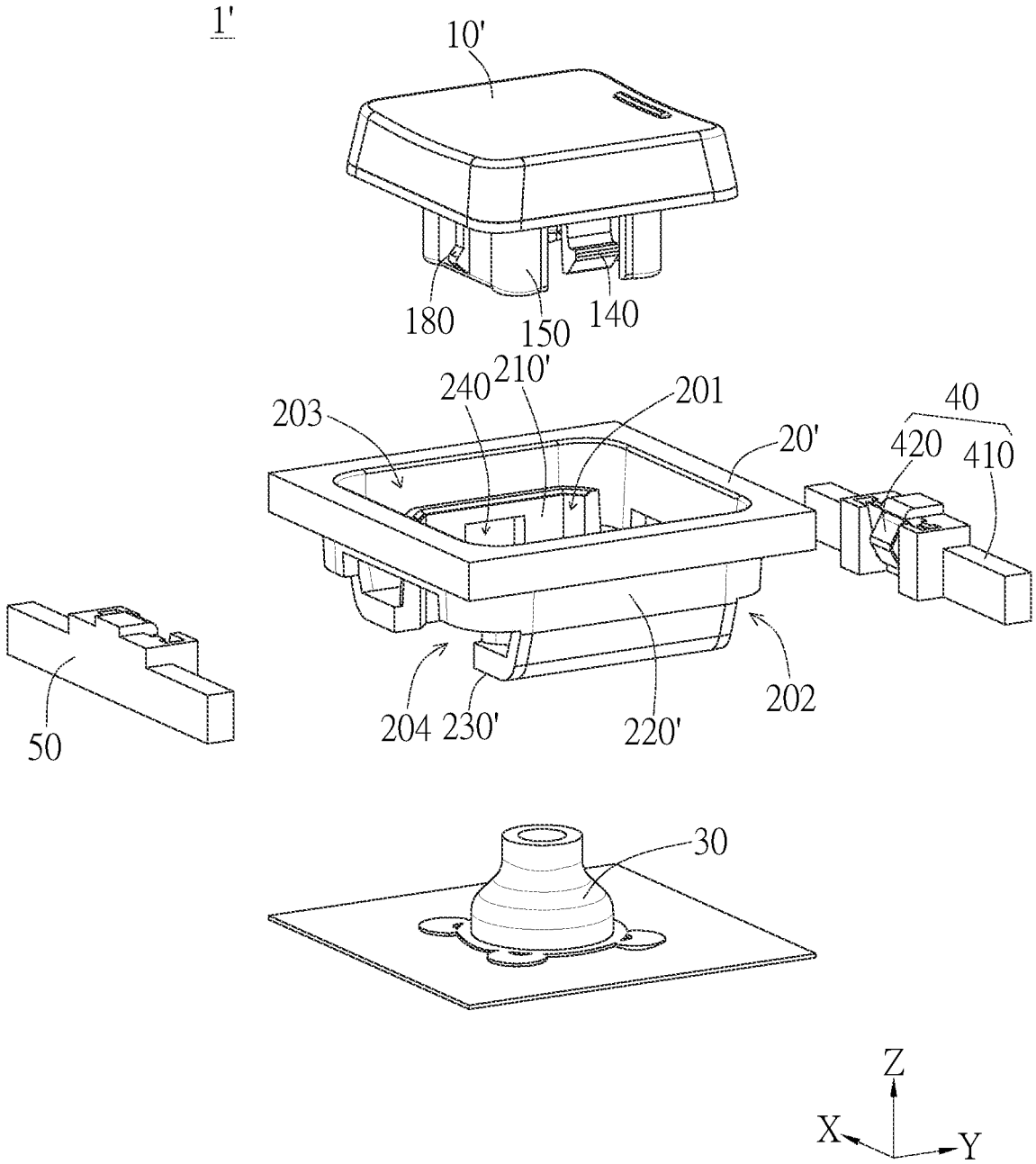
Figure 11C:
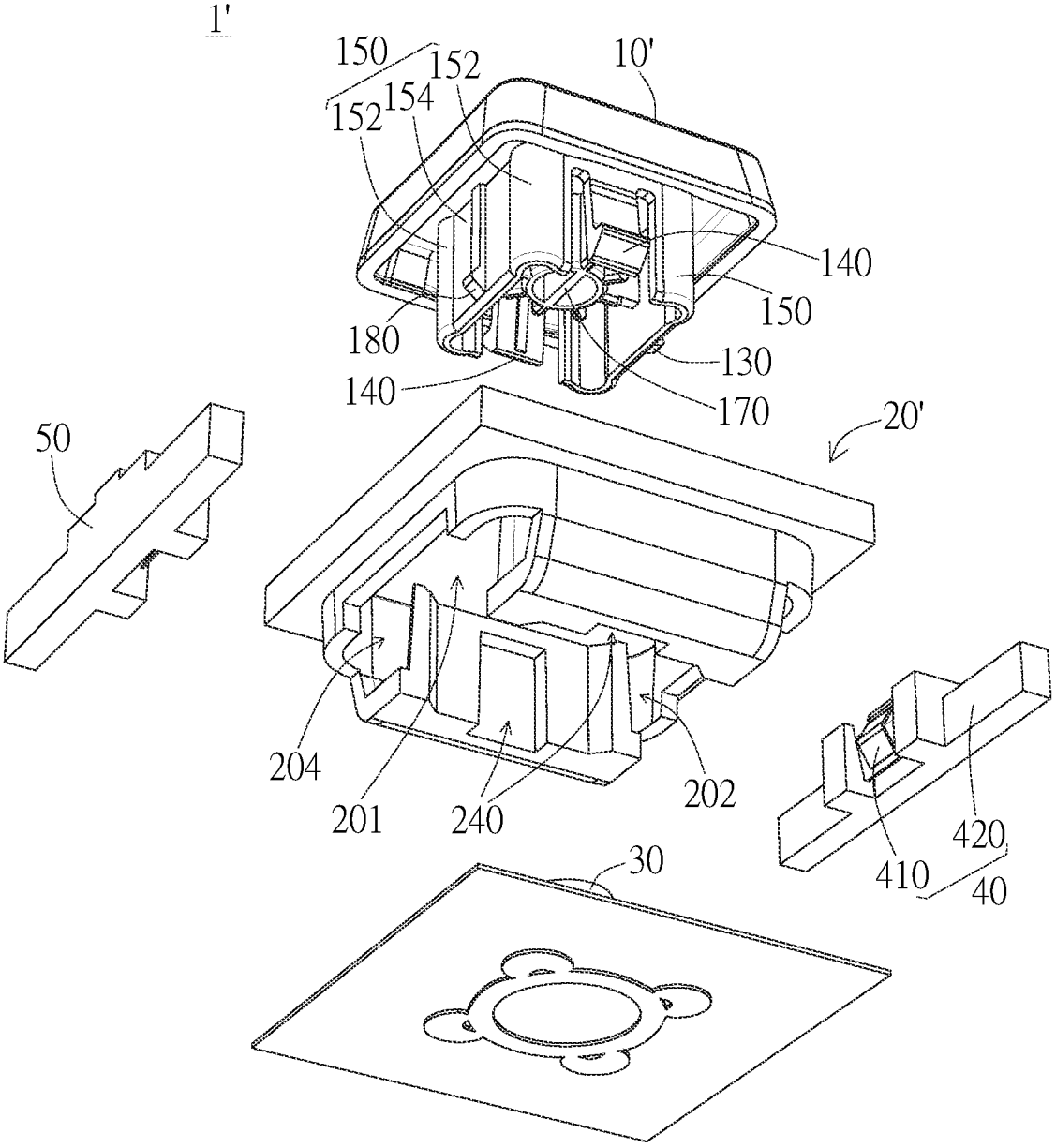

In the above embodiments, the keyswitch structure 1 or 1A can provide two or more kinds of tactile feedback by means of one tactile adjustment unit 40 (or 40'), but not limited thereto. In another embodiment, the keyswitch structure can provide two or more kinds of tactile feedback by multiple tactile adjustment units. FIGS. 11A to 110 are exploded views of a third embodiment of the keyswitch structure 1' of the invention from different viewing angles. In this embodiment, the keyswitch structure 1' further includes a second tactile adjustment unit 50, and the cap 10' further has a second cam portion 180. The second tactile adjustment unit 50 is disposed corresponding to the second cam portion 180. Specifically, the two tactile adjustment units 40 and 50 may have a similar structure, and the details of the tactile adjustment unit 50 can be referred to the related descriptions of the first tactile adjustment unit 40 of FIG. 1A. For example, the second tactile adjustment unit 50 includes a second tactile feedback member 510 (e.g. an elastic member) and a second holder 520, and the second tactile feedback member 510 is mounted on the second holder 520. The second holder 520 is movable relative to the base 20' to change a position of the second tactile feedback member 510 relative to the second cam portion 180, so as to change the pressing force required for the second cam portion 180 to move toward the base 20'. Hereinafter, the differences between this embodiment and the previous embodiments will be described.

As shown in FIGS. 11A to 110, the cap 10' is embodied as a keycap and has two cam portions 130 and 180, which are disposed corresponding to the two tactile adjustment units 40 and 50, respectively. The two cam portions 130 and 180 are preferably disposed on opposite sides of the Y axis direction. Moreover, corresponding to the tactile adjustment units 40 and 50, the two cam portions 130 and 180 can be angular blocks having different cross-sectional shapes. For example, the second cam portion 180 can have a cross section of isosceles triangle, and the first cam portion 130 can have a cross section of non-isosceles triangle, which has a shorter length at the lower surface. As such, in the Z axis direction, the protrudent point of the first cam portion 130 is lower than the protrudent point of the second cam portion 180 (shown in FIG. 14A). In this embodiment, the guiding wall 150 functions as the first guiding portion of the keycap to enhance the stability of the keycap moving relative to the base 20'. Other details of the keycap (e.g. the first engaging portion 140, the guiding wall 150, the positioning portion 170) can be referred to the related descriptions of the previous embodiments.

Figure 12A:
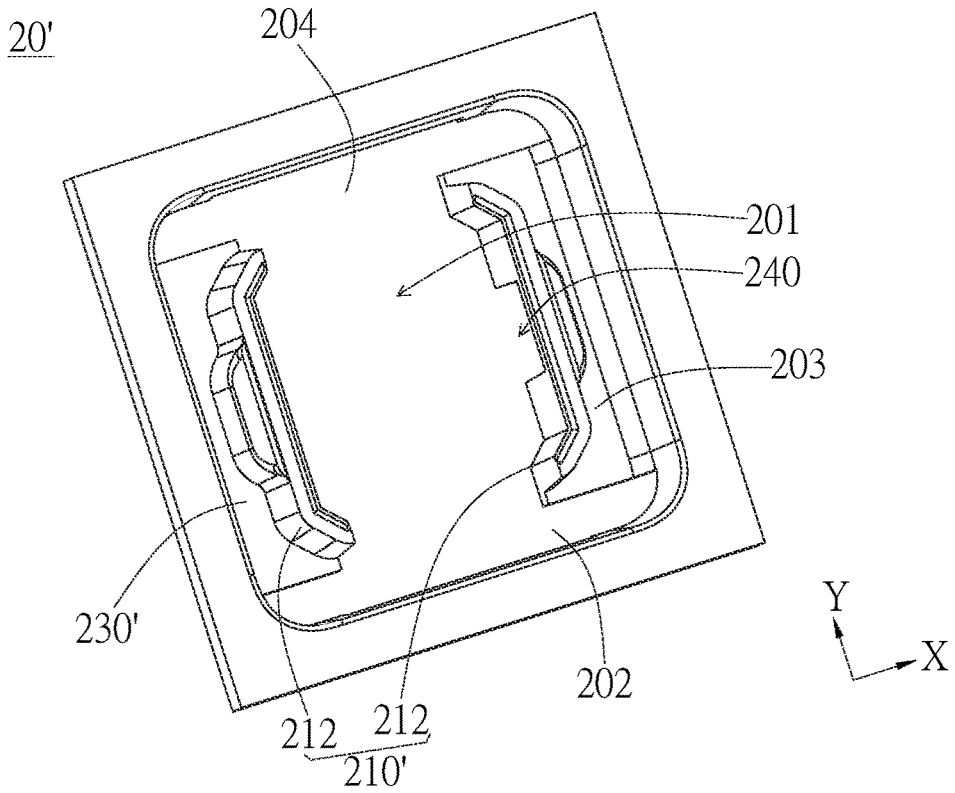
FIGS. 12A and 12B are schematic views of the base of FIG. 11A from different viewing angles.
Figure 12B:
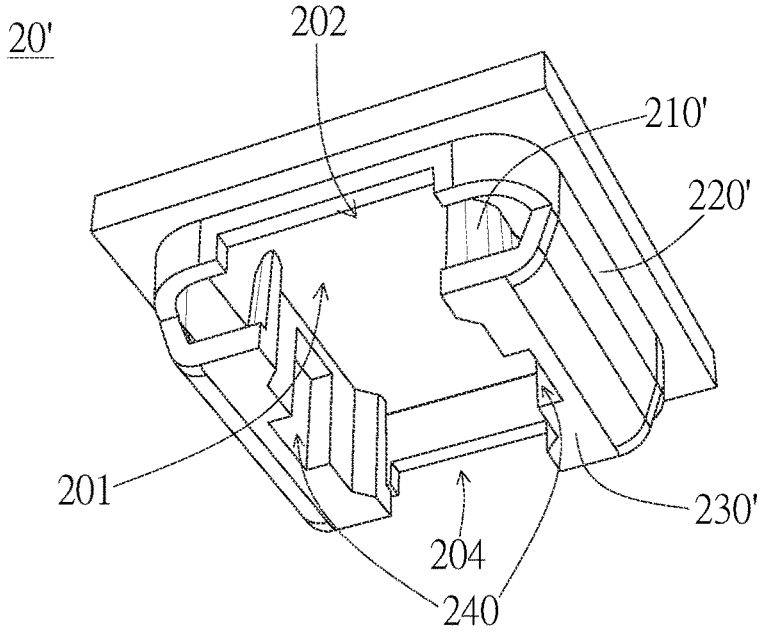
Figure 13A:
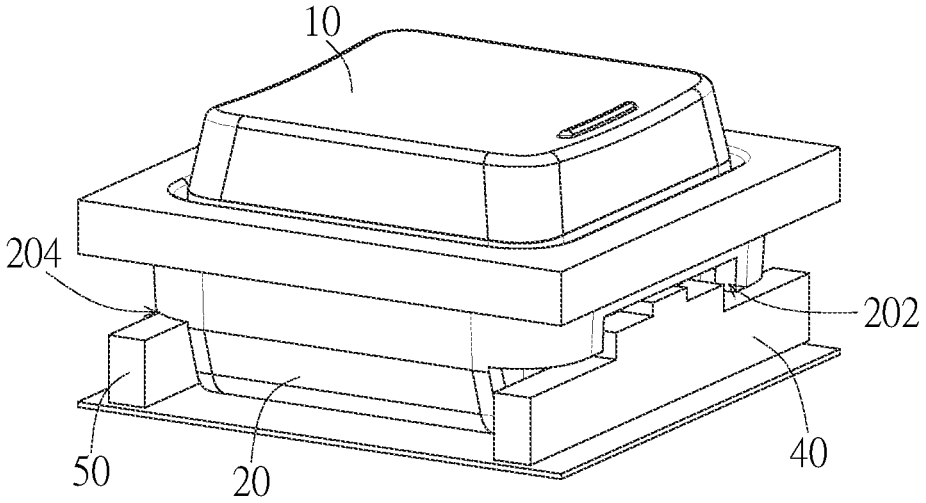
FIGS. 13A and 13B are a perspective view and a side view of the keyswitch structure of FIG. 11A having the first tactile feedback.
Figure 13B:
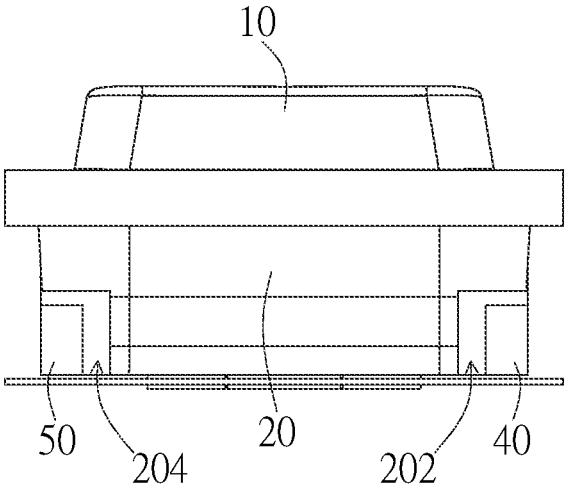

As shown in FIGS. 12A and 12B, the base 20' has two openings 202 and 204, and the two tactile adjustment units 40 and 50 are disposed corresponding to the two openings 202 and 204, respectively. In this embodiment, corresponding to the disposition of the two openings 202 and 204, the inner wall 210' of the base 20' is designed as two sidewalls 212, which are disposed separately along the X axis direction and extend along the Y axis direction, and two slots are respectively disposed on the two sidewalls 212 as the second engaging portion 240. Specifically, the inner wall 210' extends upward from the bottom 230' at two opposite sides of the accommodation space 201, and the outer wall 220' extends upward form the bottom 230' with a distance apart from the inner wall 210', so that the inner wall 210', the outer wall 220', and the bottom 230' together enclose the movement space 203. The two openings 202 and 204 can be formed at opposite sides of the base 20', so that the bottom 203' and the outer wall 220' are partially opened, and the openings 202 and 204 can communicate with the accommodation space 201 and the movement space 203.

Referring to FIGS. 13A and 13B and FIGS. 14A and 14B, an embodiment of the keyswitch structure 1' having the first tactile feedback is illustrated. As shown in the figures, the tactile adjustment units 40 and 50 can move relative to the base 20' (i.e., the holders 420 and 520 can move relative to the base 20'), so that the first tactile feedback member 410 mounted on the first holder 420 and the second tactile feedback member 510 mounted on the second holder 520 can be located at different positions relative to the moving paths of the first cam portions 130 and 180, respectively. In this embodiment, when the two tactile adjustment units 40 and 50 move outward away from the openings 202 and 204, the tactile feedback members 410 and 510 moves along with the holders 420 and 520 to be located outside the moving paths of the cam portions 130 and 180, respectively. In other words, the movable portions 414 and 514 are away from the moving paths of the cam portions 130 and 180 and do not overlap the cam portions 130 and 180 in the Z axis direction, respectively. With such a configuration, when the keycap (i.e., the cap 10) is pressed, the keycap along with the cam portions 130 and 180 moves downward and compresses the rubber dome (i.e., the restoring member 30) to trigger the switch unit, and during the downward movement of the cam portions 130 and 180, the cam portions 130 and 180 do not interfere with the movable portions 414 and 514 of the tactile feedback members 410 and 510 since the movable portions 414 and 514 are respectively located outside the moving paths of the cam portions 130 and 180, so that the keyswitch structure 1' provides the first tactile feedback, i.e., soundless linear tactile feedback. When the keyswitch structure 1' is in such a status, the pressing force required for the cam portions 130 and 180 to move across the tactile feedback members 410 and 510 is relatively smaller, and no sound will be generated. That is, in the embodiment of FIG. 14A, the first tactile feedback provided by the keyswitch structure 1' is similar to the second tactile feedback provided in the embodiments of FIG. 6A and FIG. 10A.

Figure 15A:
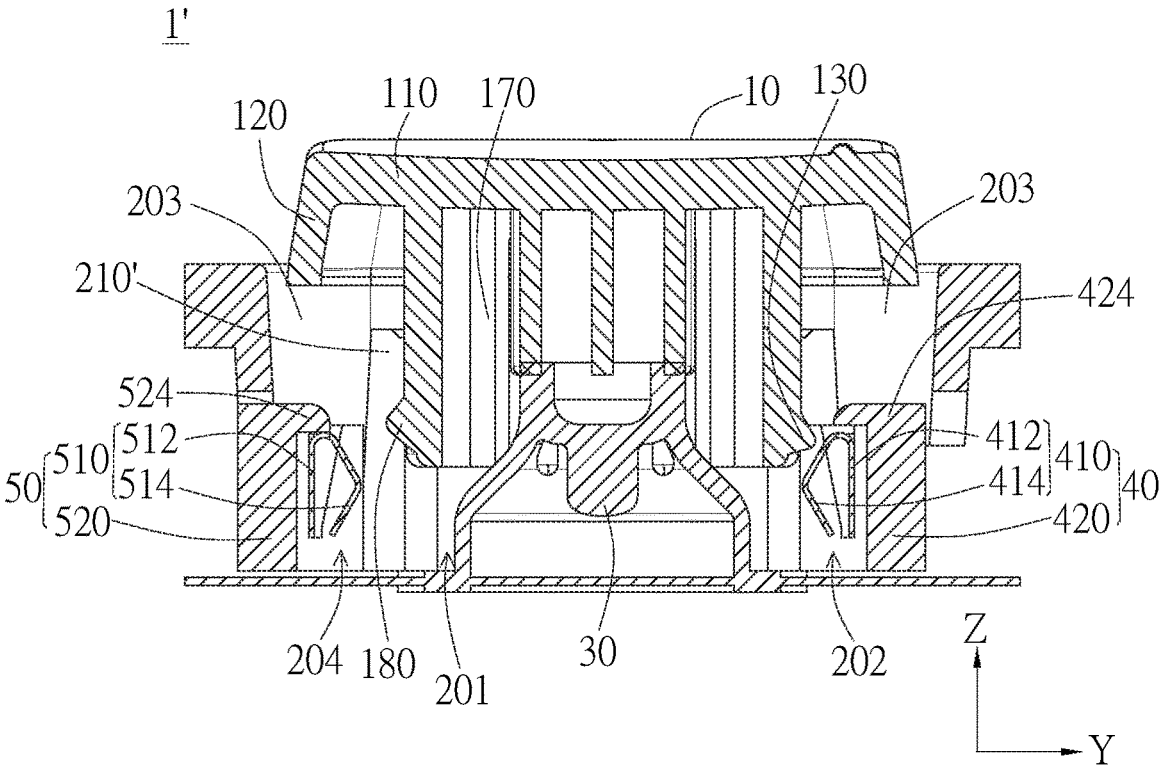
FIGS. 15A and 15B are schematic cross-sectional views of the keyswitch structure of FIG. 11A having the second tactile feedback at the non-pressed state and the pressed state, respectively.
Figure 15B:
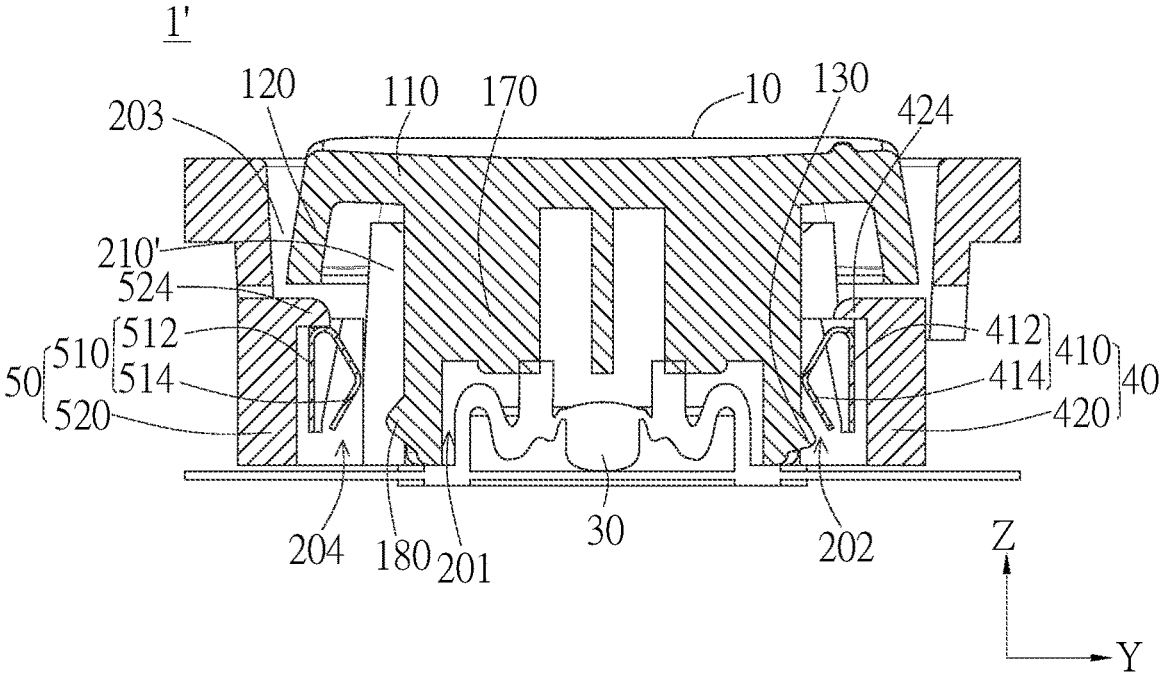

Referring to FIGS. 15A and 15B, an embodiment of the keyswitch structure 1' having the second tactile feedback is illustrated. When the second tactile adjustment unit 50 is maintained at the position near the outer side of the second opening 204 (i.e., at the position shown in FIG. 14A that the second tactile feedback member 510 does not interfere with the second cam portion 180), and the first holder 420 of the first tactile adjustment unit 40 moves relative to the base 20' toward the first opening 202, the first tactile feedback member 410 moves along with the first holder 420 to be located inside the moving path of the first cam portion 130, i.e., the first movable portion 414 at least partially overlaps the first cam portion 130 in the Z axis direction. With such a configuration, when the keycap (i.e., cap 10) is pressed, the keycap along with the cam portions 130 and 180 moves downward and compresses the rubber dome (i.e., the restoring member 30), and during the downward movement of the cam portions 130 and 180, only the first cam portion 130 interferes with the movable portion 414 of the first tactile feedback member 410, such as the first cam portion 130 pressing the movable portion 414 toward the positioning portion 412. As shown in FIG. 15B, when the keycap keeps moving downward to trigger the switch unit, and the first cam portion 130 passes the movable portion 414 (i.e., the movable portion 414 moves across the protrudent point of the first cam portion 130), the movable portion 414 is released to rebound away from the positioning portion 412 and bounce upward, so that the first tactile feedback member 410 hits the restricting portion 424 (and selectively the upper portion of the first cam portion 130) to generate a sound, and the keyswitch structure 1' provides the second tactile feedback. When the keyswitch structure 1' is in such a status, the pressing force required for the first cam portion 130 to move across the tactile feedback member 410 is relatively larger, and the sound can be generated. When the keycap is released, i.e., the cap 10 is not pressed anymore, by means of the restoring force provided by the restoring member 30, the keycap can move upward relative to the base 20' and return to the non-pressed position, as shown in FIG. 15A. That is, in the embodiment of FIG. 15A, the second tactile feedback provided by the keyswitch structure 1' is similar to the first tactile feedback provided in the embodiment of FIG. 4A.

Figure 16A:
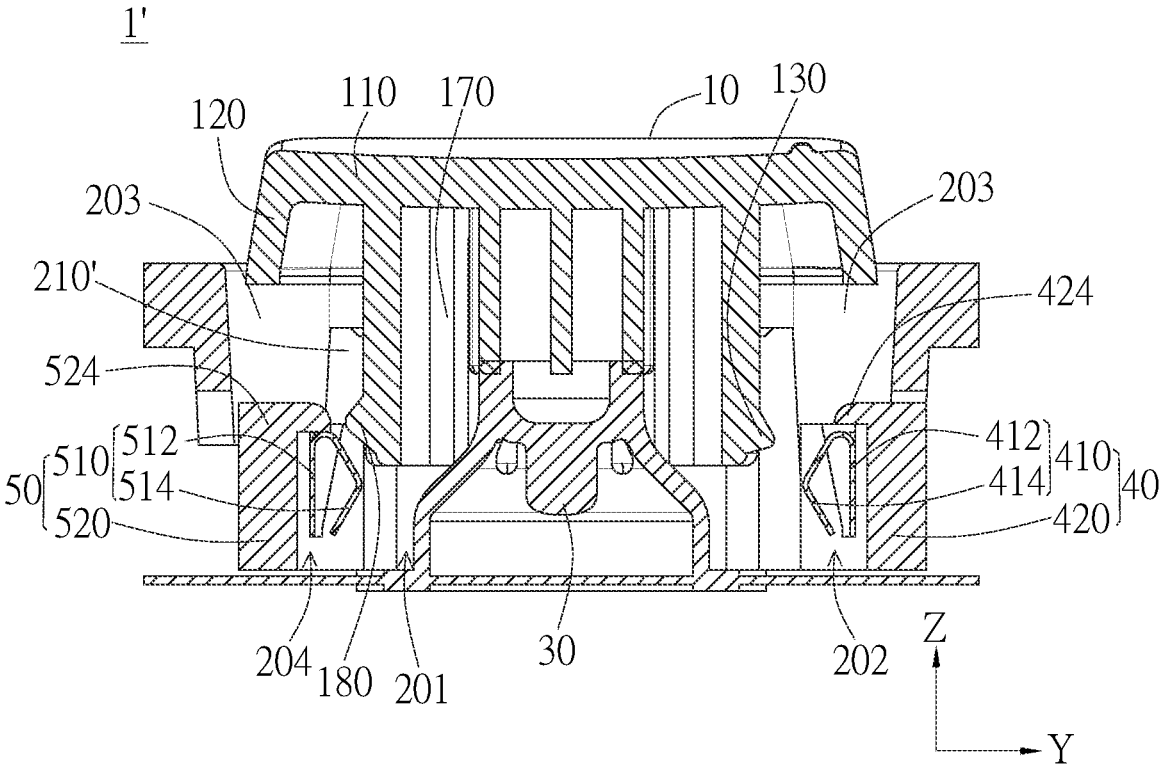
FIGS. 16A and 16B are schematic cross-sectional views of the keyswitch structure of FIG. 11A having the third tactile feedback at the non-pressed state and the pressed state, respectively.
Figure 16B:
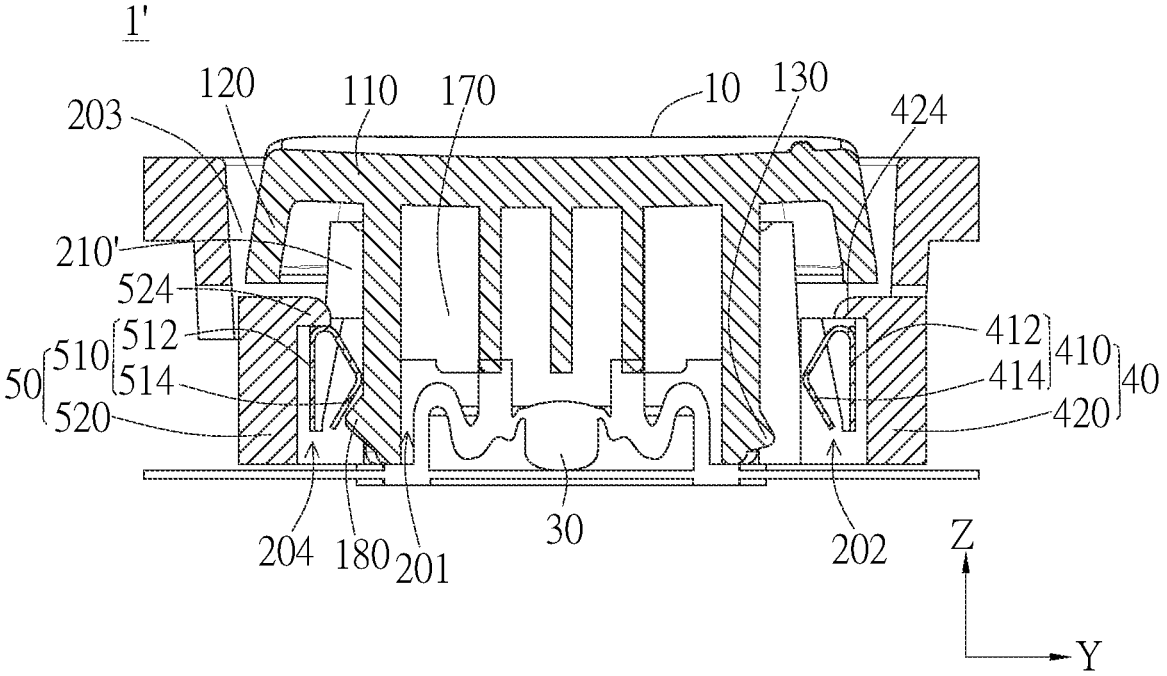

Referring to FIGS. 16A and 16B, an embodiment of the keyswitch structure 1' having the third tactile feedback is illustrated. As shown in the figures, when the first tactile adjustment unit 40 is maintained at the position near the outer side of the first opening 202 (i.e., at the position shown in FIG. 14A that the first tactile feedback member 410 does not interfere with the first cam portion 130), and the second holder 520 of the second tactile adjustment unit 50 moves relative to the base 20' toward the opening 204, the second tactile feedback member 510 moves along with the second holder 520 to be located inside the moving path of the second cam portion 180, i.e., the movable portion 514 at least partially overlaps the second cam portion 180 in the Z axis direction. With such a configuration, when the keycap (i.e., cap 10) is pressed, the keycap along with the cam portions 130 and 180 moves downward and compresses the rubber dome (i.e., the restoring member 30), and during the downward movement of the cam portions 130 and 180, only the second cam portion 180 interferes with the movable portion 514 of the second tactile feedback member 510, such as the second cam portion 180 pressing the movable portion 514 toward the positioning portion 512. In this embodiment, the angular cross sections of the cam portions 130 and 180 are different, and the second tactile feedback member 510 of the second tactile adjustment unit 50 abuts against the bottom of the restricting portion 524 of the second holder 520 (i.e., no gap between the second tactile feedback member 510 and the restricting portion 524). The movable portion 514 will not bounce upward substantially. As shown in FIG. 16B, when the keycap keeps moving downward to trigger the switch unit, and the second cam portion 180 passes the movable portion 514 (i.e., the movable portion 514 moves across the protrudent point of the second cam portion 180), the movable portion 514 is released to rebound away from the positioning portion 512, so that the second tactile feedback member 510 selectively hits the upper portion of the second cam portion 180 to generate or not generate a sound, and the keyswitch structure 1' provides the third tactile feedback. When the keyswitch structure 1' is in such a status, the pressing force required for the second cam portion 180 to move across the tactile feedback member 510 is different from that of the keyswitch structure 1' in FIG. 15A, and the volume of sound is also different. When the keycap is released, i.e., the cap 10 is not pressed anymore, by means of the restoring force provided by the restoring member 30, the keycap can move upward relative to the base 20' and return to the non-pressed position, as shown in FIG. 16A.

The keyswitch structure 1' of FIG. 11A uses two tactile adjustment units 40 and 50 to provide different kinds of tactile feedback, wherein when the first tactile adjustment unit 40 interferes with the first cam portion 130, the pressing force required for the first cam portion 130 to move toward the base 20' is a first pressing force. When the second tactile adjustment unit 50 interferes with the second cam portion 180, the pressing force required for the second cam portion 180 to move toward the base 20' is a second pressing force, which is different from the first pressing force. In another embodiment (not shown), according to practical applications, the tactile adjustment units 40 and 50 can be adjusted, so that the tactile feedback members 410 and 510 mounted on the holders 420 and 520 are respectively located in the moving paths of the cam portions 130 and 180, i.e., the movable portions 414 and 514 are respectively located inside the moving paths of the cam portions 130 and 180. As such, when the keycap is pressed, the cam portions 130 and 180 interfere with the movable portions 414 and 514, respectively, and the keyswitch structure 1' provides the fourth tactile feedback. Moreover, in the embodiment of FIG. 11A, the tactile feedback members 410 and 510 are illustrated as the U-shaped resilient members, but not limited thereto. In another embodiment, the two tactile adjustment units can be one similar to the first tactile adjustment unit 40 of FIG. 1A and one similar to the tactile adjustment unit 40' of FIG. 7, or two similar to the tactile adjustment units 40' of FIG. 7 with the torsion springs having different given resilient forces.

Figure 17A:
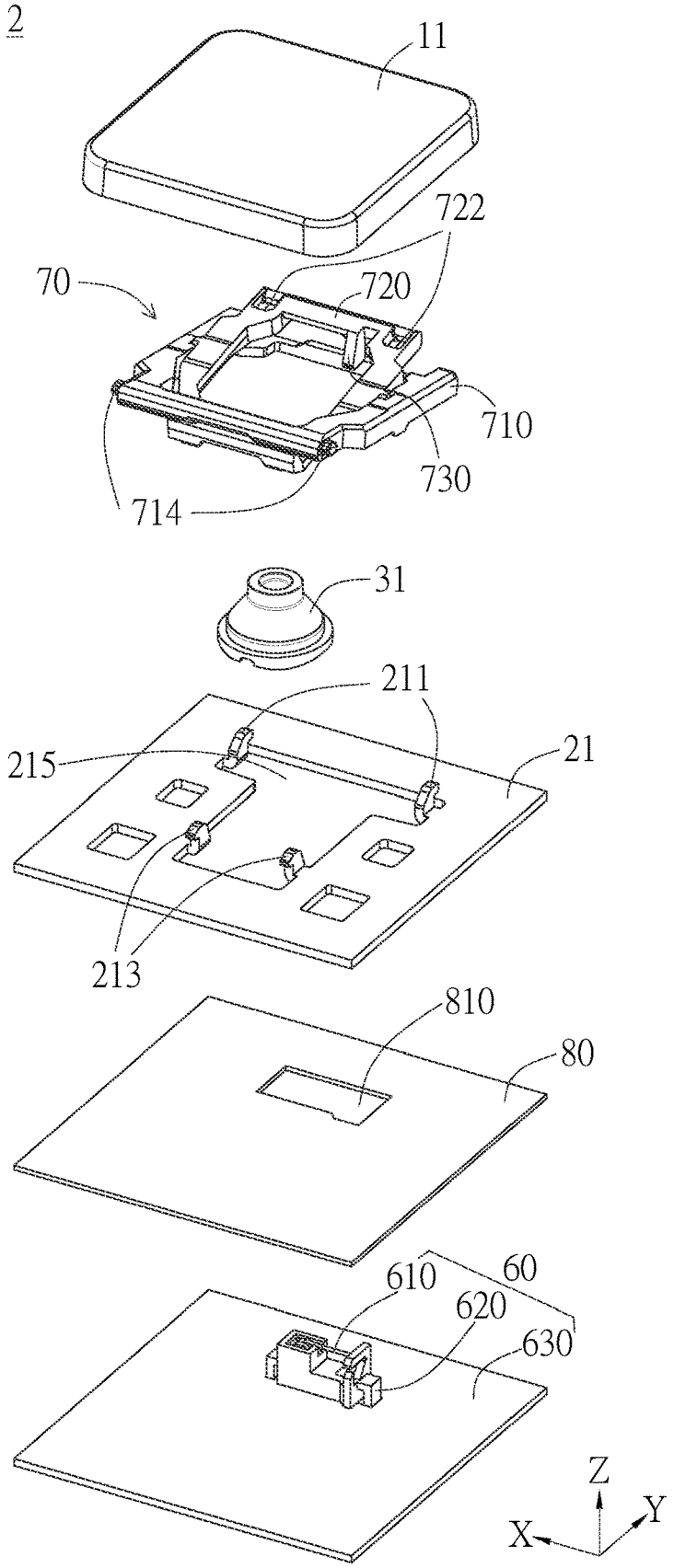
FIGS. 17A and 17B are exploded views of a fourth embodiment of the keyswitch structure of the invention from different viewing angles.
Figure 17B:
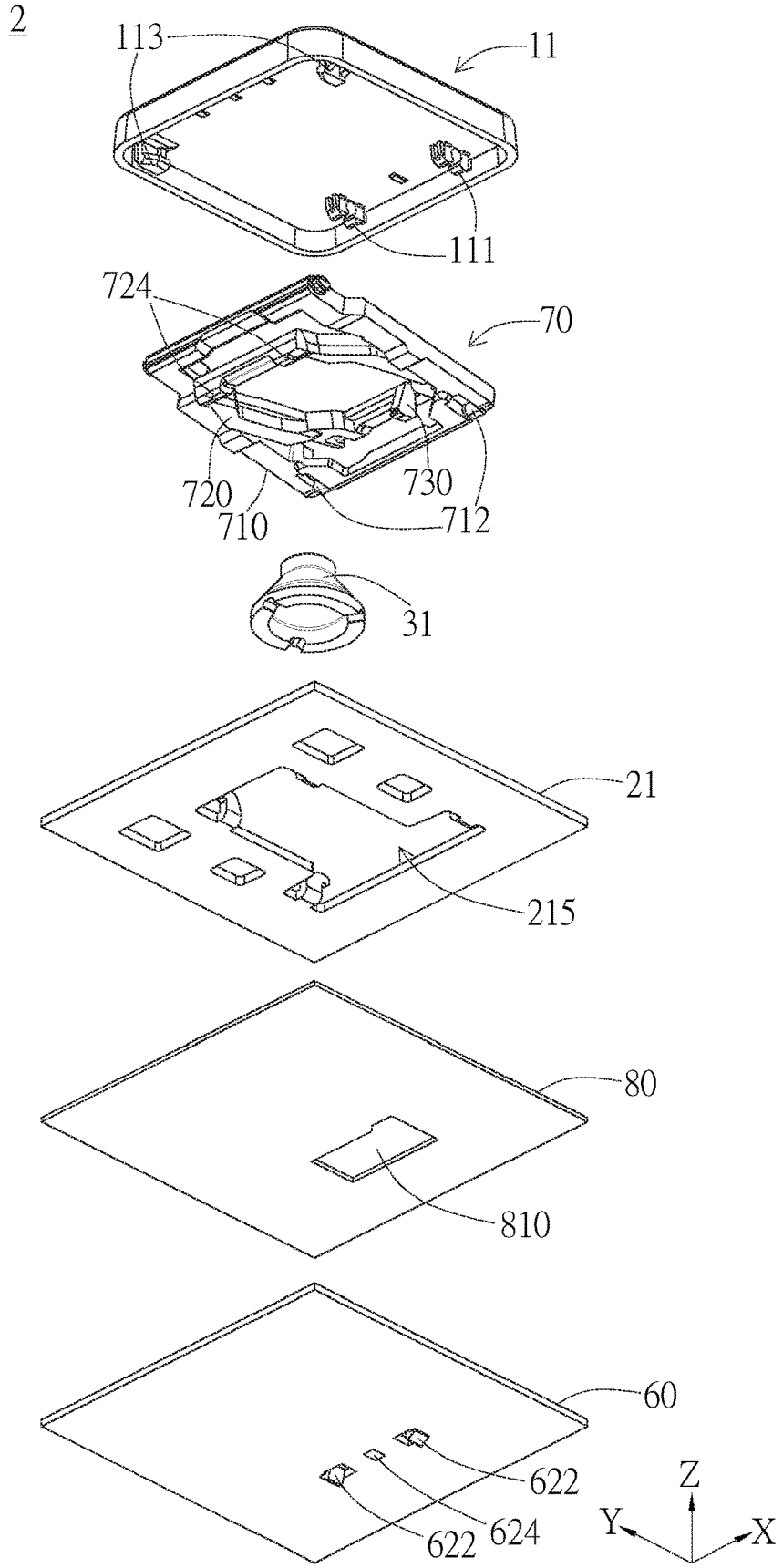
Figure 17C:
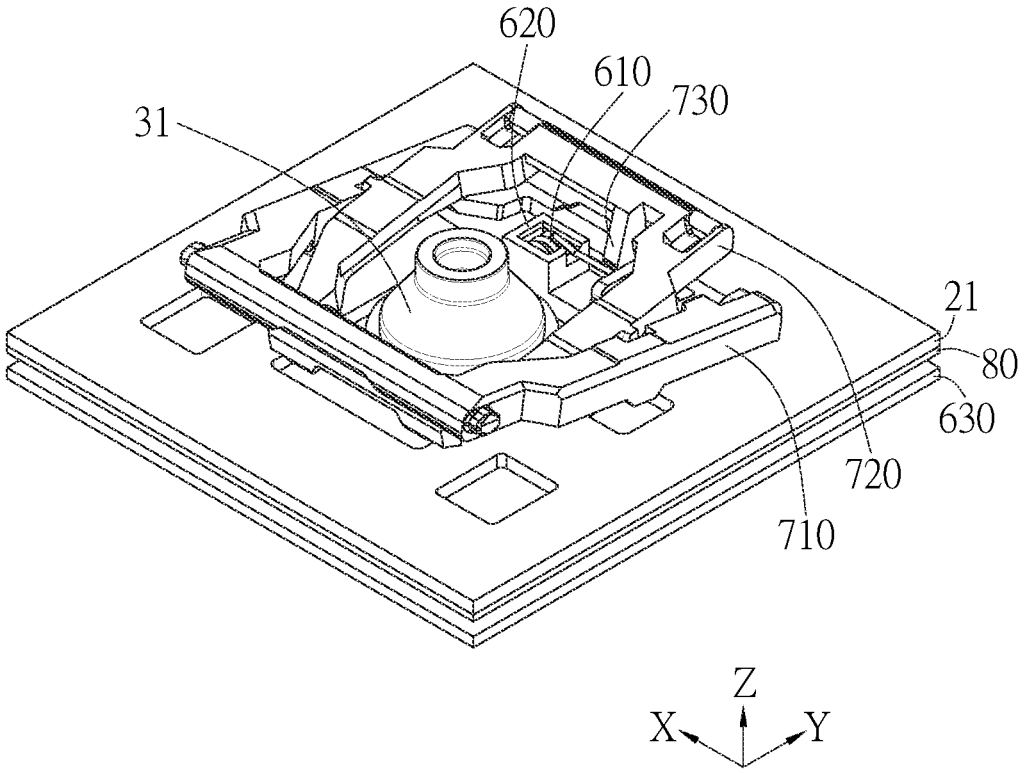
FIG. 17C is an assembled view of the keyswitch structure of FIG. 17A without the cap.

Referring to FIGS. 17A to 17C, FIGS. 17A and 17B are exploded views of a fourth embodiment of the keyswitch structure 2 of the invention from different viewing angles, and FIG. 17C is an assembled view of the keyswitch structure 2 of FIG. 17A without the cap 11. As shown in the figures, the keyswitch structure 2 includes a cap 11, a base 21, a support mechanism 70, a restoring member 31, and a tactile adjustment unit 60. The base 21 is disposed below the cap 11. The support mechanism 70 is connected between the cap 11 and the base 21 to support the cap 11 to move relative to the base 21, and the support mechanism 70 has a cam portion 730. The restoring member 31 is disposed between the base 21 and the cap 11 and configured to provide a restoring force to enable the cap 11 to move away from the base 21. The tactile adjustment unit 60 is disposed corresponding to the cam portion 730. The tactile adjustment unit 60 includes a tactile feedback member 610 and a holder 620, and the tactile feedback member 610 is mounted on the holder 620. The holder 620 is movable relative to the base 21 to change a position of the tactile feedback member 610 relative to the cam portion 730, so as to change a pressing force required for the cam portion 730 to move toward the base 21 when the cam portion 730 is driven by the cap 11.

Specifically, the cap 11 can be embodied as a keycap, and the keycap has couplers 111 and 113 on its bottom surface. The couplers 111 and 113 are configured to couple with the support mechanism 70. The coupler 111 can be a coupling structure having a coupling hole, and the coupler 113 can be a coupling structure having a groove. According to practical applications, the keycap can be a keycap having a light-transparent portion, so as to be applied to a lighting keyboard. For example, the light-transparent portion can have an alphanumeric configuration, such as number, letter, and symbol, to indicate the instruction inputted by the keyswitch.

The base 21 can be a baseplate, which enhances the structural strength of the keyswitch structure 2. The base 21 has connection members 211 and 213, which are configured to couple the support mechanism 70. In an embodiment, the baseplate is preferably a metal plate, which is formed by stamping. The connection members 211 and 213 are hook-like portions bent from the baseplate toward the keycap. The base 21 further has an opening 215 for accommodating the tactile adjustment unit 60. In this embodiment, the opening 215 is opened toward the moving direction of the cap 11. For example, the opening 215 penetrates the base 21 along the Z axis direction.

The support mechanism 70 includes an outer frame 710 and an inner frame 720. The inner frame 720 is pivotally connected to the inner side of the outer frame 710 to form a scissors-like support mechanism. The outer frame 710 and the inner frame 720 can be rectangular frames formed by injection molding, and the inner frame 720 and the outer frame 710 are rotatably connected to each other by means of a pivotal shaft and a pivotal hole. Moreover, two ends of each of the inner frame 720 and the outer frame 710 are movably connected to the cap 11 and the base 21, respectively. For example, the coupling portion 712 of the outer frame 710 at the keycap end movably couples with the coupler 113 of the keycap (i.e., the cap 11), and the coupling portion 712 of the outer frame 710 at the base end movably couples with the connection member 211 of the baseplate (i.e., the base 21). Similarly, the coupling portion 722 of the inner frame 720 at the keycap end movably couples with the coupler 111 of the keycap (i.e., the cap 11), and the coupling portion 724 of the inner frame 720 at the base end movably couples with the connection member 213 of the baseplate (i.e., the base 21). As such, the support mechanism 70 can stably support the cap 11 to move upward and downward relative to the base 21. The cam portion 730 is disposed on the inner side of the inner frame 720 and extends from the inner frame 720 toward the base 21. For example, the cam portion 730 is disposed on the inner side of the inner frame 720 at the keycap end. The cam portion 730 extends downward as an angular post, and the angular post has a protrudent point protruding toward the tactile adjustment unit 60.

The restoring member 31 can be a rubber dome, a spring, or a magnetic member, to provide the restoring force to enable the cap 11 to move away from the base 21. The keyswitch structure 2 can further include a switch unit 80. In an embodiment, the switch unit 80 can be a membrane switch disposed under the rubber dome, and located under or above (in this embodiment, under) the base 21, but not limited thereto. In another embodiment, according to practical applications, the switch unit can be an optical switch or a mechanical switch, which is triggered in response to the movement of the cap 11 relative to the base 21. The switch unit 80 has an opening 810, which is at least partially aligned with the opening 215 of the base 21 and configured to accommodate the tactile adjustment unit 60. When the switch unit 80 is disposed under the base 21, the opening 215 of the base 21 can have a larger size to accommodate the restoring member 31 and the tactile adjustment unit 60, but not limited thereto. In other embodiments, the base 21 can have two separate openings, wherein one is provided as the opening 215 for accommodating the tactile adjustment unit 60, and the other is provided for accommodating the restoring member 31. When the switch unit 80 is disposed above the base 21 (not shown), the opening 215 and the opening 810 may substantially have the same size to accommodate the tactile adjustment unit 60, and the switch unit 80 can further have a plurality of holes for allowing the connection members 221 and 223 to pass therethrough.

Figure 18A:
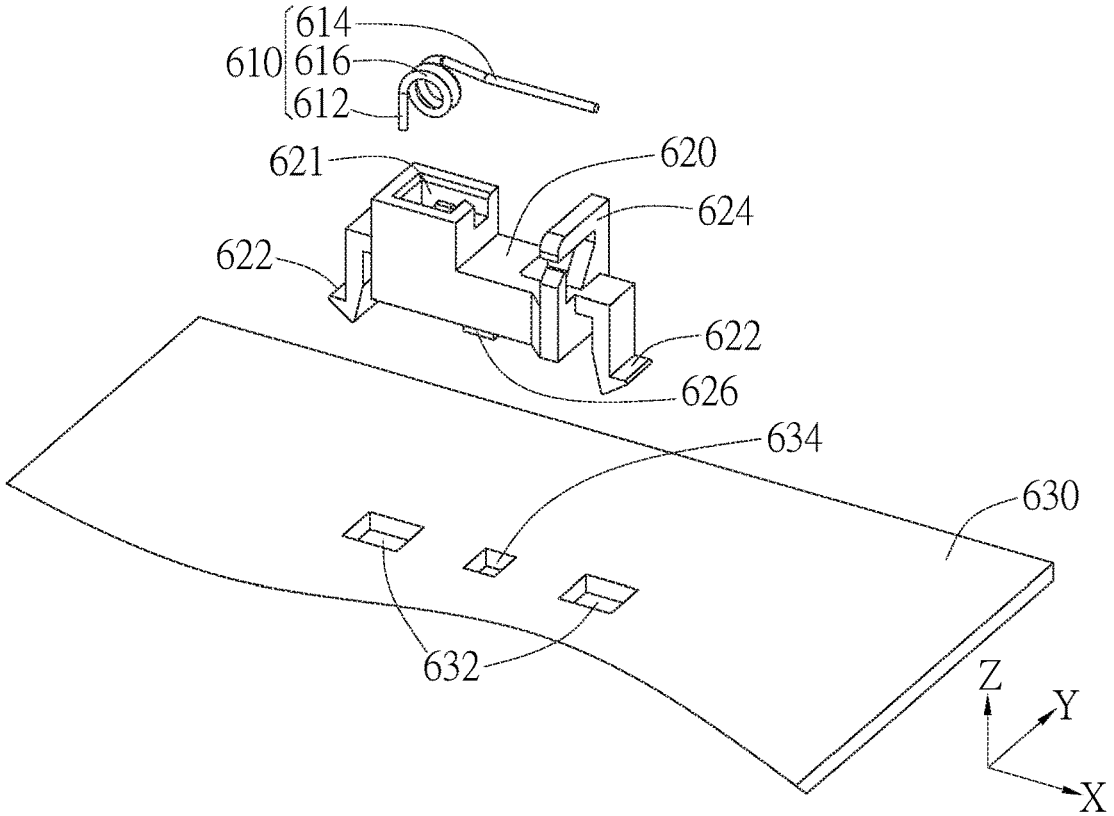
FIGS. 18A to 18C are exploded views of the tactile adjustment unit of FIG. 17A from different viewing angles.
Figure 18B:
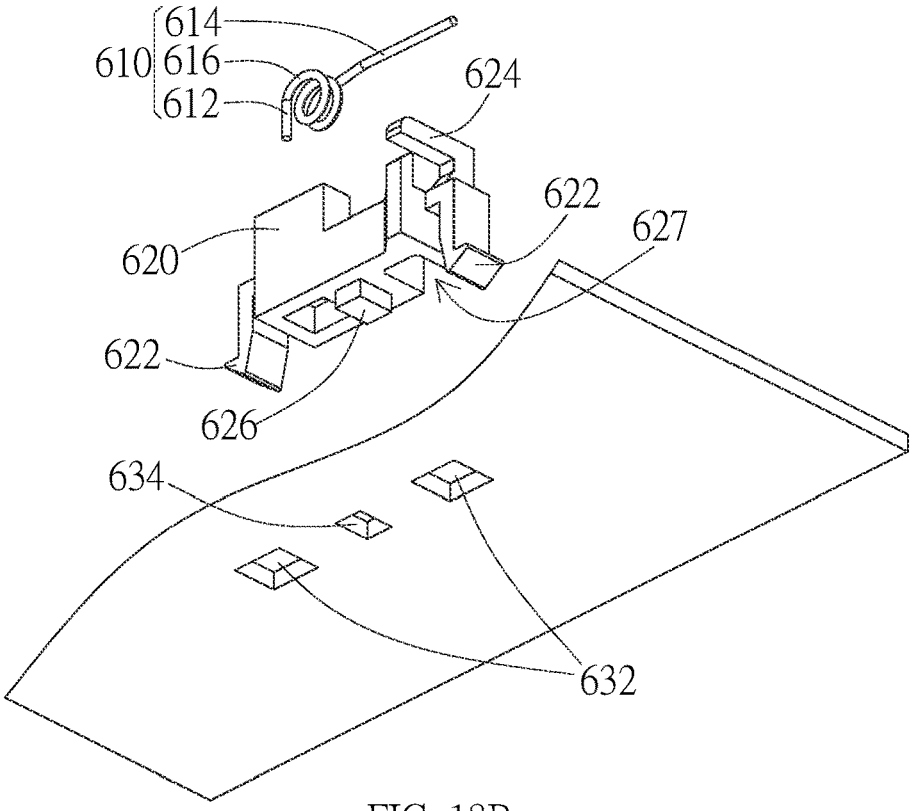
Figure 18C:
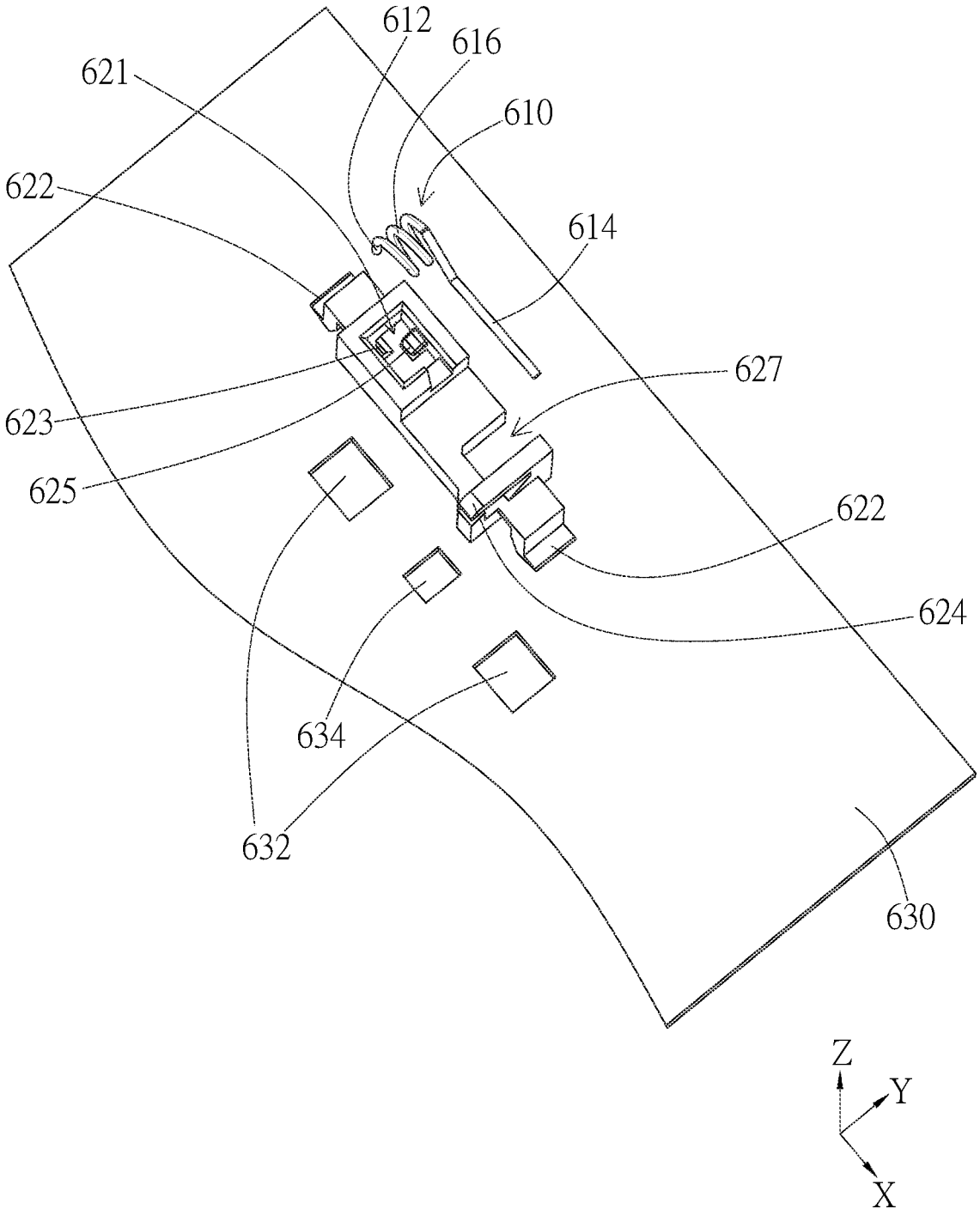

As shown in FIGS. 18A to 18C, in an embodiment, the tactile adjustment unit 60 further includes an adjustment plate 630, which is disposed below the base 21. The holder 620 is disposed on the adjustment plate 630 and protrudes from the opening 215 above the base 21. Specifically, the holder 620 has an engaging portion 622 and a positioning portion 626, which are configured to couple with the adjustment plate 630. For example, the holder 620 has hook-like portions as the engaging portions 622, which are disposed on two opposite sides, extend downward, and are bent outward. The holder 620 has a rod portion as the positioning portion 626, which is disposed on the bottom of the holder 620 and extend downward. The adjustment plate 630 substantially extend parallel to the base 21 and has engaging holes 632 and a positioning hole 634. When the holder 620 is disposed on the adjustment plate 630, the positioning portion 626 extends into the positioning hole 634, and the engaging portions 622 engage with the engaging holes 632, respectively, so that the holder 620 is positioned on the adjustment plate 630. When the adjustment plate 630 is disposed under the base 21, the holder 620 protrudes upward from the opening 215 of the base 21 toward the cap 11. Moreover, in this embodiment, the tactile feedback member 610 can be embodied as a torsion spring (similar to the tactile feedback member 410'), which includes a spring body 616, a positioning portion 612, and an extending arm 614. The positioning portion 612 and the extending arm 614 extend from two ends of the spring body 616, and the details of the tactile feedback member 610 can be referred to the related descriptions of FIG. 7. Corresponding to the torsion spring type tactile feedback member 610, the holder 620 may have a positioning mechanism (e.g. positioning hole 623 and positioning block 625) similar to that of the holder 420 of FIG. 7 and a restricting portion 624. The positioning mechanism is configured to position the tactile feedback member 610, and the restricting portion 624 limits the movement of extending arm 614 in the Z axis direction. For example, the holder 620 can be embodied as a rectangular body with a receiving space 621, and the positioning hole 623 is formed as a through hole at the bottom of the holder 620 and communicates with the receiving space 621. The positioning block 625 is disposed on the wall surface, which defines the receiving space 621, and extends toward the receiving space 621. When the tactile feedback member 610 is disposed in the receiving space 621 of the holder 620, the positioning portion 612 of the tactile feedback member 610 is inserted into the positioning hole 623, the spring body 616 is positioned on the positioning block 625, and the extending arm 614 extends under the restricting portion 624 along the X axis direction. As such, the distal end (i.e., free end) of the extending arm 614 at least partially overlaps the restricting portion 624 in the Z axis direction, and the movement of the extending arm 614 in the Z axis direction can be limited. The holder 620 can further include a channel 627, and the cam portion 730 is allowed to move in the channel 627 relatively when the cam portion 730 moves corresponding to the extending arm 614. The channel 627 is formed along the sidewall of holder 620, which faces the cam portion 730, and corresponds to the extending arm 614, so that at least a portion of the extending arm 614 is exposed from the channel 627.

Figure 19A:
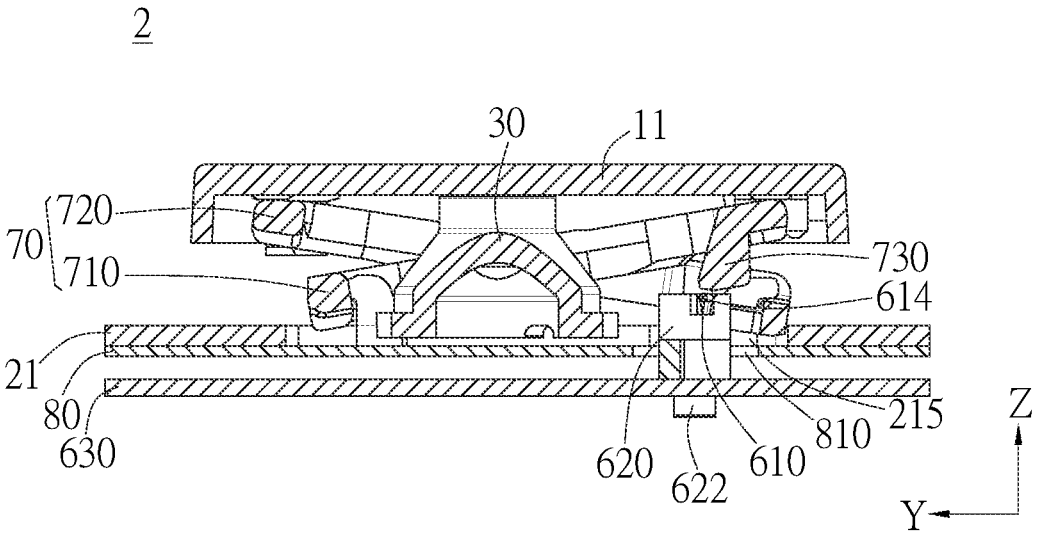
FIGS. 19A and 19B are schematic cross-sectional views of the keyswitch structure of FIG. 17A having the first tactile feedback at the non-pressed state and the pressed state, respectively.
Figure 19B:
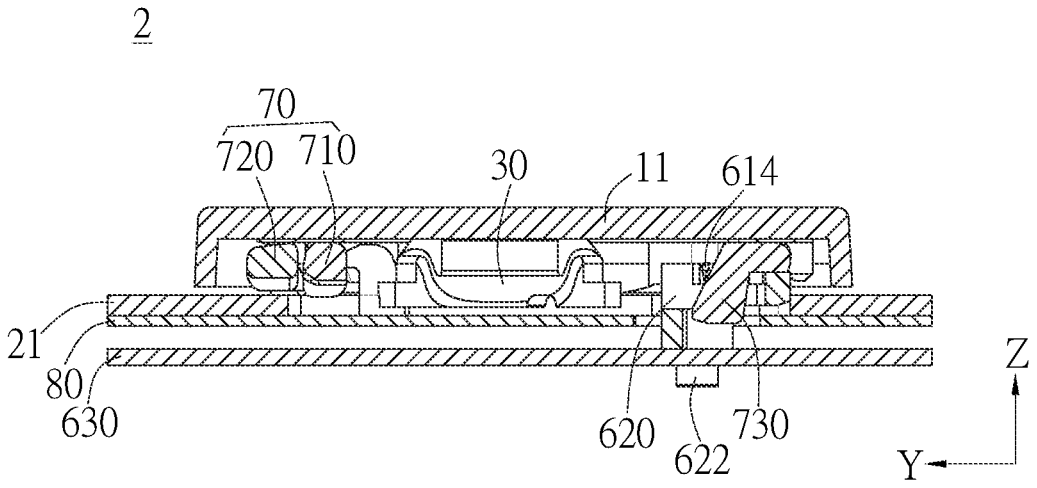

The holder 620 is movable relative to the base 21 to change the position of the tactile feedback member 610 relative to the cam portion 730, so that the extending arm 614 can be located inside or outside the moving path of the cam portion 730, and the tactile feedback of the keyswitch structure 2 is accordingly changed. Referring to FIGS. 19A and 19B, an embodiment of the keyswitch structure 2 having the first tactile feedback is illustrated. As shown in the figures, the tactile adjustment unit 60 can move relative to the base 21 (i.e., the holder 620 moves relative to the base 21 in the opening 215 by moving the adjustment plate 630), so that the position of the tactile feedback member 610 mounted on the holder 620 relative to the moving path of the cam portion 730 can be changed. In this embodiment, when the holder 620 moves relative to the base 21 in the opening 215 toward the cam portion 730 (e.g. toward the righthand side), the tactile feedback member 610 moves along with the holder 620 to be located inside the moving path of the first cam portion 730. In other words, the extending arm 714 extends across the moving path of the cam portion 730, or the extending arm 714 overlaps the cam portion 730 in the Z axis direction. With such a configuration, when the keycap (i.e., cap 11) is pressed, the keycap drives the support mechanism 70 to move downward and compresses the rubber dome (i.e., the restoring member 31), and the cam portion 730 moves downward along with the support mechanism 70 to interfere with the extending arm 614. Specifically, the cam portion 730 moves downward in the channel 627 of the holder 620 and presses the extending arm 614, so that the extending arm 614 moves relatively along the lower surface of the cam portion 730 toward the protrudent point. As shown in FIG. 19B, when the keycap keeps moving downward to trigger the switch unit 80, the extending arm 614 moves relatively across the protrudent point and then along the upper surface of the cam portion 730, so that the extending arm 614 is released to bounce (e.g. upward) toward the restricting portion 624 of the holder 620 and hit the restricting portion 624 to generate a sound, and the keyswitch structure 2 provides the first tactile feedback. When the keyswitch structure 2 is in such a status, the pressing force required for the cam portion 730 to move across the tactile feedback member 610 is relatively larger, and the sound can be generated. When the keycap is released, i.e., the cap 11 is not pressed anymore, by means of the restoring force provided by the restoring member 31, the keycap and the support mechanism 70 can move upward relative to the base 21 and return to the non-pressed position, as shown in FIG. 19A.

Figure 20A:
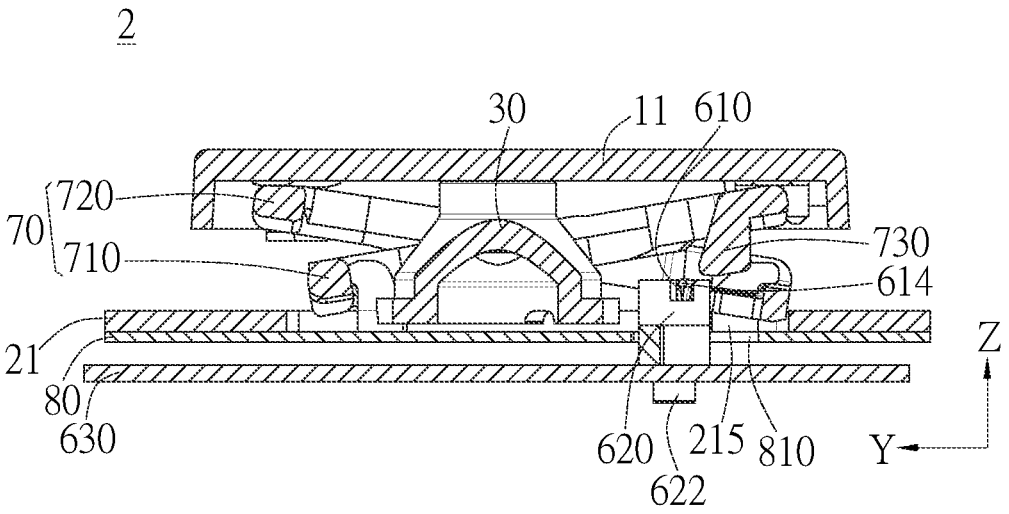
FIGS. 20A and 20B are schematic cross-sectional views of the keyswitch structure of FIG. 17A having the second tactile feedback at the non-pressed state and the pressed state, respectively.
Figure 20B:
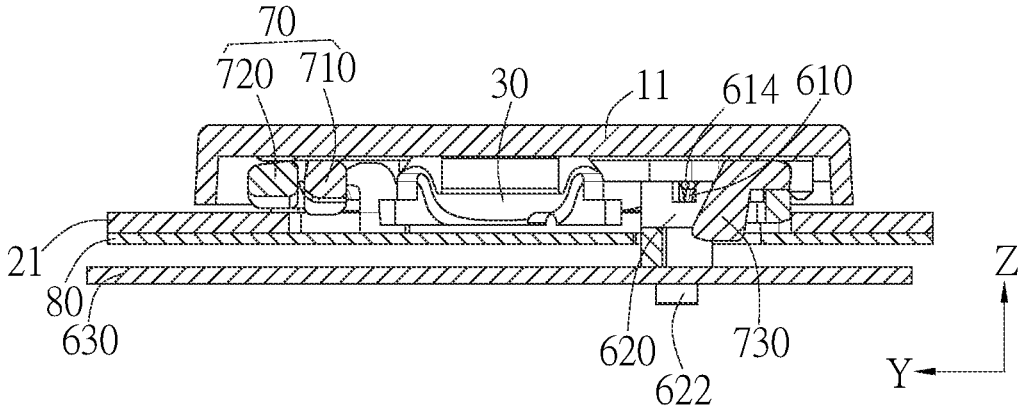

Referring to FIGS. 20A and 20B, an embodiment of the keyswitch structure 2 having the second tactile feedback is illustrated. As shown in the figures, when the holder 620 moves relative to the base 21 in the opening 215 away from the cam portion 730 (e.g. toward the left-hand side), the tactile feedback member 610 moves along with the holder 620 to be located outside the moving path of the cam portion 730, i.e., the extending arm 614 moves away from the moving path of the cam portion 730 or does not overlap the cam portion 730 in the Z axis direction. With such a configuration, when the keycap (i.e., cap 11) is pressed, the keycap drives the support mechanism 70 as well as the cam portion 730 to move downward and compresses the rubber dome (i.e., the restoring member 31) to trigger the switch unit 80, and during the downward movement of the cam portion 730, the cam portion 730 does not interfere with the extending arm 614 of the tactile feedback member 610 since the extending arm 614 is located outside the moving path of the cam portion 730, so that the keyswitch structure 2 provides the second tactile feedback, i.e., soundless linear tactile feedback. When the keyswitch structure 2 is in such a status, the pressing force required for the cam portion 730 to move across the tactile feedback member 610 is relatively smaller, and no sound will be generated.

Moreover, in this embodiment, the tactile feedback member 610 is embodied as the torsion spring, but not limited thereto. In another embodiment, the tactile feedback member 610 can be a resilient member and arranged in a manner similar to that of the first tactile adjustment unit 40 of FIG. 1A or the second tactile adjustment unit 50 of FIG. 11A. Moreover, in this embodiment, the holder 620 is mounted on the adjustment plate 630 to be moved by moving the adjustment plate 630, but not limited thereto. In another embodiment, the holder 620 can be connected to a bar-shaped or frame-shaped adjustment member to form a linking mechanism with the adjustment member. In this embodiment, the support mechanism is illustrated as a scissors-like support mechanism, but not limited thereto. In another embodiment, the support mechanism can be a butterfly type support mechanism, which includes two frames disposed at two sides under the keycap and movably connected between the keycap and the base, so that the lower ends of the two frames can move closer to each other or away from each other in response to the movement of the keycap relative to the base. In the case that the support mechanism has the butterfly configuration, the cam portion can be disposed corresponding to the tactile adjustment unit on the keycap end of one of the two frames, so that the tactile feedback adjustment similar to FIGS. 19A and 20A can be achieved by moving the tactile adjustment unit relative to the cam portion. In addition, according to practical applications, in the case that the support mechanism has the butterfly configuration, two cam portions can be disposed corresponding to two tactile adjustment units on the keycap end of each of the two frames, so that the tactile feedback adjustment similar to FIGS. 14A to 16A can be achieved by moving one or two of the two tactile adjustment units relative to the cam portions.

Figure 21:
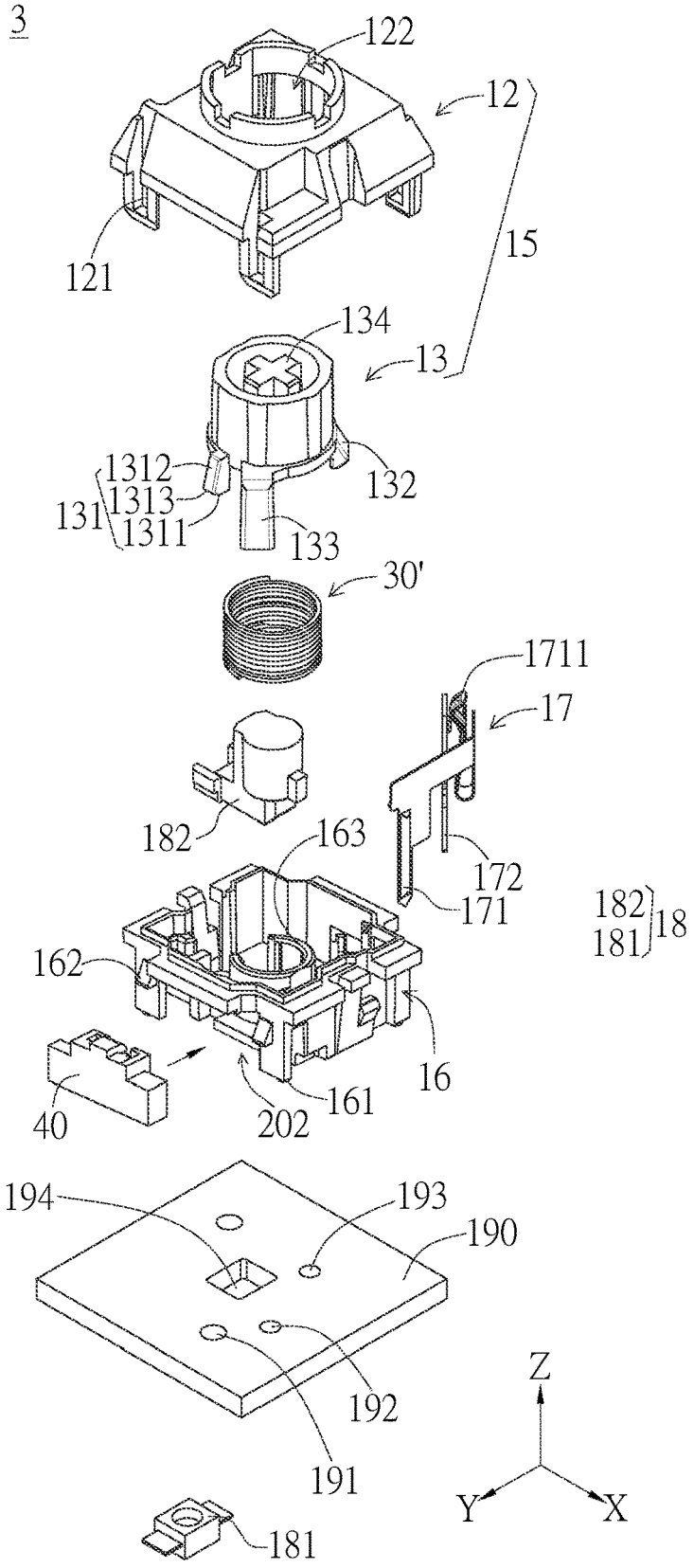
FIG. 21 is an exploded view of a fifth embodiment of the keyswitch structure of the invention.

In the previous embodiments, the cap (10 or 11) is embodied as the keycap, but not limited thereto. In another embodiment, as shown in FIG. 21, the cap 15 can be embodied as a casing, which can be combined with the base 16. As shown in FIG. 21, the cap 15 includes a cap body 12 and a plunger 13. The cap body 12 is combined with the base 16 to form a casing, and the cap body 12 has a through hole 122. The plunger 13 is movably inserted into the through hole 122, and the cam portion 131 is disposed on the plunger 13. The keyswitch structure 3 may further include an electrode module 17, a light source unit 18, a circuit board, a baseplate, and any components as appropriate. The electrode module 17 is disposed on the base 16 corresponding to the plunger 13 to function as the switch unit. When the plunger 13 moves toward the base 16, the electrode module 17 is triggered to generate a triggering signal. The light source unit 18 includes a light source 181 and a light guide rod 182, which are configured to provide light to form a lighting keyswitch.

Specifically, the base 16 can be disposed on the baseplate or the circuit board. In this embodiment, the base 16 is disposed on the printed circuit board 190 as an example, but not limited thereto. In another embodiment, when the base 16 is disposed on the baseplate, the circuit board can be selectively disposed above or under the baseplate. In an embodiment, the base 16 and the circuit board 190 can be positioned by a positioning mechanism. For example, the base 16 may have a positioning post 161, and the circuit board 190 has a hole 191 corresponding to the positioning post 161, so that the base 16 can be positioned on the circuit board 190 by inserting the positioning post 161 into the hole 191, but not limited thereto. In another embodiment, the locations of post and hole can be exchanged, or the base 16 can be positioned on the underlying component (e.g. circuit board 190 or baseplate) by screwing, adhering, leaning thereon, or any suitable methods.

The base 16 is preferably a lower casing extending along the X, Y, and Z axis directions, and the cap body 12 can be an upper casing corresponding to the base 16. The base 16 is combined with the cap body 12 to form a casing having an accommodation space therein, and the accommodation space is configured to accommodate the restoring member 30', the electrode module 17, the light source unit 18. For example, the base 16 has a hook-like portion 162, and the cap body 12 has an engaging hole 121, so that the base 16 and the cap body 12 can be combined along the Z axis direction by engaging the hook-like portion 162 with the engaging hole 121.

The though hole 122 is formed on top of the cap body 12 corresponding to the plunger 13, so that the plunger 13 can be inserted into the through hole 122 from the bottom of the cap body 12, and the top of the plunger 13 protrudes from the through hole 122. The plunger 13 preferably has the cam portion 131, an actuating portion 132, a restricting portion 133, and a coupling portion 134. For example, the plunger 13 is preferably a barrel-like object, and the cam portion 131, the actuating portion 132, and the restricting portion 133 are disposed along the periphery of the lower end of the plunger 13 while the coupling portion 134 is disposed on top of the plunger 13.

Specifically, the cam portion 131 includes a bump extending downward. The bump has a lower surface 1311, an upper surface 1312, and a protrudent point 1313 between the lower surface 1311 and the upper surface 1312. For example, the bump can be an angular block, and the lower surface 1311 and the upper surface 1312 are preferably inclined toward each other and connected at the protrudent point 1313. That is, the protrudent point 1313 protrudes outward (e.g. in the Y-axis direction) with respect to the lower surface 1311 and the upper surface 1312. The actuating portion 132 is disposed corresponding to the electrode module 17, and the actuating portion 132 is preferably a block (e.g. angular block) and configured to selectively trigger the electrode module 17 to generate the triggering signal. The restricting portion 133 is preferably a pillar, and two restricting portions 133 radially extend from two opposite sides of the plunger 13, so that the distance between the two pillars is larger than the size of the through hole 122 to prevent the plunger 13 from escaping from the cap body 12 when the plunger 13 moves relative to the base 16 upwardly. The coupling portion 134 can be a cross-shaped protrusion formed on the top of the plunger 13 and is configured to couple a keycap (not shown), but not limited thereto. In other embodiments, the coupling portion 134 can have other configurations (e.g. a coupling hole) to couple the keycap.

In this embodiment, the restoring member 30' can be embodied as a spring, and the restoring member 30' is positioned on the base 16. For example, the base 16 can have a ring-shaped wall 163, which extends from the bottom surface of the base 16 toward the cap body 12. One end of the spring (i.e., the restoring member 30') can be sleeved on the ring-shaped wall 163, and the other end of the spring is against the bottom surface of the plunger 13, so that the top portion of the plunger 13 protrudes from the through hole 122 of the cap body 12. As such, when the keycap is pressed to push the plunger 13 to move toward the base 16, the plunger 13 compresses the spring, and when the pressing force is released, the spring provides the restoring force to enable the plunger 13 to move away from the base 16 to the position before being pressed. Moreover, with the disposition of the light source unit 18, the base 16 is preferably configured to accommodate the light guide rod 182. For example, the light guide rod 182 can be disposed within the space surrounded by the ring-shaped wall 163, and the spring is positioned on the outer side of the ring-shaped wall 163. The base 16 is preferably formed with an opening at its bottom, and the light source 181 can be disposed corresponding to the opening under the light guide rod 182 and configured to emit light toward the light guide rod 182. In this embodiment, the light source 181 is preferably a light-emitting diode disposed corresponding to the opening 194 of the circuit board 190, but not limited thereto.

The electrode module 17 includes a first electrode piece 171 and a second electrode piece 172 respectively disposed on the base 16 and electrically connected to the circuit board 190. For example, the first electrode piece 171 and the second electrode piece 172 are preferably inserted into electrode holes of the base 16 and further protrude out of the base 16 to be electrically connected to a first coupling hole 192 and a second coupling hole 193 of the circuit board 190, but not limited thereto. In another embodiment, the circuit board 190 may not have the coupling holes, and the first electrode piece 171 and the second electrode piece 172 can be electrically connected to surface contact areas of the circuit board 190. In this embodiment, the first electrode piece 171 preferably abuts against the inner wall surface of the base 16, and the second electrode piece 172 is disposed corresponding to the first electrode piece 171. The first electrode piece 171 preferably has a flexible portion 1711 disposed corresponding to the actuating portion 132 of the plunger 13, so that in response to the movement of the actuating portion 132, the first electrode piece 171 and the second electrode piece 172 can be selectively contacted to each other and triggered to generate the triggering signal. For example, when the keyswitch structure 3 is at the non-pressed position, the protrudent portion of the actuating portion 132 pushes the flexible portion 1711 outward away from the second electrode piece 172, so that the first electrode piece 171 and the second electrode piece 172 are not contacted or conducted, and no triggering signal is generated. When the plunger 13 is pressed and moves toward the base 16, the actuating portion 132 moves downward along with the plunger 13, so that the protrudent portion passes over the flexible portion 1711, enabling the flexible portion 1711 to bounce toward the second electrode piece 172. Therefore, the first electrode piece 171 and the second electrode piece 172 are contacted or conducted, and the triggering signal is generated.

It is noted that the electrode module 17 is illustrated as the switch unit of the keyswitch structure 3 in the embodiment, but not limited thereto. In another embodiment, the keyswitch structure 3 may have other types of switch unit, which selectively generates the triggering signal in response to the movement of the plunger 13. For example, the keyswitch structure 3 can include an emitter and a receiver, which are electrically connected to the circuit board 190 to function as the switch unit, i.e. optical switch, so that the keyswitch structure 3 can generate the triggering signal by changing the amount of light received by the receiver from the emitter when the plunger 13 moves toward the base 16.

In this embodiment, the first tactile adjustment unit 40 can have a structure similar to that shown in FIG. 1A, but not limited thereto. In another embodiment, the first tactile adjustment unit 40 can be replaced with the tactile adjustment unit 40' or 50 shown in the previous embodiments. Similar to the embodiment of FIG. 1A, the base 16 can have an opening 202, and the opening 202 is formed at one side of the base 16, such as at the sidewall in the Y axis direction. The first holder 420 of the first tactile adjustment unit 40 is disposed corresponding to the opening 202 at one side of the base 16. When the cap body 12 is combined with the base 16, the cam portion 131 of the plunger 13 faces toward the opening 202 of the base 16 to correspond to the first tactile feedback member 410.

Figure 22A:
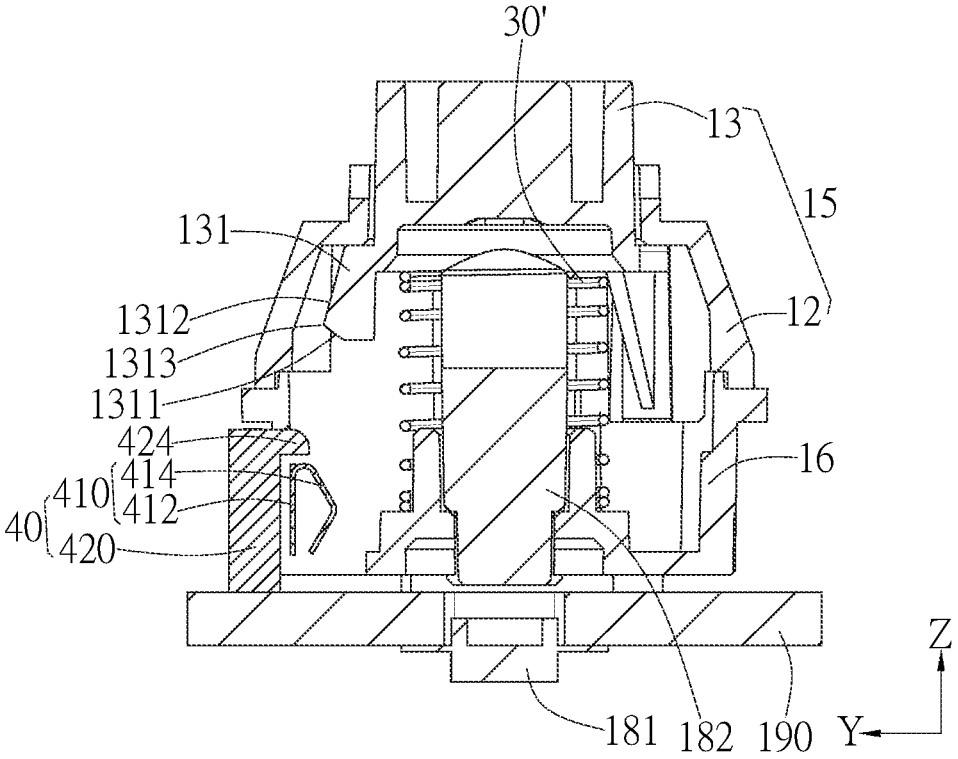
FIGS. 22A and 22B are cross-sectional views of the keyswitch structure of FIG. 21 having the first tactile feedback and the second tactile feedback at the non-pressed state, respectively.

Referring to FIG. 22A, an embodiment of the keyswitch structure 3 having the first tactile feedback is illustrated. As shown in the figures, the first tactile adjustment unit 40 can move relative to the base 16 (i.e., the first holder 420 moves relative to the base 16), so that the position of the first tactile feedback member 410 mounted on the first holder 420 relative to the moving path of the cam portion 131 can be changed. In this embodiment, when the first holder 420 moves relative to the base 16 toward the opening 202 (e.g. toward the righthand side), the first tactile feedback member 410 moves along with the first holder 420 to be located inside the moving path of the first cam portion 131, i.e., the movable portion 414 at least partially overlaps the cam portion 131 in the Z axis direction. With such a configuration, when the keycap is pressed, the keycap drives the cam portion 131 of the plunger 13 to move downward and compress the spring (i.e., the restoring member 30'), and during the downward movement of the cam portion 131, the cam portion 131 interferes with the movable portion 414 of the first tactile feedback member 410, such as the cam portion 131 pressing the movable portion 414 toward the positioning portion 412. When the keycap keeps moving downward to trigger the electrode module 17, and the cam portion 131 passes the movable portion 414 (i.e., the movable portion 414 moves across the protrudent point 1313 of the cam portion 131), the movable portion 414 is released to rebound away from the positioning portion 412 and bounce upward, so that the first tactile feedback member 410 hits the restricting portion 424 to generate a sound, and the keyswitch structure 3 provides the first tactile feedback. When the keyswitch structure 3 is in such a status, the pressing force required for the cam portion 131 to move across the first tactile feedback member 410 is relatively larger, and the sound can be generated. When the keycap is released, by means of the restoring force provided by the restoring member 30', the keycap can move upward relative to the base 16 and return to the non-pressed position, as shown in FIG. 22A.

Figure 22B:
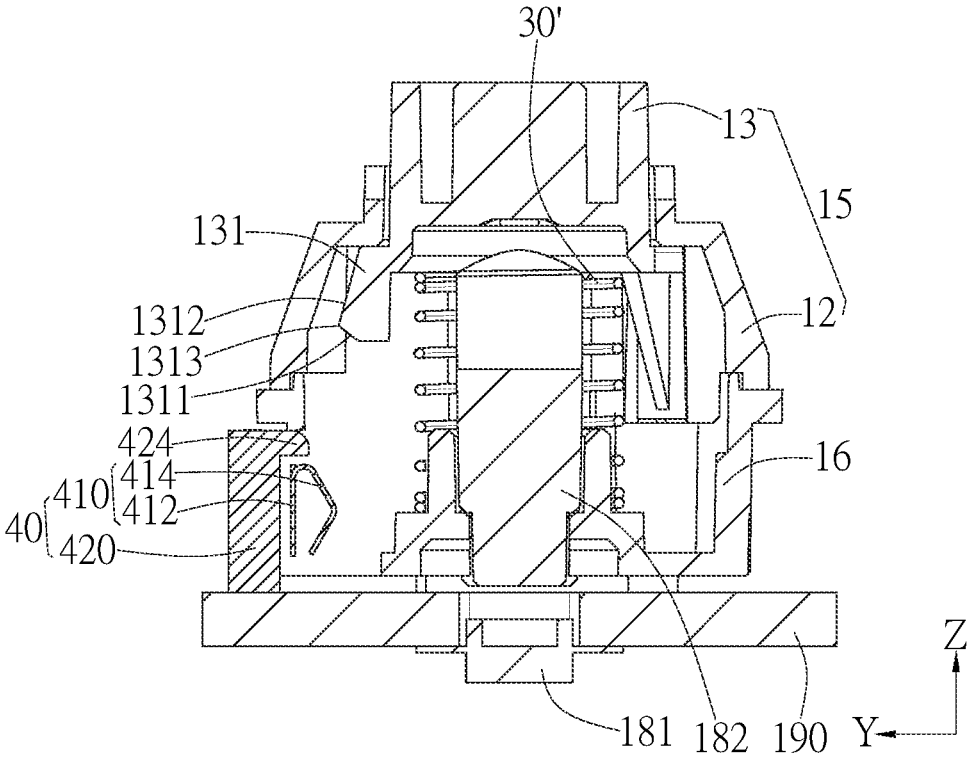

Referring to FIG. 22B, an embodiment of the keyswitch structure 3 having the second tactile feedback is illustrated. As shown in the figures, when the first holder 420 moves relative to the base 16 away from the opening 202 e.g. toward the left-hand side), the first tactile feedback member 410 moves along with the first holder 420 to be located outside the moving path of the cam portion 131, i.e., the movable portion 414 does not overlap the cam portion 131 in the Z axis direction. With such a configuration, when the keycap is pressed, the keycap drives the cam portion 131 of the plunger 13 to move downward and compress the spring (i.e., the restoring member 30') to trigger the electrode module 17, and during the downward movement of the cam portion 131, the cam portion 131 does not interfere with the movable portion 414 of the first tactile feedback member 410 since the movable portion 414 is located outside the moving path of the first cam portion 131, so that the keyswitch structure 3 provides the second tactile feedback, i.e., soundless linear tactile feedback. When the keyswitch structure 3 is in such a status, the pressing force required for the first cam portion 131 to move across the first tactile feedback member 410 is relatively smaller, and no sound will be generated.

In the previous embodiments, by moving the tactile adjustment unit such as 40, 40', 50, 60, the entire tactile feedback member (e.g. 410, 410', 510, 610) can be moved, so that the tactile feedback member itself will not deform during the process of adjusting the tactile feedback. As such, the consistency of tactile feedback adjustment can be improved, and the service life of the tactile feedback member can be enhanced. Moreover, by mounting the tactile feedback member on the holder to form a modular adjustment unit, the assembling convenience and the adjustment accuracy can be improved.

Figure 23A:
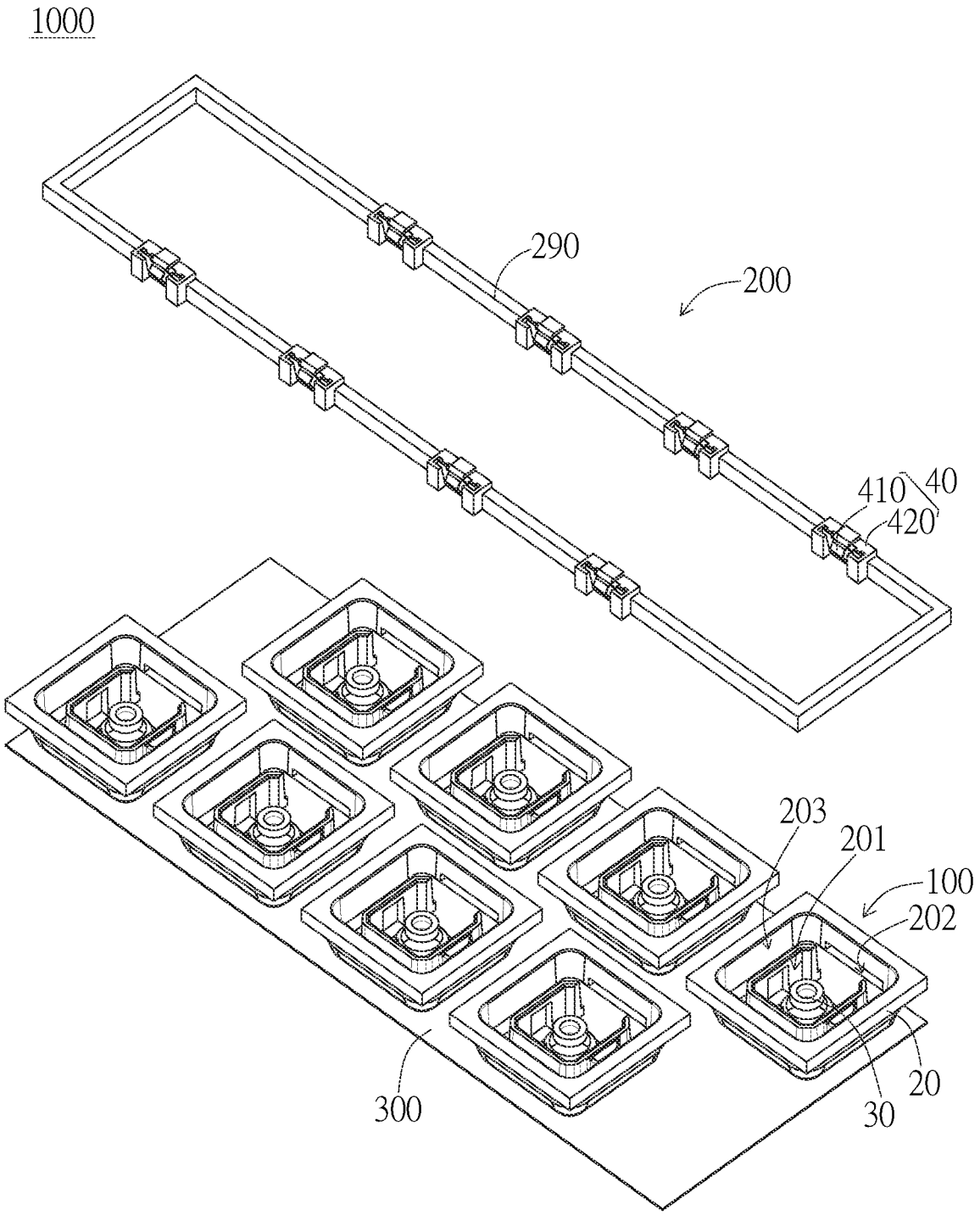
FIGS. 23A and 23B are a partially exploded view and an assembled view of the keyboard in an embodiment of the invention.
Figure 23B:
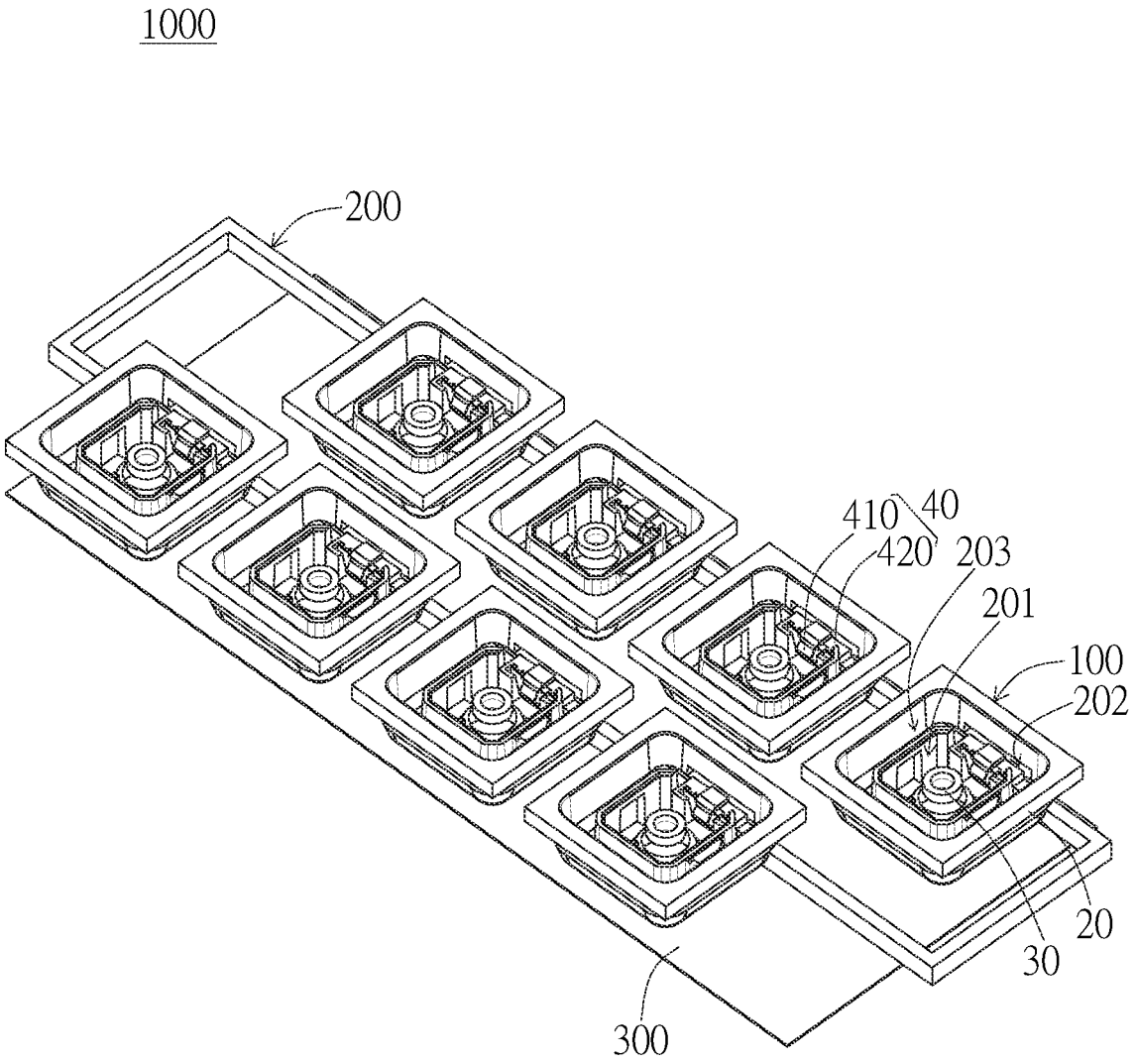

In another embodiment, the invention provides a keyboard including the keyswitch structures (e.g. 1, 1A, 1', 2, 3) described above. As shown in FIGS. 23A and 23B, the keyboard 1000 includes a plurality of keyswitch structures 100 and a tactile adjustment mechanism 200. In this embodiment, the keyboard 1000 is illustrated with eight keyswitch structures 100, which are arranged in two rows, but not limited thereto. In other embodiments, according to practical applications, the number of the keyswitch structures 100 in the keyboard 1000 can be more or less than eight, and the keyswitch structures 100 can be arranged in one or more rows. In this embodiment, the keyswitch structure 100 is illustrated to have a structure similar to that of FIG. 1A, and for convenience of explanation, the cap is not shown. In other words, the cap, the base 20, the restoring member 30 of the keyswitch structure 100 can be referred to related descriptions of FIG. 1A and will not be elaborated again. The rubber domes, the switch units, or the baseplates of the plurality of keyswitch structures 100 can be connected to form an integral component, so that the bases 20 of the plurality of keyswitch structures 100 can be integrated on a single plate component, such as baseplate 300, so as to enhance the assembling efficiency.

The tactile adjustment units of the plurality of keyswitch structures 100 can be integrated into the tactile adjustment mechanism 200 having a plurality of tactile adjustment units 40. For example, the tactile adjustment mechanism 200 can include an adjustment frame 290 and a plurality of tactile feedback members 410, which are disposed on the adjustment frame 290 corresponding to the plurality of keyswitch structures 100, respectively. For example, the plurality of holders 420 are connected to each other to form a rectangular tactile adjustment frame 290, which corresponds to the two rows of keyswitch structures 100. Specifically, the plurality of keyswitch structures 100 are arranged in a plurality of rows, such as two rows in this embodiment, with the opening 202 of the base 20 located at the same side, and the plurality of holders 420 disposed corresponding to the openings 202 on a plurality of ribs (e.g. two ribs) of the tactile feedback frame 290. As such, the tactile adjustment frame 290 of the tactile adjustment mechanism 200 is be movable relative to the plurality of keyswitch structures 100 to change a position of the first tactile feedback member 410 in each of the keyswitch structures 100 relative to the cam portion (such as 130 shown in FIG. 1A), so as to change tactile feedback of the plurality of keyswitch structures 100.

The tactile feedback adjustment of the keyswitch structure 100 can be referred to the related descriptions of the previous embodiments and will not be elaborated again.

Figure 24:
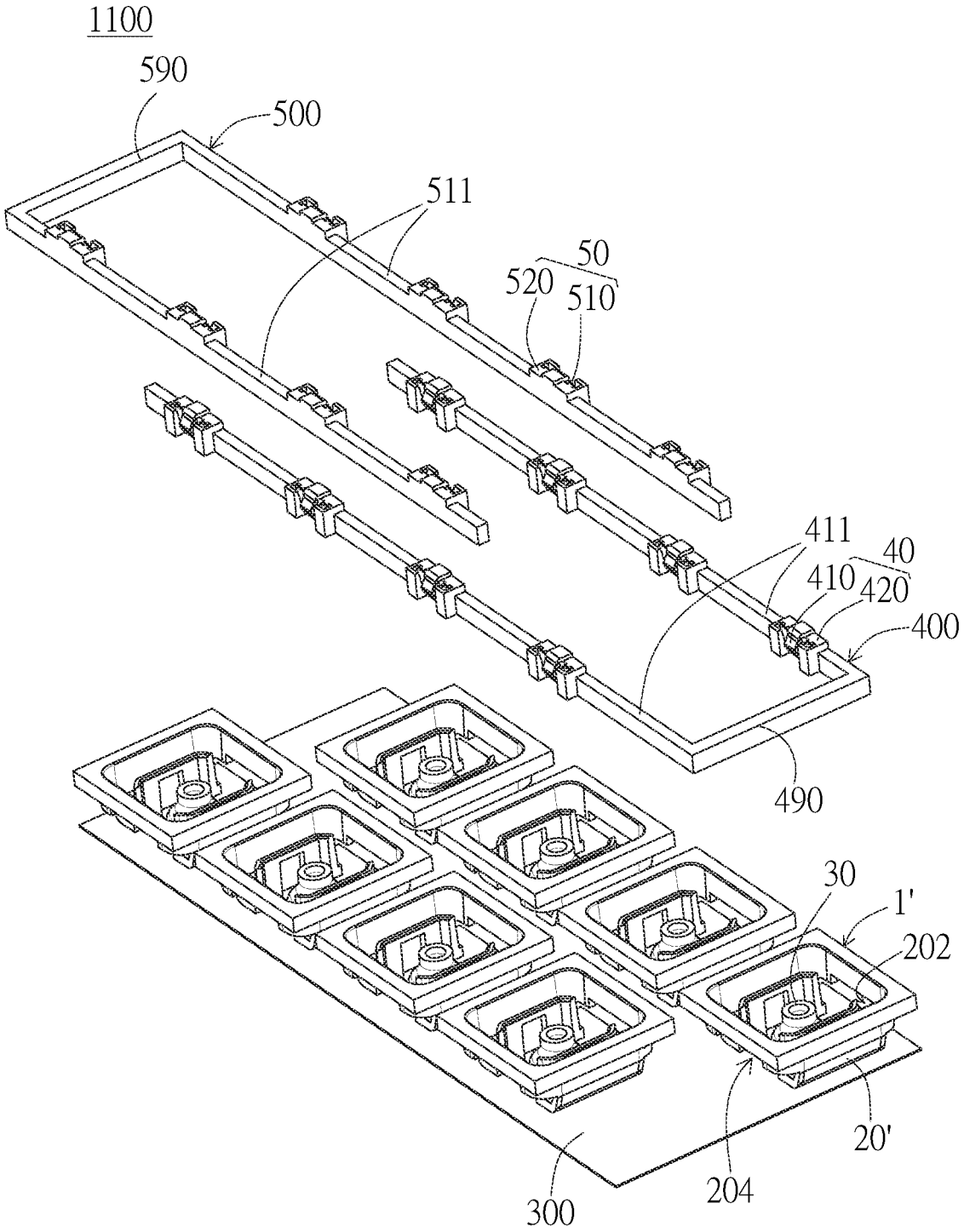
FIGS. 24 to 26 are partially exploded views of the keyboard in different embodiments of the invention.

The keyswitch structure 100 is illustrated to have a structure similar to that of FIG. 1A, but not limited thereto. In another embodiment, the keyswitch structure 100 of the keyboard can be replaced with the keyswitch structure (e.g. 1A, 1', 2, 3) of FIG. 7, 11A, 17A, or 21. As shown in FIG. 24, in another embodiment, the keyboard 1100 includes the keyswitch structures 1' of FIG. 11A. For example, the base 20' of each of the plurality of keyswitch structures 1' has two openings 202 and 204, and the two tactile adjustment units 40 and 50 of the plurality of keyswitch structures 1' are integrated into a tactile adjustment mechanism 400 having a plurality of tactile feedback units 40 and a tactile adjustment mechanism 500 having a plurality of tactile feedback units 50. For example, the holders 420 of the plurality of tactile feedback units 40 are connected to each other to form a U-shaped adjustment frame 490 including two ribs 411 and correspond to the openings 202 of the two rows of keyswitch structures 1'. Similarly, the holders 520 of the plurality of tactile feedback units 50 are connected to each other to form a U-shaped adjustment frame 590 including two ribs 511 and correspond to the openings 204 of the two rows of keyswitch structures 1'. The U-shaped frame 490 of the tactile adjustment mechanism 400 and the U-shaped frame 590 of the tactile adjustment mechanism 500 are arranged staggeredly with the U-shaped openings facing each other and independently moved with respect to each other. As such, by independently controlling the movement of the tactile adjustment frame 490 or 590, the plurality of keyswitch structures 1' can at least provide the tactile feedback similar to that of FIGS. 14A, 15A, and 16A. The tactile feedback adjustment of the keyswitch structure 1' can be referred to the related descriptions of the previous embodiments and will not be elaborated again. In addition, the configuration of the tactile adjustment frames 490 and 590 can be modified according to practical applications. For example, when the keyswitch structures 1' are arranged in more than three rows, the tactile adjustment frame 490 or 590 can be configured as a comb-like frame including a plurality of ribs with one ends connected to a same connecting bar and the other ends extending parallel to each other from the connecting bar.

Figure 25:
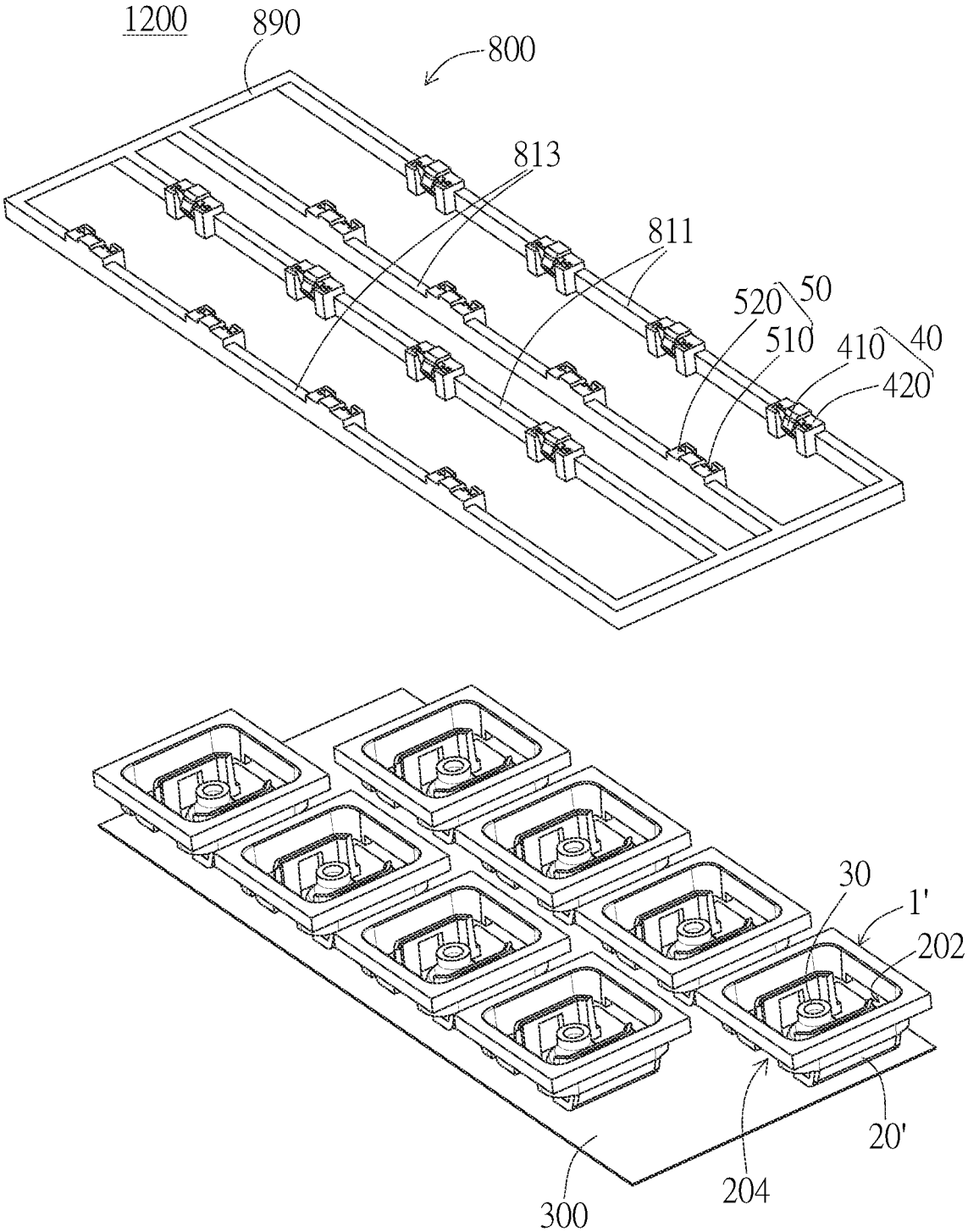

In another embodiment, as shown in FIG. 25, the keyboard 1200 has the tactile adjustment mechanisms 400 and 500 integrated into a single tactile adjustment mechanism 800. For example, the tactile adjustment mechanism 800 includes a plurality of ribs such as 811, 813, which are connected to each other to form a bar frame 890. The holders 420 of the plurality of tactile adjustment units 40 are disposed on the ribs 811 and correspond to the openings 202 of the base 20', respectively. The holders 520 of the plurality of tactile adjustment units 50 are deposed on the ribs 813 and correspond to the openings 204 of the base 20', respectively. The ribs 811 and the ribs 813 are alternatingly arranged, so that the movable portions such as 414 and 514 of the tactile feedback members 410 and 510 mounted thereon face toward each other to form the configuration similar to that of FIG. 14A. As such, by controlling the movement of the tactile adjustment frame 890, the plurality of keyswitch structures 1' can selectively provide the tactile feedback similar to that of FIG. 14A, 15A, or 16A. In other words, the adjustment frame 400 and the adjustment frame 500 are integrated with each other to form a linking mechanism, such as the single tactile adjustment mechanism 800. The tactile feedback adjustment of the keyswitch structure 1' can be referred to the related descriptions of the previous embodiments and will not elaborate again.

Figure 26:
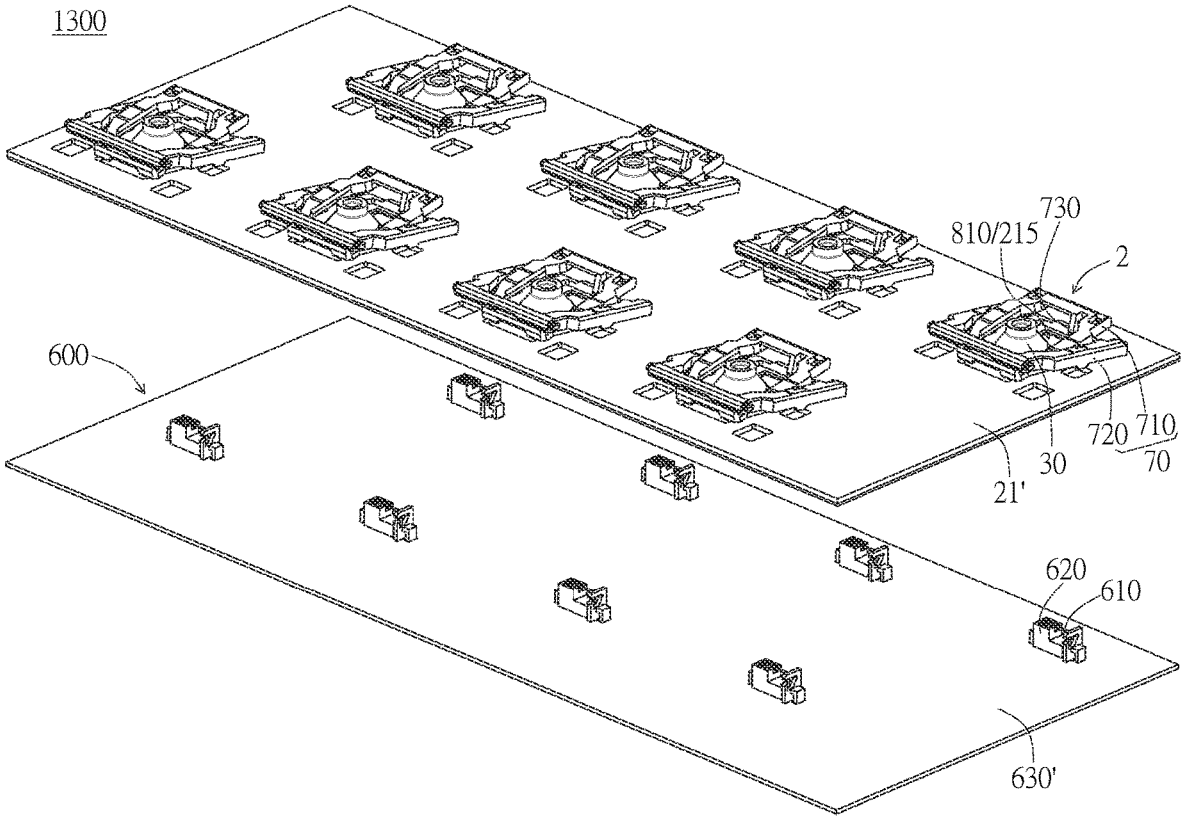

As shown in FIG. 26, in another embodiment, the keyboard 1300 has the keyswitch structures 2 of FIG. 17A. In other words, the cap, the base, the restoring member 30 of the keyswitch structure 2 can be referred to related descriptions of FIG. 17A and will not be elaborated again. The bases (e.g. 21 in FIG. 17A) of the plurality of keyswitch structures 2 can be integrated on a single baseplate 21', and the rubber domes or the switch units of the plurality of keyswitch structures 2 can be connected to form an integral component. so as to enhance the assembling efficiency. In other words, the baseplate 21' can have a plurality of connection members such as 211 and 213 for coupling the support mechanisms 70 of the plurality of keyswitch structures 2 and a plurality of openings (e.g. 215) corresponding to the tactile adjustment units of the plurality of keyswitch structures 2. In this embodiment, the tactile adjustment mechanism 600 includes an adjustment plate 630', a plurality of holders 620, and a plurality of tactile feedback members 610. The plurality of holders 620 are disposed on the adjustment plate 630' corresponding to the plurality of keyswitch structures 2, and the plurality of tactile feedback members 610 are mounted on the holders 620, respectively. The adjustment plate 630' moves relative to the keyswitch structures 2 to change a position of the tactile feedback member 610 in each of the keyswitch structures 2 relative to the cam portion (e.g. 730), so as to change tactile feedback of the plurality of keyswitch structures 2. Specifically, the adjustment plates (e.g. 630) of the plurality of keyswitch structures 2 are connected to form the integral adjustment plate 630', and the plurality of holders 620 couples with the adjustment plate 630' respectively corresponding to the openings 215 of the plurality of keyswitch structures 2, so that when the adjustment plate 630' is disposed below the plurality of keyswitch structures 2, each of the holders 620 protrudes from the corresponding opening 215 above the base such as baseplate 21'. By moving the adjustment plate 630' of the tactile adjustment mechanism 600, the plurality of keyswitch structures 2 can selectively provide different tactile feedbacks, such as the tactile feedback shown in FIG. 19A or 20A. The tactile feedback adjustment of the keyswitch structure 2 can be referred to the related descriptions of the previous embodiments and will not elaborate again.

In the previous embodiments of keyboard, the tactile adjustment mechanism can be positioned by means of positioning mechanism to maintain the provision of the desired tactile feedback of the plurality of keyswitch structures. For example, by means of engagement mechanism, magnetic components, the adjustment frame or the adjustment plate of the tactile adjustment mechanism can be secured at the place with respect to the plate component (e.g. baseplate 300 or 21') of the plurality of keyswitch structures after performing the tactile adjustment process, such as at the position for providing the first, second, or third tactile feedback, so that the keyswitch structures of the keyboard can be maintained to provide the desired tactile feedback after the tactile adjustment, but not limited thereto. In another embodiment, the process of adjusting the tactile feedback can be performed by a driver (such as a motor), which drives the tactile adjustment mechanism of the keyboard to change the tactile feedback of the keyswitch structures and enables the keyswitch structures to provide the desired tactile feedback after the adjustment of tactile feedback.

In the above embodiments, the keyboard is illustrated that each of the plurality of keyswitch structures corresponds to a tactile adjustment unit, but not limited thereto. In another embodiment, by disposing the holder having the tactile feedback member mounted thereon corresponding to a selected keyswitch structure, or by mounting the tactile feedback member on a selected holder, only some of the keyswitch structures of the keyboard will have the tactile adjustment function, such as the W, A, S, D keys, and the rest of the keyswitch structures do not provide the tactile adjustment function, so as to fulfill the operation requirements of users for different operation situations, such as gaming. In the above embodiments, the tactile adjustment units in the plurality of keyswitch structures of the keyboard preferably have the same tactile feedback member, so that each keyswitch structure substantially provides the same tactile feedback, but not limited thereto. According to practical applications, the tactile feedback members of the tactile adjustment units can be different, so that the keyswitch structures in one keyboard may provide different tactile feedback after one time tactile adjustment.

Although the preferred embodiments of the present invention have been described herein, the above description is merely illustrative. The preferred embodiments disclosed will not limit the scope of the present invention. Further modification of the invention herein disclosed will occur to those skilled in the respective arts and all such modifications are deemed to be within the scope of the invention as defined by the appended claims.

What is claimed is:

1. A keyswitch structure, comprising:

a base;

a cap disposed corresponding to the base, the cap having a first cam portion movable relative to the base;

a restoring member disposed between the base and the cap and configured to provide a restoring force to enable the first cam portion to move away from the base; and a movable first tactile adjustment unit disposed corresponding to the first cam portion, the movable first tactile adjustment unit comprising a first holder and a first tactile feedback member mounted on the first holder to be moved with the first holder, wherein the first holder is movable relative to the base to change a position of the first tactile feedback member relative to the first cam portion before the cap is pressed, so as to change a pressing force required for the first cam portion to move toward the base when the cap is pressed, wherein the first holder moves to drive the first tactile feedback member inside or outside a moving path of the first cam portion; when the first tactile feedback member is located inside the moving path, and the cap moves toward the base, the first cam portion interferes with the first tactile feedback member; when the first tactile feedback member is located outside the moving path, and the cap moves toward the base, the first cam portion passes the first tactile feedback member without interfering therewith.

2. The keyswitch structure of claim 1, wherein the base has an accommodation space and a first opening communicating with the accommodation space; the restoring member is disposed in the accommodation space, and the first holder is disposed at one side of the base corresponding to the first opening, so that the first tactile feedback member faces the accommodation space.

3. The keyswitch structure of claim 2, wherein the base comprises an inner wall, an outer wall, and a bottom connected to lower ends of the inner wall and the outer wall, so that a movement space is defined between the inner wall and the outer wall, and the accommodation space is at an inner side of the inner wall.

4. The keyswitch structure of claim 3, wherein the cap is a keycap movably combined with the base; the keycap comprises a keytop and a keyskirt surrounding the keytop and extending toward the base; the first cam portion is disposed on a bottom of the keytop; when the keycap moves relative to the base, the keyskirt moves in the movement space.

5. The keyswitch structure of claim 4, wherein the keycap comprises a first guiding portion extending from the keytop toward the base; the base comprises a second guiding portion; when the keycap moves relative to the base, the first guiding portion and the second guiding portion moves relatively along each other.

6. The keyswitch structure of claim 5, wherein the keycap comprises a first engaging portion extending from the keytop toward the base; the base comprises a second engaging portion; when the keycap is combined with the base, the first engaging portion movably engages with the second engaging portion.

7. The keyswitch structure of claim 1, wherein the first tactile feedback member comprises an elastic member having a positioning portion and a movable portion; the positioning portion is positioned on the first holder; the movable portion is bent from one end of the positioning portion toward the positioning portion to be movable relative to the positioning portion.

8. The keyswitch structure of claim 7, wherein the first holder comprises a positioning structure and a restricting portion; the positioning portion is positioned by the positioning structure; the restricting portion is disposed corresponding to the movable portion to restrict movement of the elastic member.

9. The keyswitch structure of claim 1, further comprising a second tactile adjustment unit, wherein the cap further has a second cam portion; the second tactile adjustment unit is disposed corresponding to the second cam portion and comprises a second holder and a second tactile feedback member mounted on the second holder; the second holder is movable relative to the base to change a position of the second tactile feedback member relative to the second cam portion, so as to change the pressing force required for the second cam portion to move toward the base.

10. The keyswitch structure of claim 9, wherein when the first tactile adjustment unit interferes with the first cam portion, the pressing force required for the first cam portion to move toward the base is a first pressing force; when the second tactile adjustment unit interferes with the second cam portion, the pressing force required for the second cam portion to move toward the base is a second pressing force different from the first pressing force.

11. The keyswitch structure of claim 2, wherein the cap comprises a cap body and a plunger; the cap body is combined with the base and has a through hole; the plunger is movably inserted into the through hole, and the first cam portion is disposed on the plunger.

12. A keyswitch structure, comprising:

a base having an accommodation space and a first opening communicating with the accommodation space;

a cap disposed corresponding to the base, the cap having a first cam portion movable relative to the base;

a restoring member disposed between the base and the cap in the accommodation space and configured to provide a restoring force to enable the first cam portion to move away from the base; and a movable first tactile adjustment unit disposed corresponding to the first cam portion, the movable first tactile adjustment unit comprising a first holder and a first tactile feedback member mounted on the first holder to be moved with the first holder, wherein the first holder is disposed at one side of the base corresponding to the first opening, so that the first tactile feedback member faces the accommodation space, wherein the first holder is movable relative to the base to change a position of the first tactile feedback member relative to the first cam portion before the cap is pressed, so as to change a pressing force required for the first cam portion to move toward the base when the cap is pressed.

13. The keyswitch structure of claim 12, wherein the base comprises an inner wall, an outer wall, and a bottom connected to lower ends of the inner wall and the outer wall, so that a movement space is defined between the inner wall and the outer wall, and the accommodation space is at an inner side of the inner wall.

14. The keyswitch structure of claim 13, wherein the cap is a keycap movably combined with the base; the keycap comprises a keytop and a keyskirt surrounding the keytop and extending toward the base; the first cam portion is disposed on a bottom of the keytop; when the keycap moves relative to the base, the keyskirt moves in the movement space.

15. The keyswitch structure of claim 14, wherein the keycap comprises a first guiding portion extending from the keytop toward the base; the base comprises a second guiding portion; when the keycap moves relative to the base, the first guiding portion and the second guiding portion moves relatively along each other.

16. The keyswitch structure of claim 15, wherein the keycap comprises a first engaging portion extending from the keytop toward the base; the base comprises a second engaging portion; when the keycap is combined with the base, the first engaging portion movably engages with the second engaging portion.

17. The keyswitch structure of claim 12, wherein the cap comprises a cap body and a plunger; the cap body is combined with the base and has a through hole; the plunger is movably inserted into the through hole, and the first cam portion is disposed on the plunger.

* * * * *